US006988838B2

(12) United States Patent
Inokuchi et al.

(10) Patent No.: US 6,988,838 B2
(45) Date of Patent: Jan. 24, 2006

(54) INK JET RECORDING APPARATUS

(75) Inventors: Hidehiko Inokuchi, Ogori (JP); Yutaka Miyazono, Kasuga (JP); Masaharu Tanaka, Maebaru (JP); Hiroyuki Ogata, Chikushino (JP); Kenji Kanabo, Kurume (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 151 days.

(21) Appl. No.: 10/609,811

(22) Filed: Jun. 30, 2003

(65) Prior Publication Data

US 2004/0141787 A1 Jul. 22, 2004

(30) Foreign Application Priority Data

Jul. 1, 2002 (JP) ..... P. 2002-191884
Jul. 8, 2002 (JP) ..... P. 2002-198379
Jul. 25, 2002 (JP) ..... P. 2002-216324

(51) Int. Cl.

| | |
|---|---|
| ***B41J 2/01*** | (2006.01) |
| ***B41J 3/407*** | (2006.01) |
| ***B65H 1/00*** | (2006.01) |
| ***B65H 1/08*** | (2006.01) |
| ***B65H 1/22*** | (2006.01) |

(52) U.S. Cl. ..... 400/59; 400/55; 347/104; 347/108

(58) Field of Classification Search ..... 400/55, 400/59, 693; 347/108, 104
See application file for complete search history.

(56) References Cited

U.S. PATENT DOCUMENTS

| | | | | |
|---|---|---|---|---|
| 4,698,650 | A | 10/1987 | Watanabe et al. | 346/134 |
| 6,132,122 | A | 10/2000 | Robinson et al. | 400/624 |
| 6,276,852 | B1 | 8/2001 | Osmus | 400/624 |
| 6,296,407 | B1 | 10/2001 | McKay et al. | 400/624 |
| 6,340,256 | B1 | 1/2002 | McKay et al. | 400/624 |
| 2001/0019349 | A1 | 9/2001 | Kawakami | 347/108 |
| 2002/0067940 | A1 * | 6/2002 | Sasai et al. | 400/61 |
| 2002/0145636 | A1 * | 10/2002 | Jones et al. | 347/2 |
| 2003/0151653 | A1 | 8/2003 | Inokuchi et al. | 347/104 |
| 2003/0156172 | A1 | 8/2003 | Matsuba et al. | 347/86 |

FOREIGN PATENT DOCUMENTS

| | | | |
|---|---|---|---|
| EP | 0 574 860 | A2 | 12/1993 |
| EP | 0 799 710 | A1 | 10/1997 |
| JP | 06031906 | A * | 2/1994 |
| JP | 2001058735 | A * | 3/2001 |
| JP | 2001-191613 | | 7/2001 |
| JP | 2001-315409 | | 11/2001 |
| JP | 2001-319074 | | 11/2001 |
| JP | 2002-086841 | | 3/2002 |
| JP | 2002-127526 | | 5/2002 |
| WO | WO 9952713 | A1 * | 10/1999 |

OTHER PUBLICATIONS

English translation of Japanses Patent 06–031906 to Arai et al.*

* cited by examiner

*Primary Examiner*—Daniel J. Colilla
(74) *Attorney, Agent, or Firm*—Pearne & Gordon LLP

(57) ABSTRACT

An ink jet recording apparatus includes a disc tray which is contained in the recording device and on which a DVD disc is to be placed, a select switch for switching between a protruding state and an accommodated state of the disc tray, and a sheet feed tray on which recording sheets are placed and which are disposed substantially parallel to the disc tray, wherein the select switch, the sheet feed tray and the disc tray are operated on the front side of the ink jet recording apparatus. Further, a disc tray is movable in a printing direction and a tray discharge direction. When the disc tray is loaded into or unloaded from the recording device, the disc tray is transported in the tray discharge direction to move to outside an ink jet recording device. In other cases than the above case, the disc tray is accommodated in the ink jet recording device. Thus, the disc tray is transported into two directions. Therefore, the ink jet recording device is reduced in size in the printing direction, and it is compactly accommodated in a television rack in a home.

46 Claims, 85 Drawing Sheets

INK JET RECORDING APPARATUS

BACKGROUND OF THE INVENTION

The present invention relates to an ink jet recording apparatus which is capable of printing an optical recording medium and a magnetic recording medium. More particularly, the invention relates to an ink jet recording apparatus which enables an operator to perform all of necessary operations from a specific one direction.

Recently, the ink jet recording apparatus (printer) comes to be connected not only to the computer but also to another devices, such as a television or VTR. The device installing location is also changing from a desk top to a location at which some or many persons come together, such as a living room. A recording device is proposed which is designed such that in consideration of stacking the recording device on other device, an operator may load and unload the ink cartridge, set recording sheets, and take out the recording sheets as set, from the front side of the recording device. A printer disclosed in JP-A-2001-191613, for example, is known for an example of such a recording device.

A digital information distributing system which directly prints on a portable data media, such as CDROM, is disclosed in JP-A-2001-319074.

In the case of those conventional recording devices, however, it is impossible to print on both a data media, such as a CD or a DVD, and a normal sheet (recording sheet).

An ink jet recording apparatus which is capable of printing on both a data media, such as a CD or a DVD and a normal sheet (recording sheet), is disclosed in JP-A-2002-127526. The ink jet recording apparatus is arranged such that an optical disc tray is inserted into the device through a sheet supplying port, and a paper delivery serration is separated from the discharge roller. Therefore, the operator needs additional work to insert the optical disc tray into the recording device through the sheet supplying port. Further, apart of the optical disc tray protrudes to outside the ink jet recording apparatus. Accordingly, space to install the ink jet recording apparatus is increased by an amount corresponding to the projection.

SUMMARY OF THE INVENTION

Accordingly, an object of the invention is to provide an ink jet recording apparatus which is compactly accommodated in, for example, a television rack in a home and in this state, is capable of printing on a normal paper or a thing other than the normal paper.

According to first aspect of the invention, there is provided an ink jet recording apparatus comprising: a medium holding plate which is contained in the ink jet recording apparatus and on which a first recording medium is to be placed; a select switch for switching a protruding state of the medium holding plate out of the ink jet recording apparatus and an accommodating state of the medium holding plate; a medium tray which is contained in the ink jet recording apparatus and on which a second recording medium is to be placed, the medium tray being substantially parallel to the medium holding plate; a first transporting system for reciprocatively moving the medium holding plate in a first direction and a second direction opposite to the first direction; a second transporting system for transporting the second recording medium in the first direction; and a recording head for ejecting ink to the first recording medium on the medium holding plate which is transported in the first direction by the first transporting system, and the second recording medium on the medium holding plate which is transported in the second direction by the second transporting system; wherein the select switch, the medium tray, and the medium holding plate are operated on the front side of the ink jet recording apparatus.

The first transporting system and the second transporting system may include each at least one transporting roller.

The first transporting system may include a motor, a pinion driven by the motor, and a gear which is provided on the medium holding plate so as to be in mesh with the pinion.

Preferably, the second transporting system includes a feed roller for transporting exclusively the second recording medium, and free rollers, in transporting the medium holding plate, the feed roller and the free roller ascend to be not in contact with the medium holding plate, and in transporting the second recording medium, the feed roller and the free roller descend to be in contact with the second recording medium.

Preferably, the first transporting system and the second transporting system include each a pinch roller provided opposite to the transporting roller, and when the medium holding plate is transported to the first direction, and when a leading end of the medium holding plate as viewed in the transporting direction passes between the transporting roller and the pinch roller, a distance between the transporting roller and the pinch roller is larger than a thickness of the medium holding plate.

It is preferable that a distance between the first recording medium and the recording head and a distance between the second recording medium and the recording head are kept constant.

The medium holding plate and the medium tray may be completely accommodated in the ink jet recording apparatus at least when the recording head starts to print.

The first recording medium may include at least one of an optical recording medium, a magnetic recording medium, an electronic recording medium, a plastic card, a resin solid material, and a metal solid material.

According to second aspect of the invention, there is provided an ink jet recording device having a medium holding plate on which an optical recording medium is to be placed, a transporting system for transporting the medium holding plate in a first direction, and a recording head for ejecting ink toward the optical recording medium on the medium holding plate, which is transported in the first direction by the transporting system, the improvement being characterized in that the medium holding plate is provided so as to be movable in a second direction which is different from the first direction, and when the optical recording medium is loaded into or unloaded from the ink jet recording device, the medium holding plate moves along the second direction to outside the ink jet recording device.

Thus, the medium holding plate on which the optical recording medium is to be placed may be transported in two directions, a first direction and a second direction. The medium holding plate is accommodated in the ink jet recording device at the time of printing on the optical recording medium. Accordingly, the ink jet recording device may compactly be accommodated in, for example, a television rack in a home.

When the recording head prints on the optical recording medium, the medium holding plate which is contained in the ink jet recording device is transported in the first direction.

When the optical recording medium is loaded into or unloaded from the ink jet recording device, the medium holding plate moves along the second direction to outside the ink jet recording device.

The ink jet recording device may further include: a motor for driving and moving the medium holding plate in the first direction; a first region in which the motor drives and moves the medium holding plate in the first direction; and a second region in which the transporting system drives and transports the medium holding plate in the first direction.

The ink jet recording device may further include a motor for driving and moving the medium holding plate in the second direction. With this feature, it is easy to load the optical recording medium into and unload it from the ink jet recording device.

The transporting system may include a pinch roller for transporting the medium holding plate in the first direction, and the ink jet recording device may include a pinch-roller distance changing mechanism which automatically changes a distance as viewed in thickness direction of the medium holding plate between the pinch roller and the medium holding plate in accordance with at least one of a thickness and a kind of the medium holding plate. With this feature, even if the thickness and the kind of the medium holding plate change, there is no need that the operator performs an adjusting work.

According to third aspect of the invention, there is provided an ink jet recording device having a medium holding plate on which an optical recording medium is to be placed, a medium supplying part for supplying a second recording medium, a pinch roller and a main roller, which form a first transporting system for transporting the medium holding plate, a pinch roller and a main roller, which form a second transporting system for transporting the second recording medium from the medium supplying part, and a recording head for ejecting ink to the first recording medium and the second recording medium on the medium holding plate, which is transported in a first direction by the first transporting system and the second transporting system, the improvement being characterized in that the medium holding plate is provided so as to be movable in a second direction which is different from the first direction, the medium holding plate moves along the second direction to outside the ink jet recording device only when the first recording medium may be loaded to or unloaded from the ink jet recording device, and the medium holding plate is accommodated in the ink jet recording device when the first recording medium may be loaded into or unloaded from the ink jet recording device.

Preferably, the medium supplying part is movable in the second direction.

Preferably, the medium holding plate is provided above the medium supplying part, and a recording sheet as the second recording medium on which the recording head prints is discharged into between the medium holding plate and the medium supplying part. In this case, the medium holding plate, the medium supplying part and a space to which the second recording medium is discharged are efficiently disposed.

Preferably, the ink jet recording device further includes: a motor for driving and moving the medium holding plate in the first direction; a first region in which the motor drives and moves the medium holding plate in the first direction; and a second region in which the transporting system drives and transports the medium holding plate in the first direction.

If the first region and the second region are disposed so as to partially overlap with each other, a drive by the motor partially overlaps with a drive by the first transporting system.

Preferably, the first transporting system and the second transporting system use a pinch roller for transporting the medium holding plate and the second recording medium in a first direction, and the ink jet recording device includes a pinch-roller distance changing mechanism which automatically changes a distance as viewed in thickness direction of the medium holding plate between the pinch roller and the medium holding plate in accordance with at least one of a thickness and a kind of the medium holding plate and/or the second recording medium.

When the medium holding plate is transported by the first transporting system and the recording sheet as the second recording medium is transported by the second transporting system, the pinch roller is commonly used, with a distance as viewed in thickness direction of the medium holding plate between the pinch roller and the medium holding plate, which is changed by the pinch-roller distance changing mechanism.

The ink jet recording device may further include a discharge tray into which the second recording medium on which the recording head prints is discharged, wherein a disc tray as the medium holding plate, a sheet feed cassette as the medium supplying part and the discharge tray are disposed substantially parallel to one another.

With such a construction, the printed recording sheet is discharged into the discharge tray disposed between the disc tray and the sheet feed cassette, while being parallel to the latter.

In the ink jet recording device, a tray guide as a guide part for guiding the medium holding plate is formed on the discharge tray, when the medium holding plate moves in the second direction, the medium holding plate is held by the tray guide, and when the medium holding plate moves in the first direction, the medium holding plate is moved relative to the tray guide.

According to fourth aspect of the invention, there is provided an ink jet recording apparatus comprising: a first transpoting system for reciprocatively transporting along a first direction a medium holding plate on which a first recording medium is to be placed; a medium tray on which a second recording medium is to be placed, the medium tray being substantially parallel to the medium holding plate; a loading mechanism for transporting the medium holding plate in a second direction perpendicular to the first direction and for switching between a protruding state and an accommodated state of the disc tray on the front side of the ink jet recording apparatus; and a discharge tray, provided substantially parallel to the medium tray, for accommodating the second recording medium which has received ink ejected from the recording head; wherein the medium tray, the discharge tray, and the medium holding plate are operated on the front side of the ink jet recording apparatus.

Thus, the medium holding plate on which the first recording medium is to be placed may be transported in two directions, a first direction and a second direction. Therefore, the ink jet recording apparatus is reduced in size in the first direction, and it is compactly accommodated in, for example, a television rack in a home.

The medium tray, the discharge tray, and the medium holding plate are all operated on the front side of the ink jet recording apparatus. A loading mechanism for switching between a protruding state and an accommodated state of the disc tray on the front side of the ink jet recording apparatus is provided. Therefore, the ink jet recording apparatus may be accommodated in a place having an opening only at the front, such as a television rack in a home.

Further, the medium tray and the medium holding plate are disposed substantially parallel to each other. Therefore, the ink jet recording apparatus is reduced in height. The ink jet recording apparatus may compactly be accommodated in, for example, a television rack in a home.

DETAILED DESCRIPTION OF THE PREFERRED EMBODIMENTS

Figure 1:
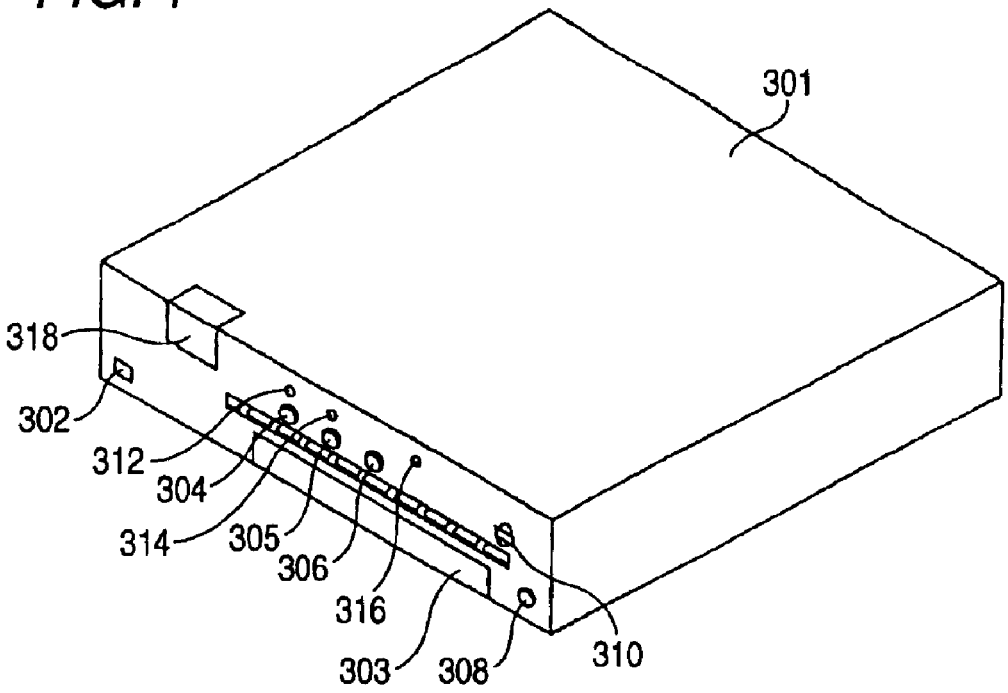
FIG. 1 is a perspective view showing an external appearance of an ink jet recording apparatus in an embodiment of the invention.

The preferred embodiments of the present invention will be described with reference to the accompanying drawings. In those drawings, like or equivalent portions will be designated by like reference numerals, for simplicity.

[First Embodiment]

Figure 2:
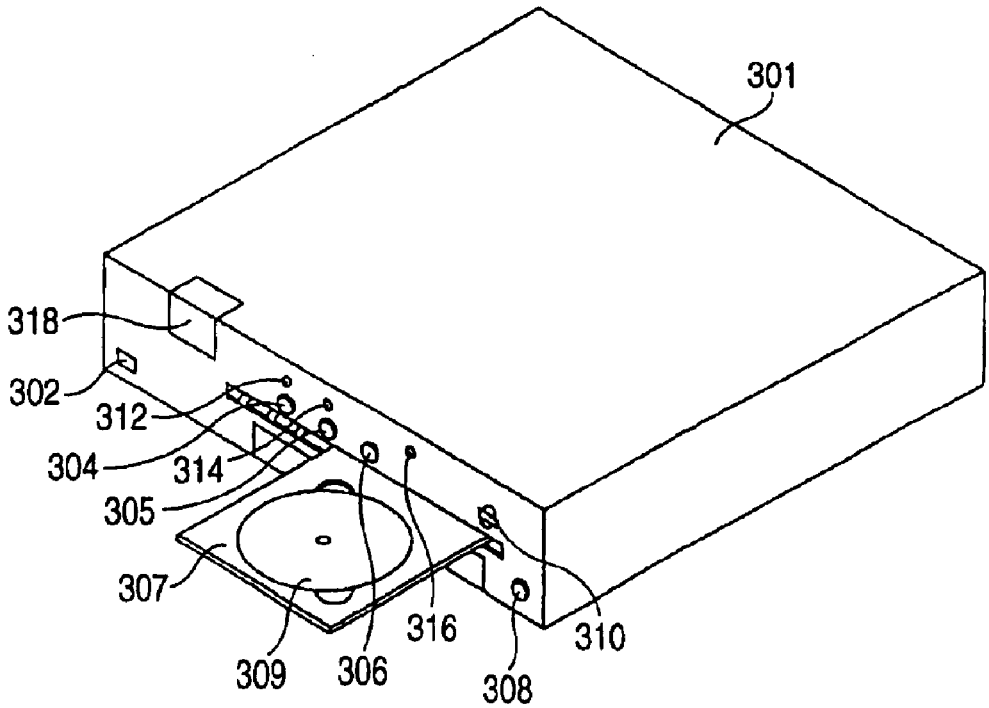
FIG. 2 is a perspective view showing an external appearance of the ink jet recording apparatus in the embodiment of the invention when the disc tray is at a loading/unloading position.
Figure 3:
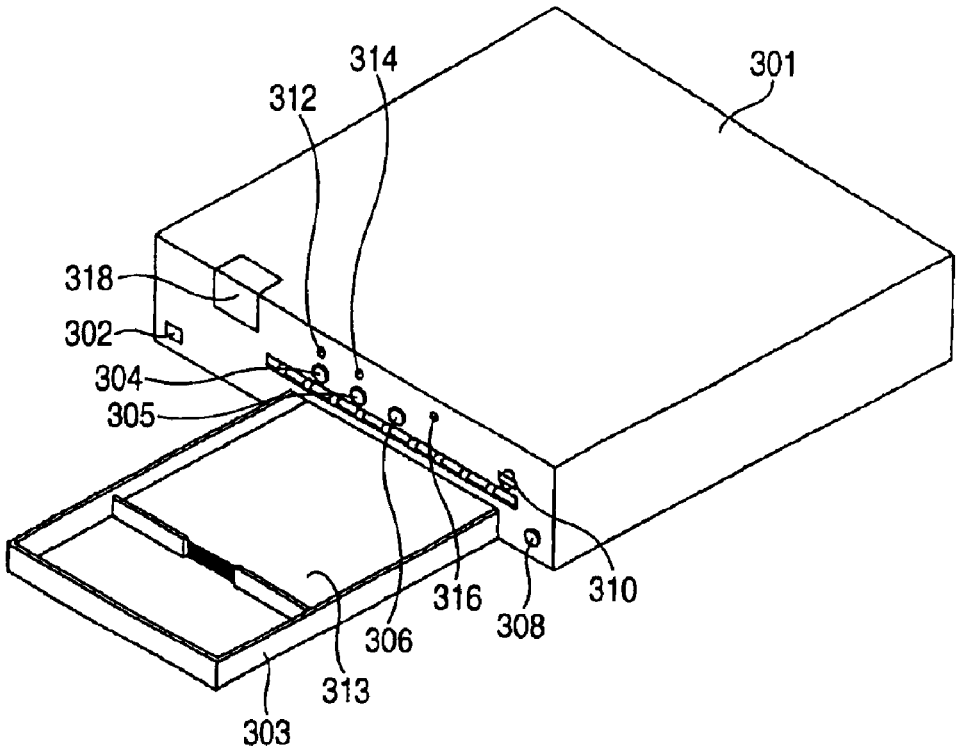
FIG. 3 is a perspective view showing an external appearance of the ink jet recording apparatus in the embodiment of the invention when the sheet feed tray is drawn out.
Figure 4:
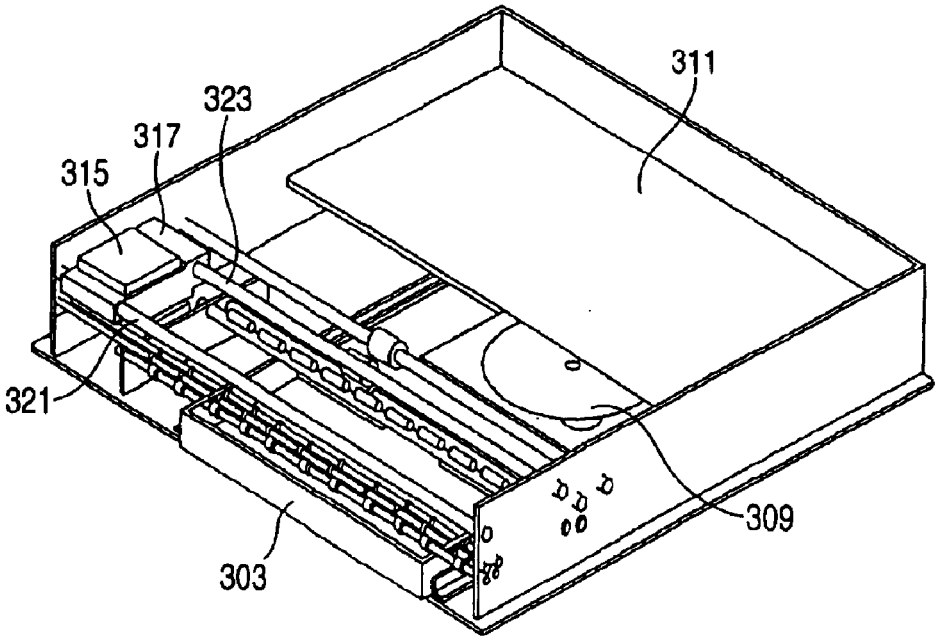
FIG. 4 is a perspective view showing a key portion of the ink jet recording apparatus in the embodiment of the invention.

FIG. 1 is a perspective view showing an external appearance of an ink jet recording apparatus 301 which is an embodiment of the invention in a state that a sheet feed tray 303 and a disc tray 307 are accommodated in the recording device. FIG. 2 is a perspective view showing an external appearance of the ink jet recording apparatus 1 in a state that the disc tray 307 is protruded to outside the recording device (A position of the disc tray in this state will be referred to as a loading/unloading position). FIG. 3 is a perspective view showing an external appearance of the ink jet recording apparatus 1 in a state that a sheet feed tray 303 having a recording sheet 313 put thereon is drawn out to the full extent (A position of the sheet feed tray in this state will be referred to as "sheet-feed-tray maximum drawn-out position", hereinafter). FIG. 4 is a perspective view showing a key portion of the ink jet recording apparatus 301.

Referring to FIGS. 1 through 3, a main operation panel (front side) of an ink jet recording apparatus 301 contains a power switch 302, an ink exchange button 304, a sheet-kind setting button 305, a reset button 306, a disc loading switch 308 as a select switch for switching between a protruding state and an accommodated state of the disc tray 307, a memory card slot 310, indicator lamps 312 and 314 for indicating statuses of buttons 304 and 305, a remote control light receiving part 316, and an ink-cartridge replacing cover 318.

A tray guide 311 shown in FIG. 4 is integral with a housing of the ink jet recording apparatus 301, and guides a disc tray 307 as a medium holding plate.

Figure 7:
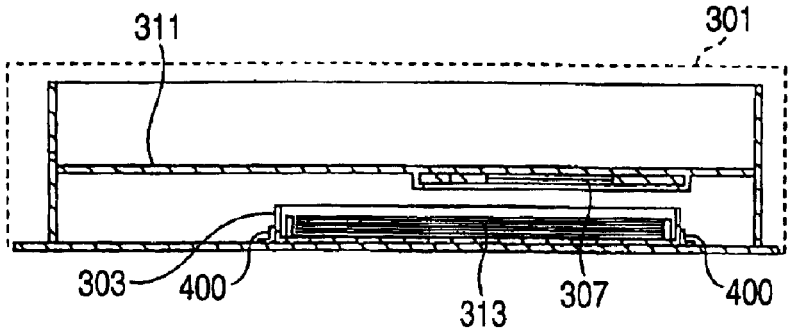
FIG. 7 is a cross sectional view taken on line F—F in FIG. 5.

As shown in FIG. 7, the disc tray 307 is held within the tray guide 311, and the sheet feed tray 303 is held by a sheet feed tray guide 400.

A DVD disc 309 as a first recording medium is located at a predetermined position to be described later on the disc tray 307.

Figure 8:
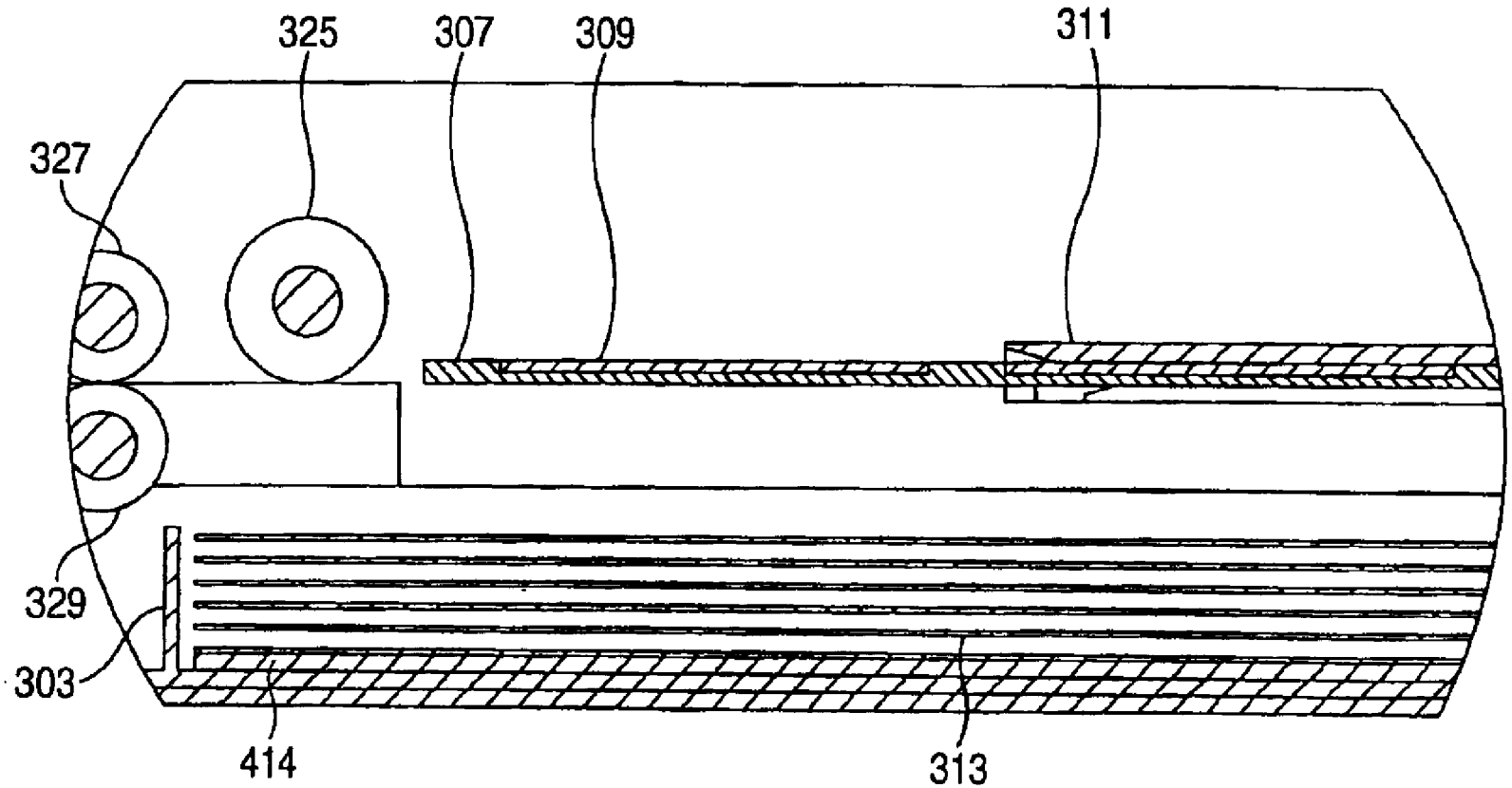
FIG. 8 is a partially enlarged view showing a structural relationship among the tray guide, the disc tray and the DVD disc in the ink jet recording apparatus in the embodiment of the invention.

A partially enlarged view showing a structural relationship among the tray guide 311, the disc tray 307 and the DVD disc 309 is shown in FIG. 8.

FIG. 4 is a perspective view showing a key portion of the ink jet recording apparatus in the embodiment of the invention. A carriage 317 on which an ink cartridge 315 and a recording head 319 supplied with ink from the ink cartridge 315 is supported by carriage shafts 321 and 323, and is adjustable in height. The carriage is driven by a carriage motor (not shown) through power transmission means (not shown), such as a timing pulley and a timing belt, and is reciprocatively movable in the main scan direction (parallel to the carriage shafts 321 and 323).

Specific mechanical components necessary for the printing, such as the ink cartridge 315, the carriage 317 and the recording head 319, may be those disclosed in Japanese patent application No. 2002-038117 (filed on Feb. 15, 2002).

A gear 343 is formed at an end of the disc tray 307. A pinion 347 provided on a motor 345 engages with the gear, so that a drive force of the motor 345 is transmitted to the disc tray 307. The disc tray 307 which holds the DVD disc 309 is transported in directions perpendicular to the carriage shafts 321 and 323 (a first direction and a second direction).

The details of the construction and operations of the ink jet recording apparatus 301 of the present embodiment will be described with reference to FIGS. 5 through 24.

Printing on a recording sheet 13 will first be described.

Recording sheets 313 as second recording media are set in the sheet feed tray 303 as a medium tray. The recording sheets 313 are picked up sheet by sheet by a pickup roller 325 as a feed roller.

Figure 22:
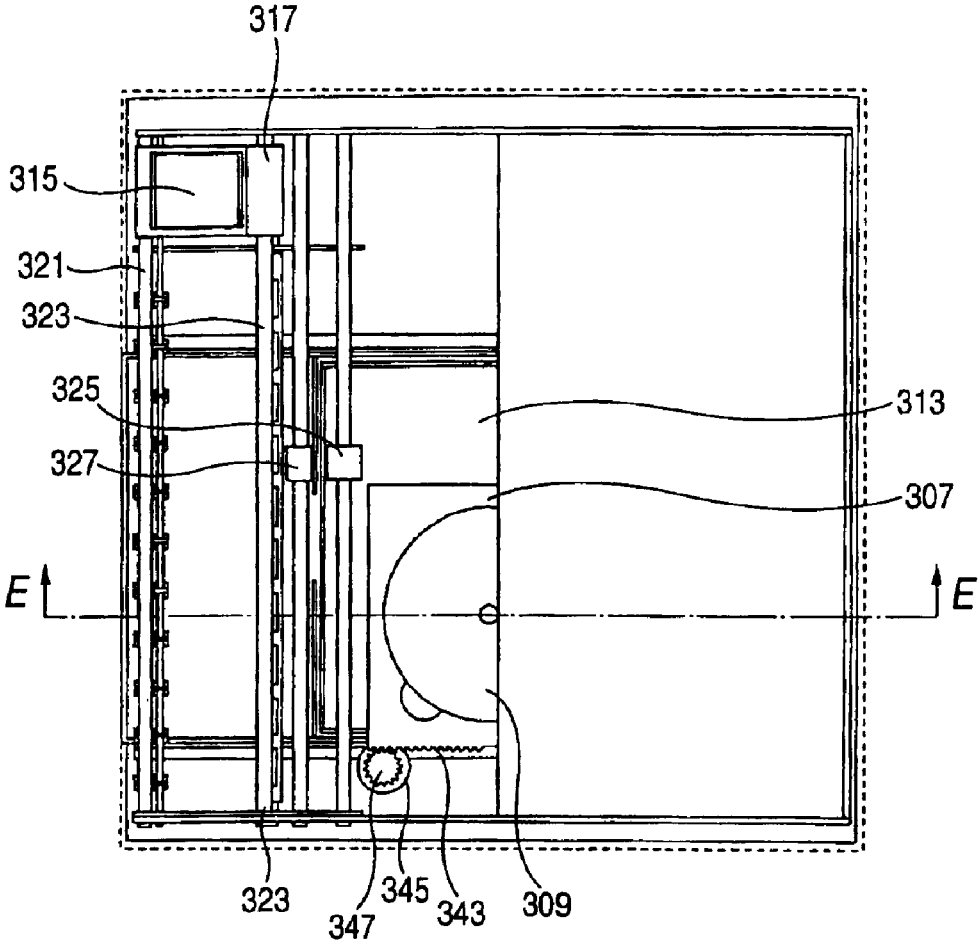
FIG. 22 is a top view showing the ink jet recording apparatus in the embodiment of the invention when the recording device is in a sheet supplying mode.
Figure 23:
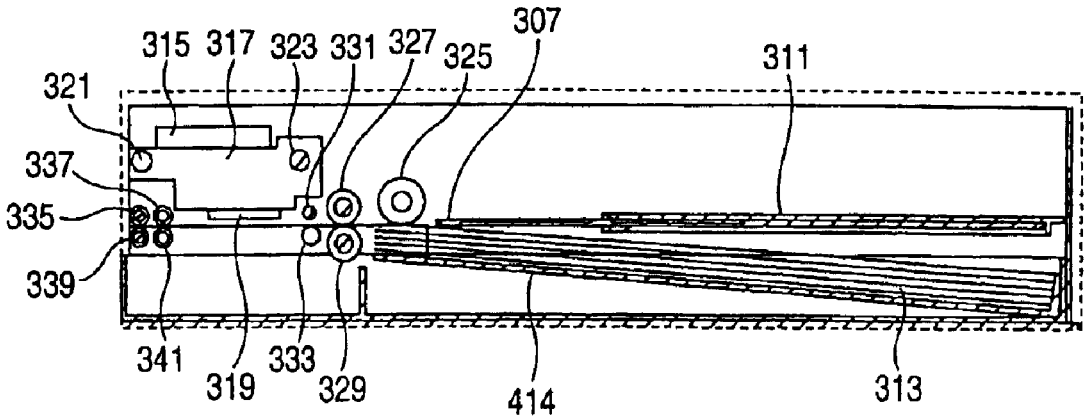
FIG. 23 is a cross sectional view taken on line E—E in FIG. 22.

A bottom plate 414 of the sheet feed tray 303 is lifted at its part closer to the pickup roller 325 as shown in FIGS. 22 and 23 by a lift-up mechanism (not shown), and the recording sheet is picked up in a state that the pickup roller 325 is in contact with the recording sheet 313.

A recording sheet 313 picked up is transported by feed rollers 327 and 329, both rotating clockwise, and gains a further transporting force between the pinch roller 331 and the main roller 333 as a transporting roller.

The main roller 333, which determines a transporting accuracy of the recording sheet 313, includes a rotary encoder (not shown) for measuring a rotation accuracy, which is mounted on the same shaft as of the main roller.

The rotary encoder is preferably located at a position where it does not hinder the loading/unloading of the ink cartridge 315 and setting/removing of the recording sheets 313.

The recording sheet 313 having passed through between the pinch roller 331 and the main roller 333 is subjected to an image forming process. In the process, the recording head 319 ejects ink onto the recording sheet to form a given image thereon. Then, the recording sheet passes between the plurality of discharge rollers 339 and 341, and the free rollers 335 and 337, and is discharged to outside the ink jet recording apparatus 301.

Those free rollers 335 and 337 are provided to minimize an area on the recording sheet 313 which receives ink ejected from the recording head and hence, to prevent its ink stain.

In the instant embodiment, the motor 345, the pinion 347, the pinch roller 331 and the main roller 333 are used for a first transporting system, and the pickup roller 325, the feed rollers 327 and 329, pinch roller 331, main roller 333, free rollers 335 and 337, and discharge rollers 339 and 341 are used for a second transporting system.

Operation of printing on the DVD disc 309 will be described with reference to a flow chart of FIG. 24.

Figure 24:
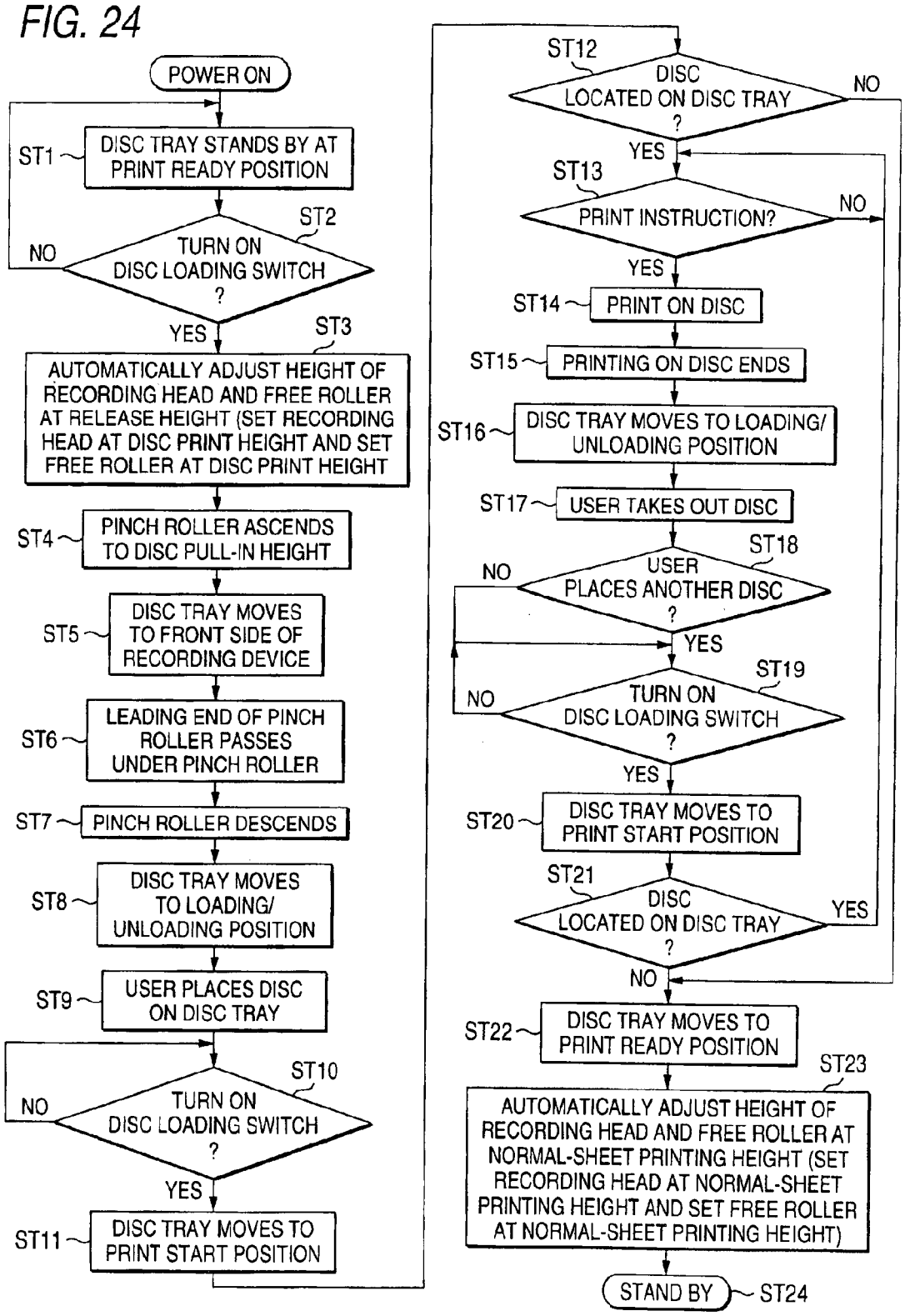
FIG. 24 is a flow chart showing operations of the ink jet recording apparatus in the embodiment of the invention.

To start, a power switch of the ink jet recording apparatus 301 is turned on, and then the disc tray 307 is put in a print ready state at a print ready position in a step 1 (ST 1) in the flow chart of FIG. 24.

Figure 5:
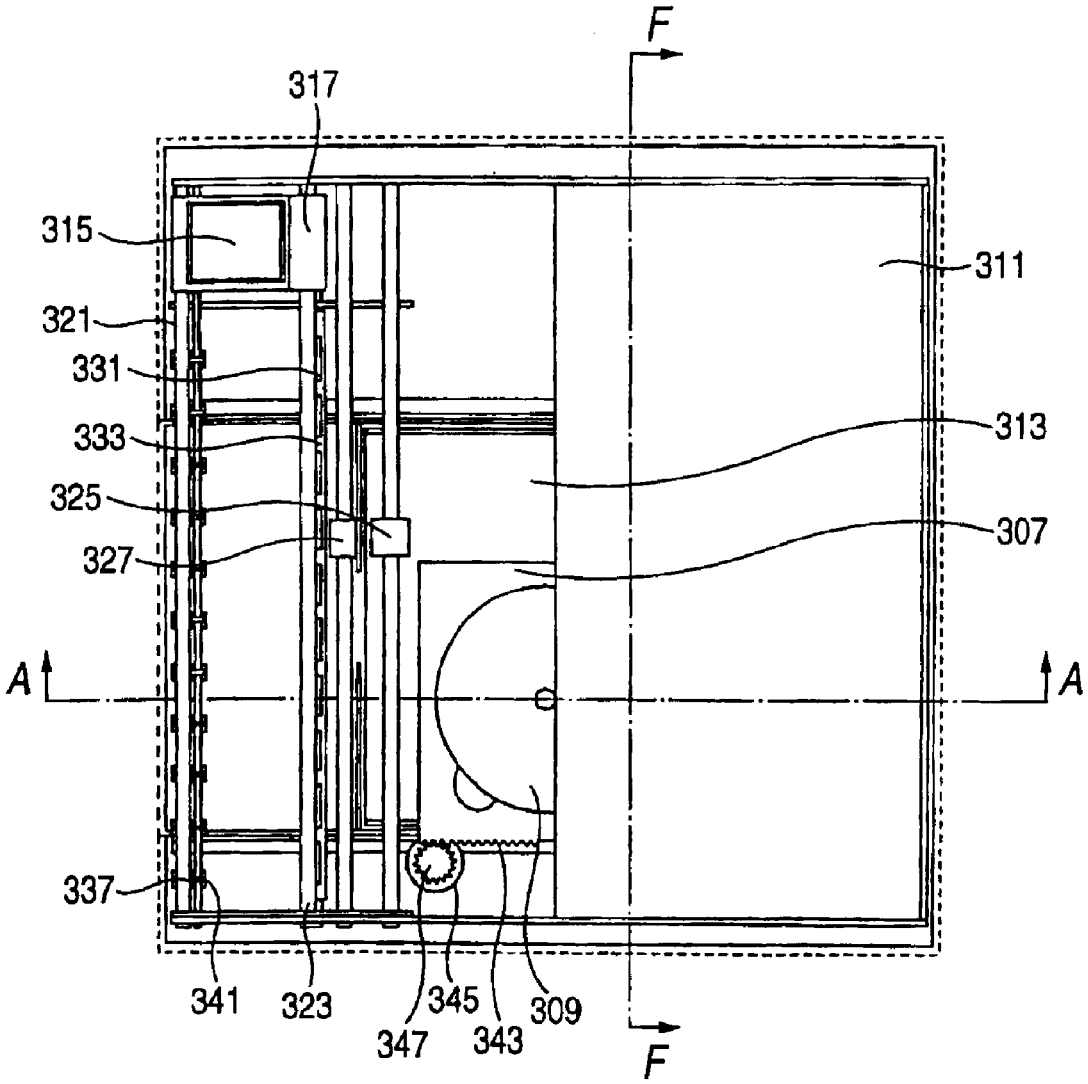
FIG. 5 is a top view showing the innards of the ink jet recording apparatus in the embodiment of the invention when the disc tray is at a print ready position.
Figure 6:
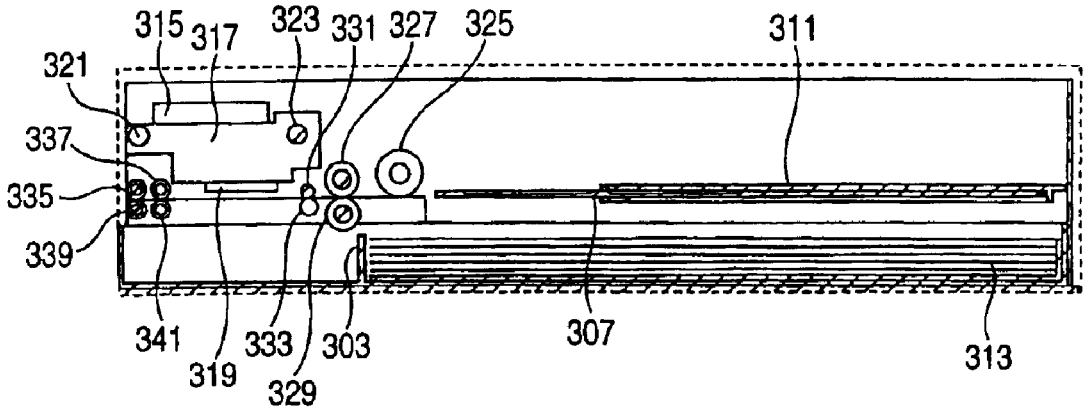
FIG. 6 is a cross sectional view taken on line A—A in FIG. 5.
Figure 9:
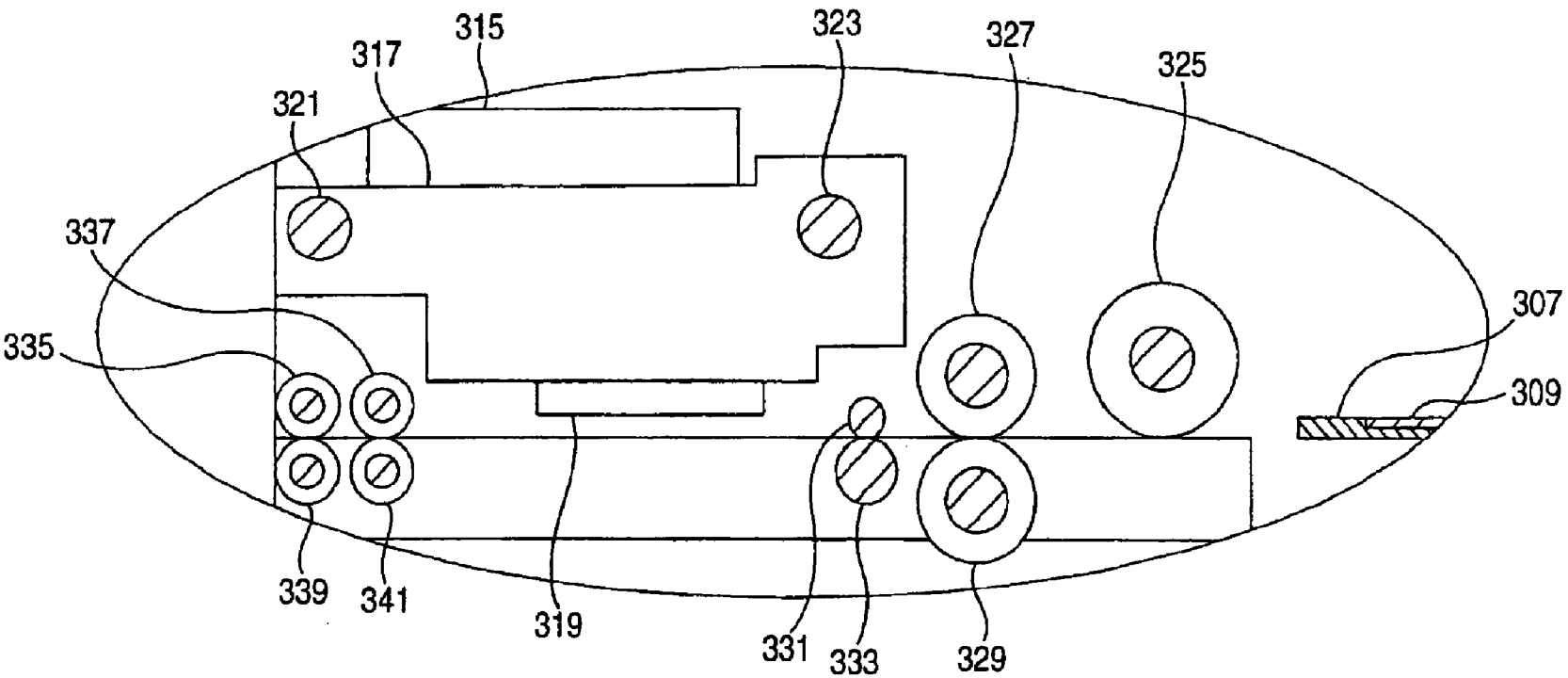
FIG. 9 is an enlarged view of a key portion of the innards of the ink jet recording apparatus in the embodiment of the invention when the disc tray is at the print ready position.

Referring to FIGS. 5 and 6, there is shown a state that the disc tray is in the print ready position when the disc tray 307 is accommodated in the ink jet recording apparatus 301 (A position of the disc tray 307 in this state will be referred to as a "print ready position"). An enlarged view of a key portion of the structure illustrated in FIG. 6 is shown in FIG. 9.

Figure 10:
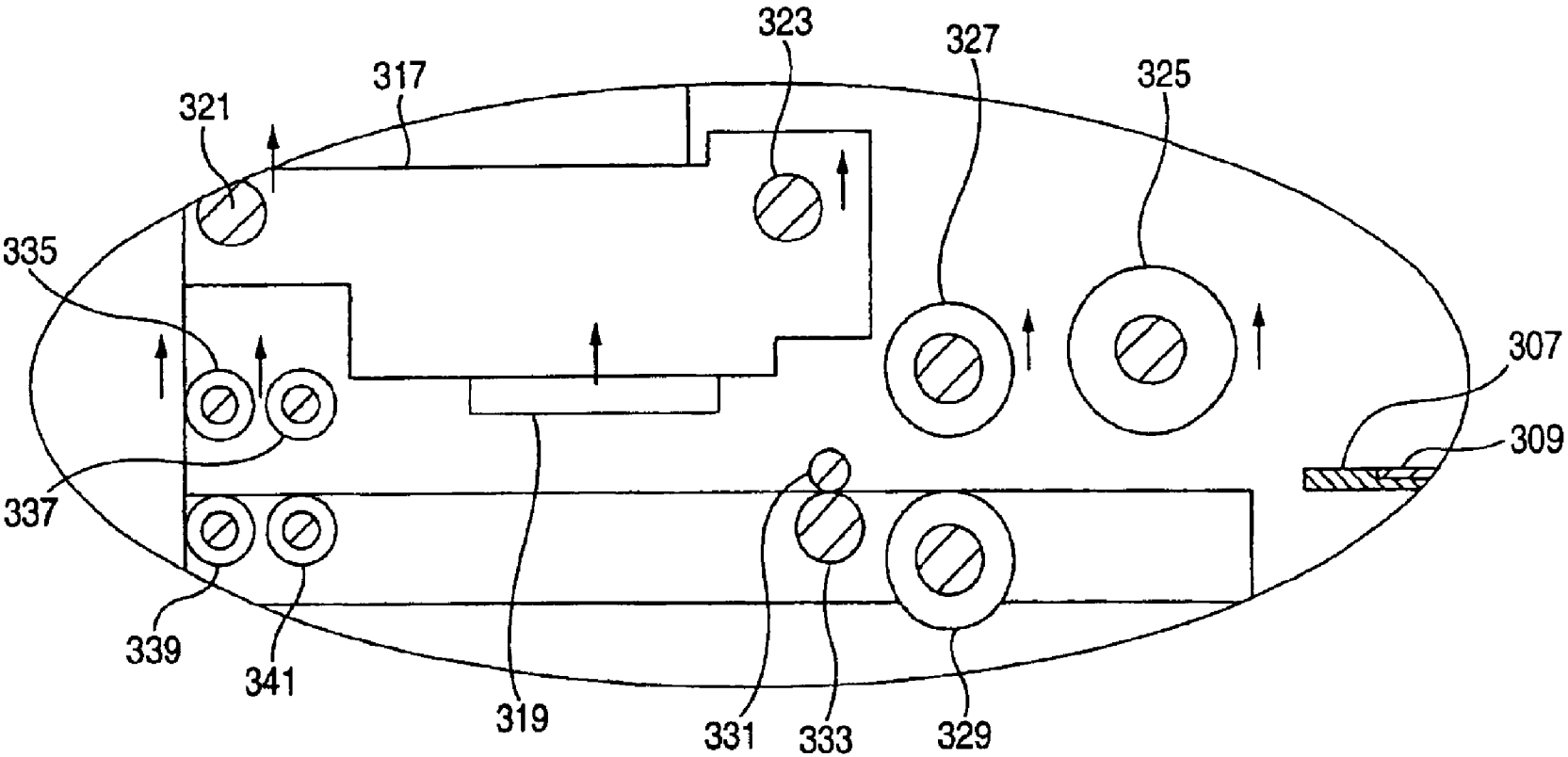
FIG. 10 is an enlarged view showing a key portion of the innards of the ink jet recording apparatus of the embodiment of the invention when an operation step is ST3.

Then, at a step 2 (ST 2) an operator turns on the disc loading switch 308. A step 3 (ST 3) is executed, and as shown in FIG. 10, the carriage 317, the pickup roller 325, the feed roller 327 and the free rollers 335 and 337 are moved upward to a predetermined height (This height will be referred to as a "release height") by a motor and a link mechanism, both not shown.

At the release height, the recording head 319, and the free rollers 335 and 337 are at a position of printing on the DVD disc 309.

Figure 11:
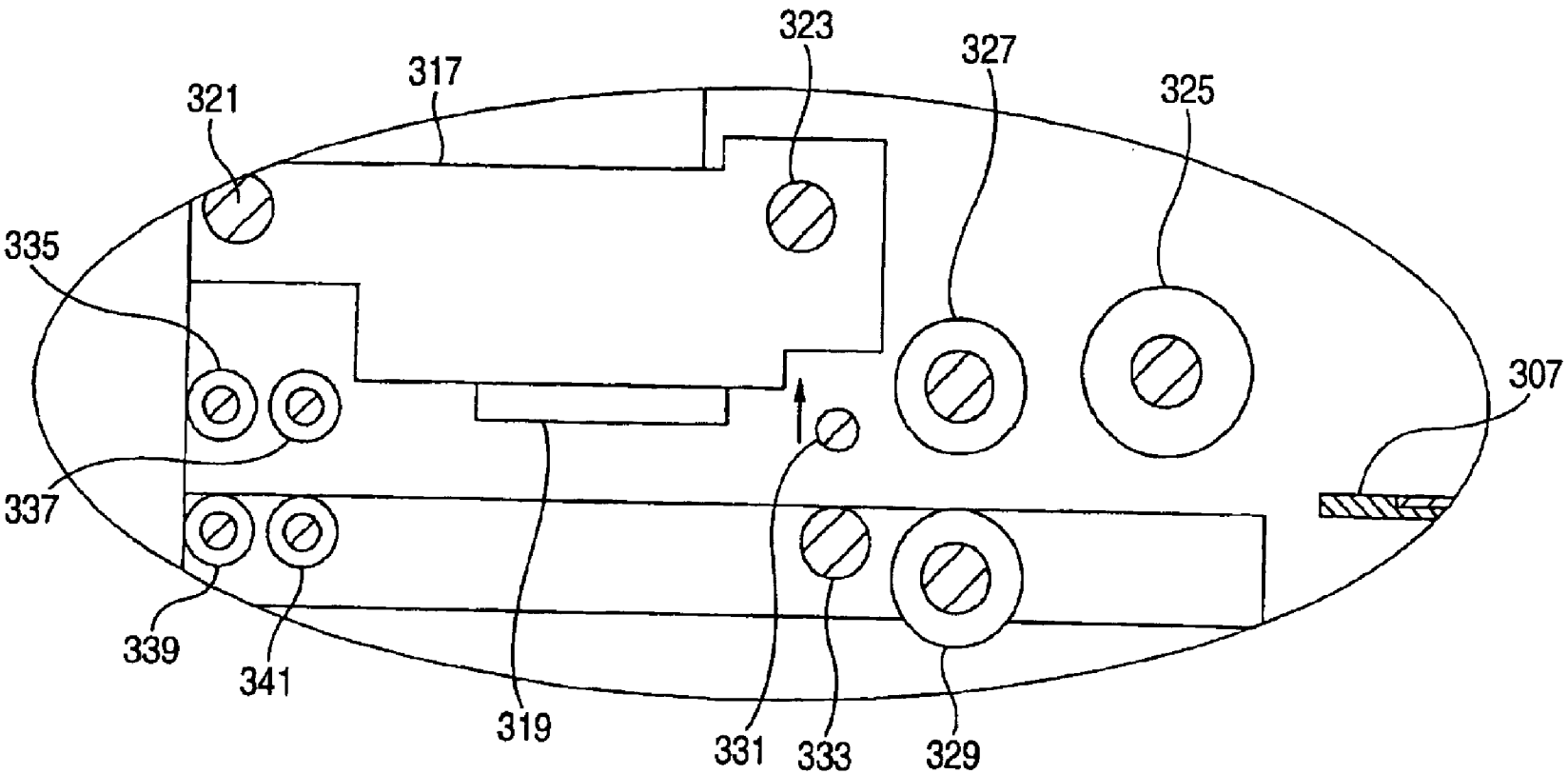
FIG. 11 is an enlarged view showing a key portion of the innards of the ink jet recording apparatus of the embodiment of the invention when an operation step is ST4.
Figure 12:
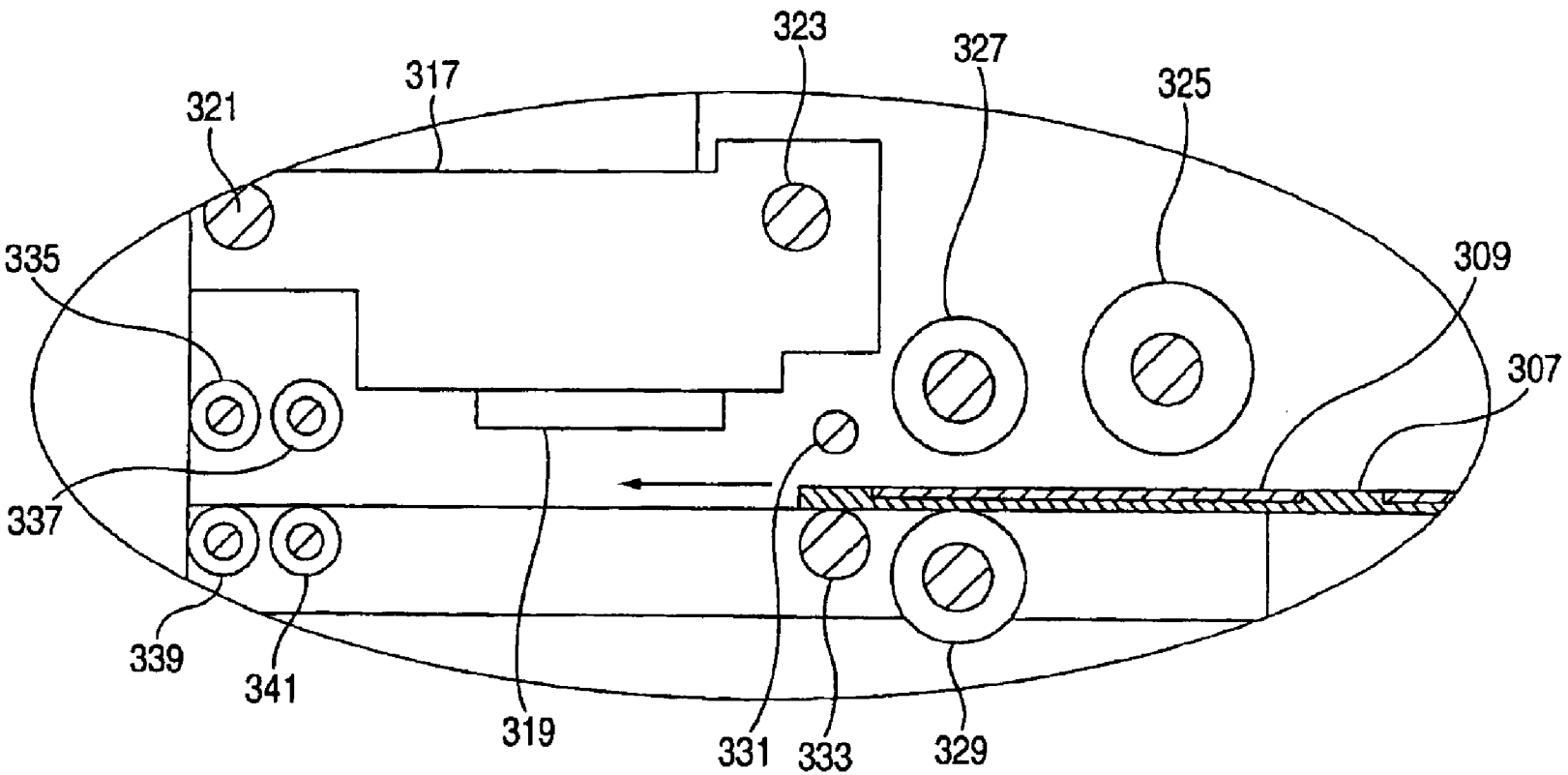
FIG. 12 is an enlarged view showing a key portion of the innards of the ink jet recording apparatus of the embodiment of the invention when an operation step is ST6.
Figure 13:
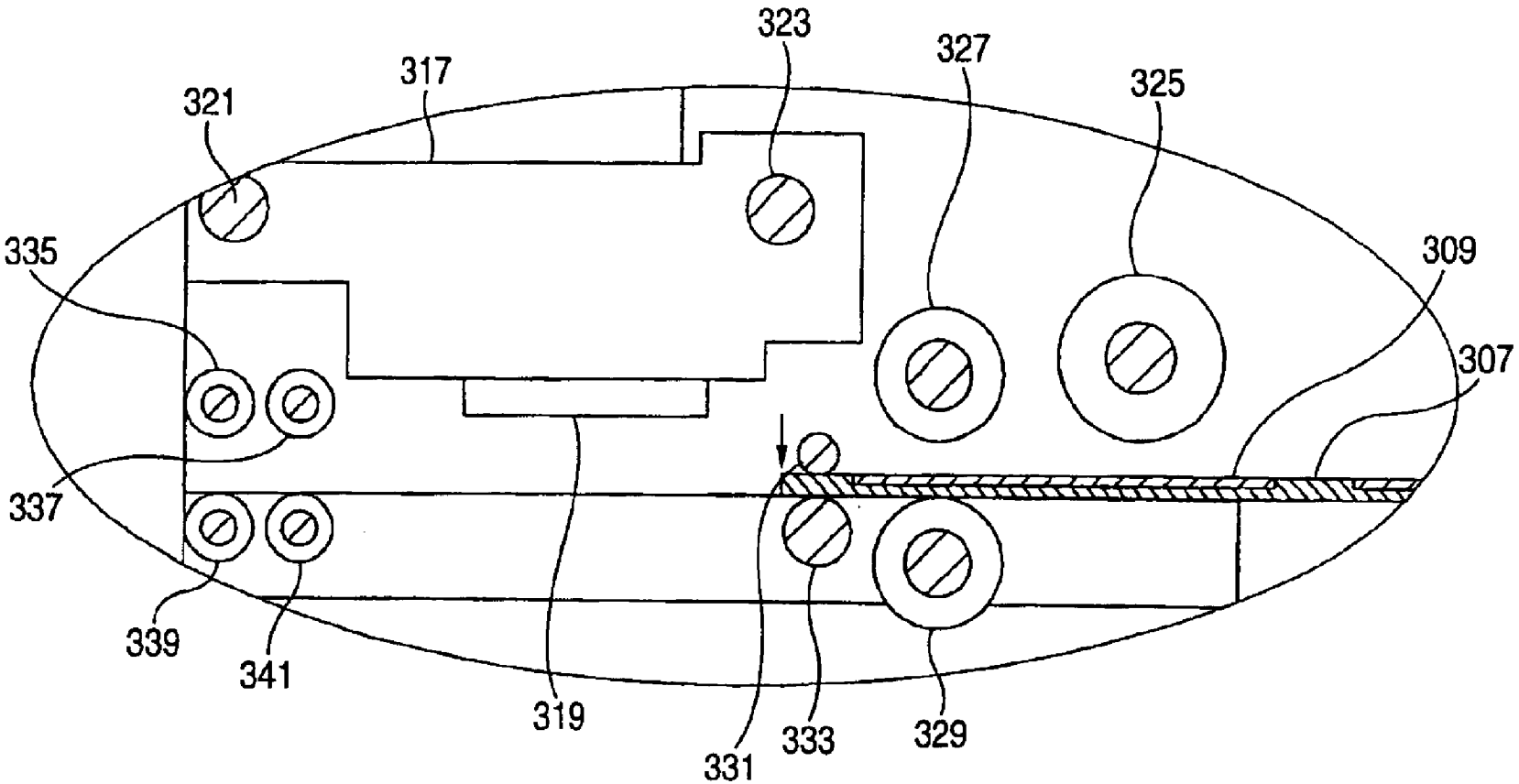
FIG. 13 is an enlarged view showing a key portion of the innards of the ink jet recording apparatus of the embodiment of the invention when an operation step is ST7.

Thereafter, a step 4 (ST 4) is executed, and as shown in FIG. 11, the pinch roller 331 ascends to a disc pull-in height, and a step 5 (ST 5) is executed, and the disc tray 307 is transported to the front of the ink jet recording apparatus 301 (in a direction of an arrow in FIG. 12).

In this case, the disc tray 307 is transported in a manner that the pinion 347 of the motor 345 engages with the gear 43 of the disc tray 307.

Figure 15:
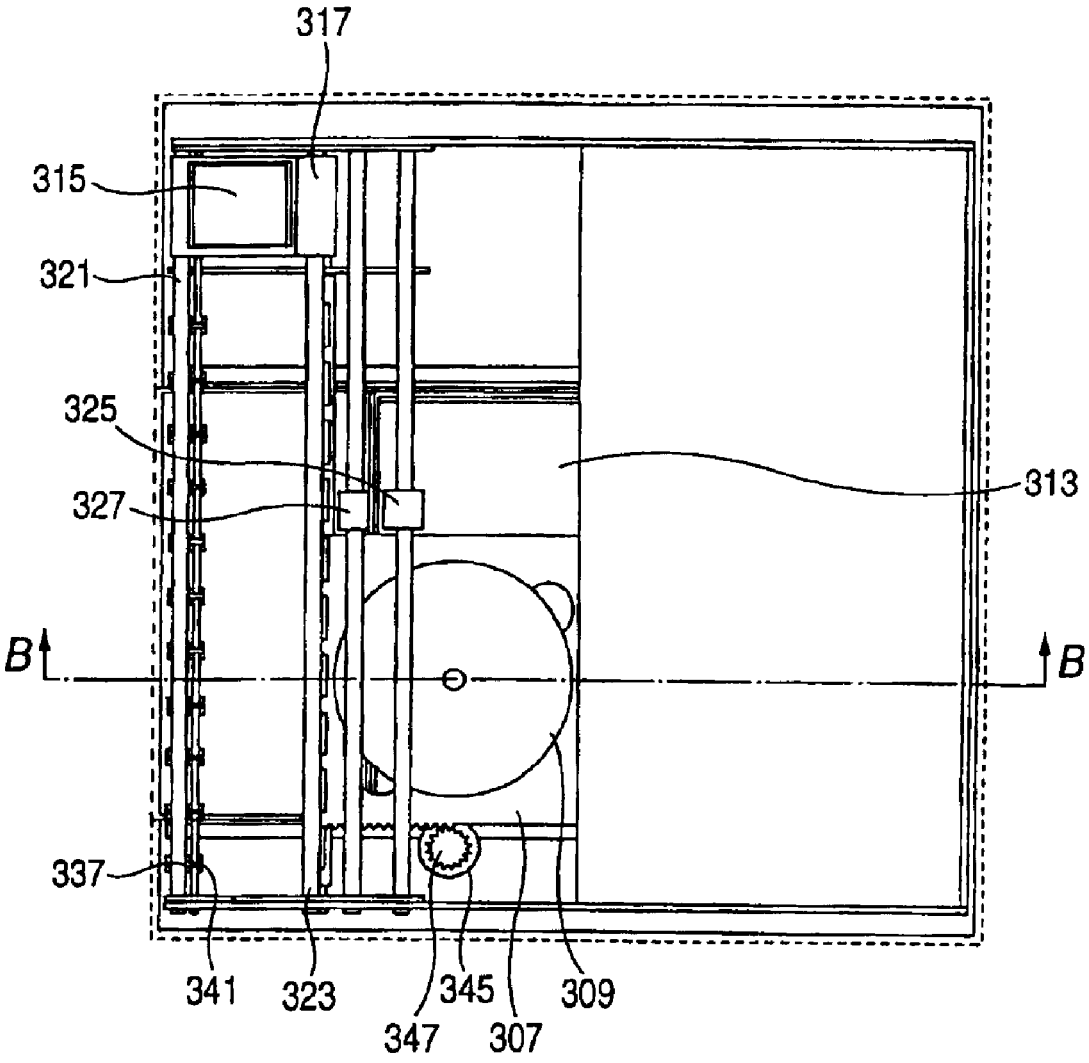
FIG. 15 is an enlarged view showing the innards of the ink jet recording apparatus of the embodiment of the invention when an operation step is ST7.
Figure 16:
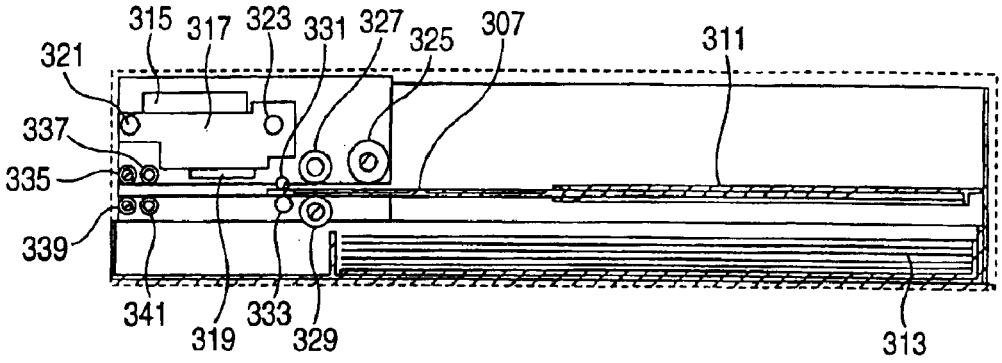
FIG. 16 is a cross sectional view taken on line B—B in FIG. 15.

Next, if in a step 6 (ST 6), it is judged that a leading end of the disc tray 307 passed under the pinch roller 331 as shown in FIG. 12, then a step 7 (ST 7) is executed and as shown in FIGS. 15 and 16, the pinch roller 331 descends to come in contact with the disc tray 307, so that a rotational force of the main roller 333 is transmitted to the disc tray 307.

Figure 14:
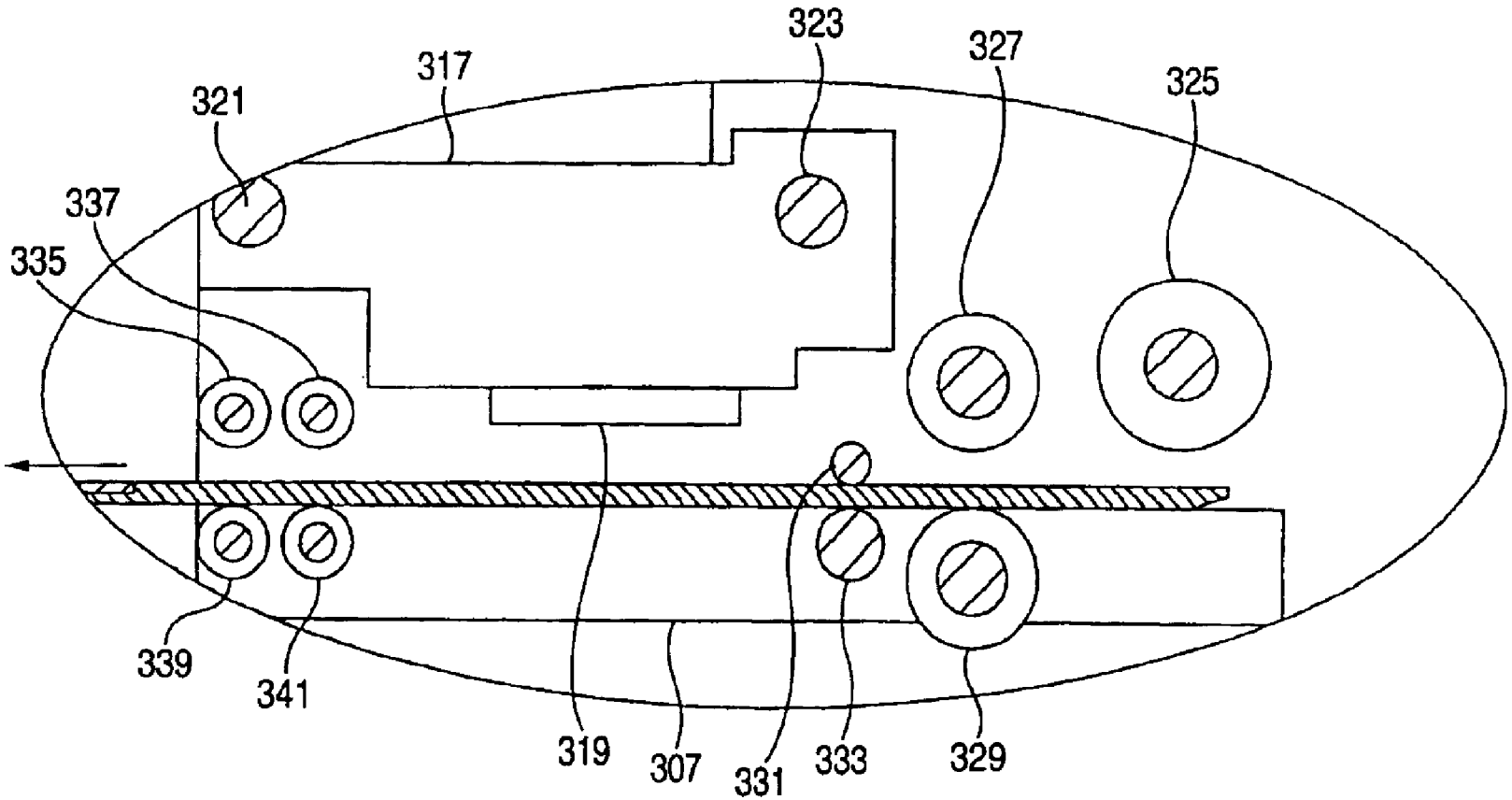
FIG. 14 is an enlarged view showing a key portion of the innards of the ink jet recording apparatus of the embodiment of the invention when an operation step is ST8.
Figure 17:
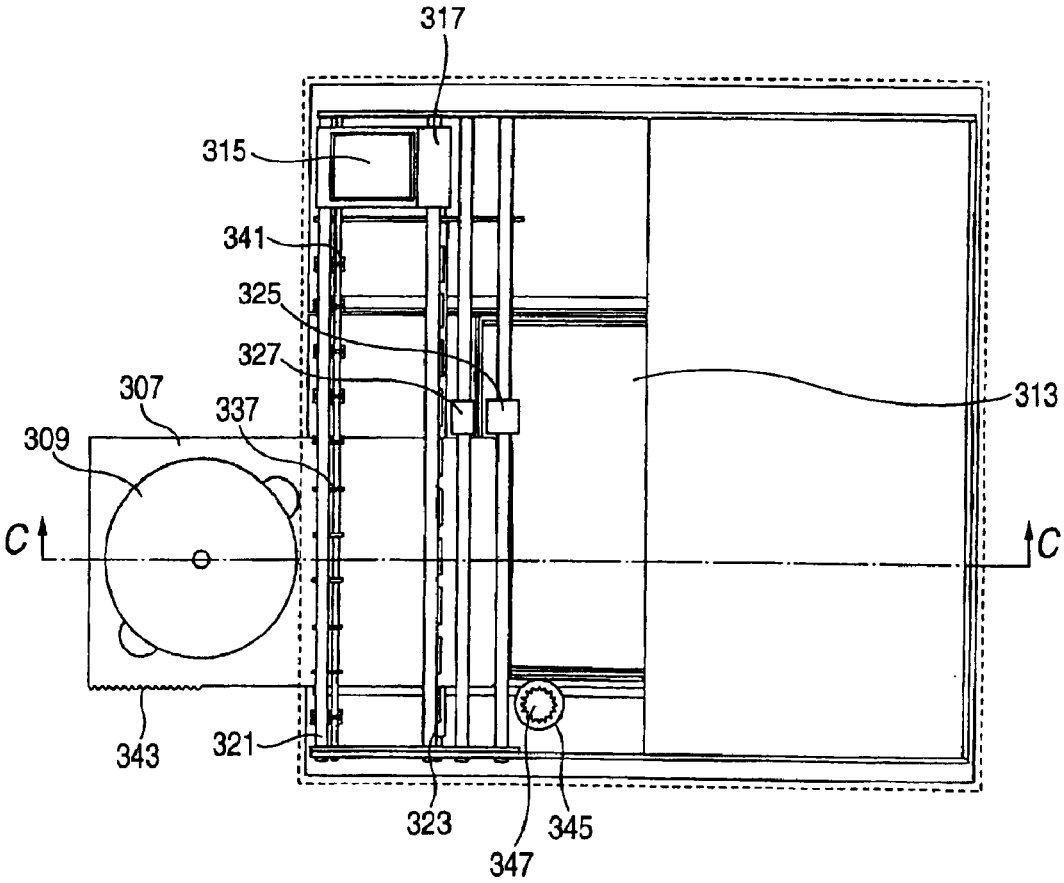
FIG. 17 is a top view showing the innards of the ink jet recording apparatus in the embodiment of the invention when the disc tray is at a loading/unloading position.
Figure 18:
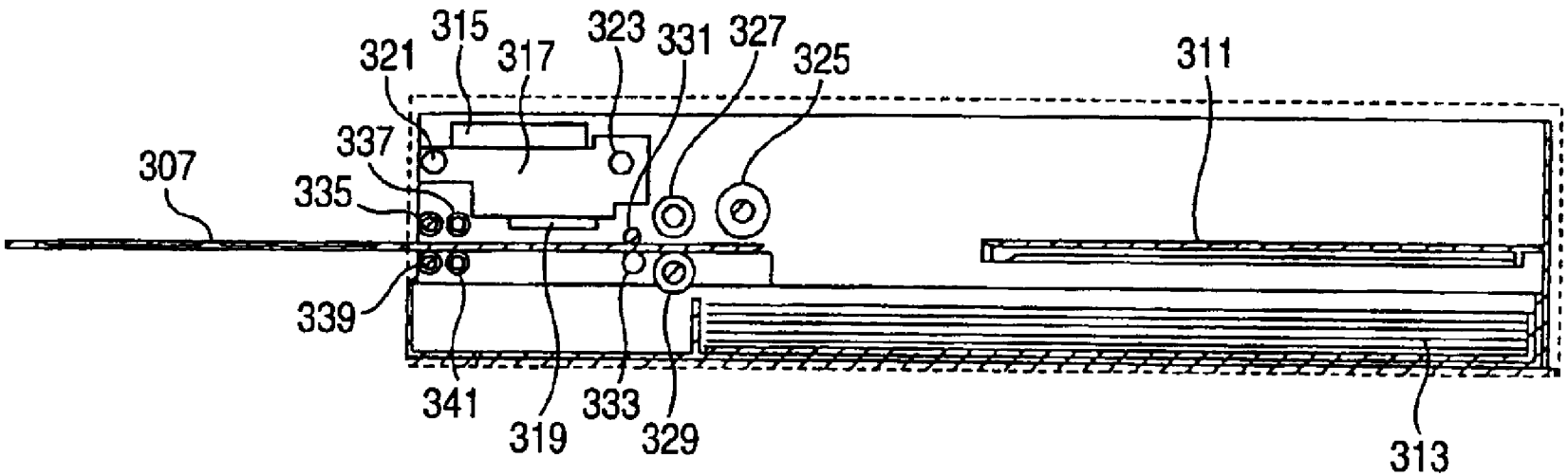
FIG. 18 is a cross sectional view taken on line C—C in FIG. 17.
Figure 19:
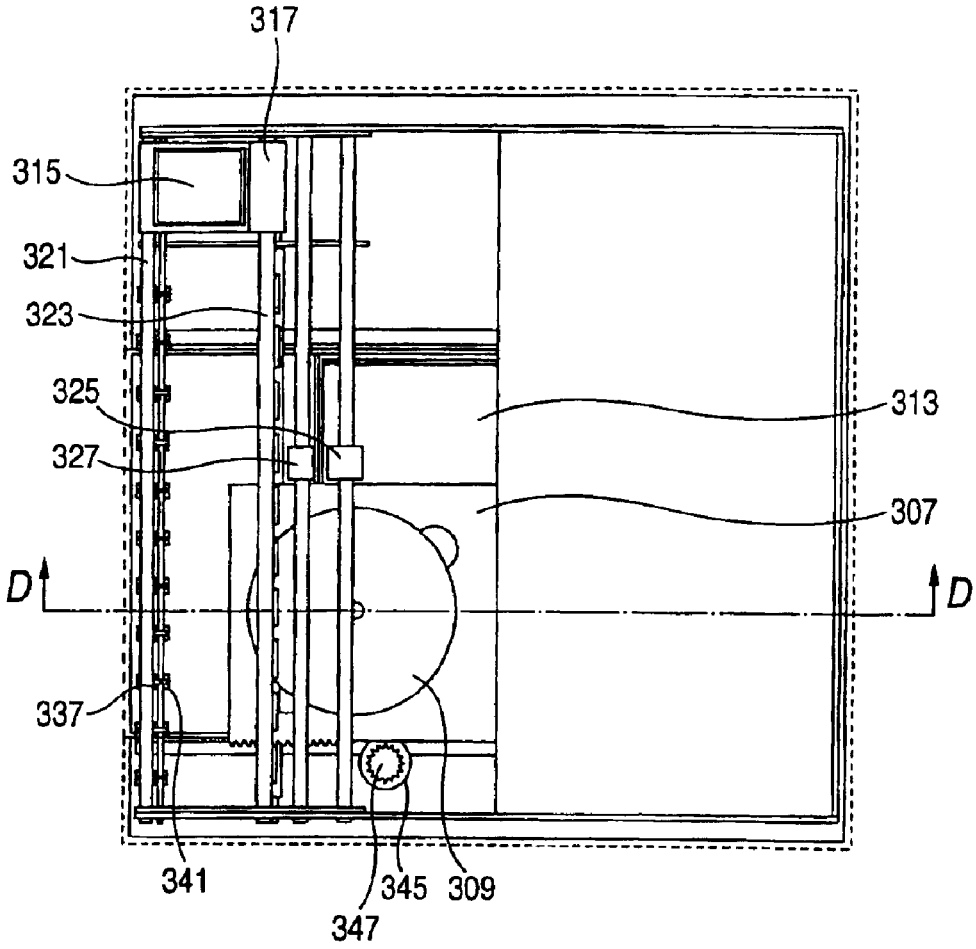
FIG. 19 is a top view showing the innards of the ink jet recording apparatus in the embodiment of the invention when the disc tray is at a print start position (ST 11).
Figure 20:
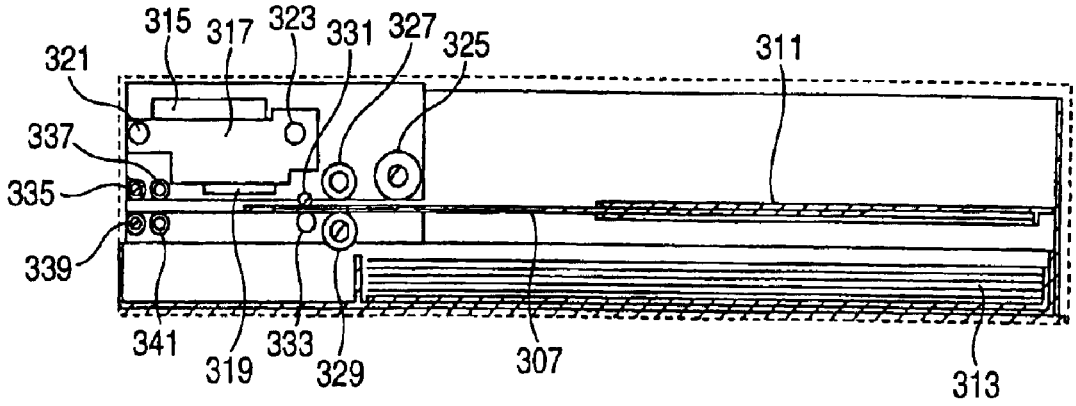
FIG. 20 is a cross sectional view taken on line D—D in FIG. 19.

Thereafter, a step 8 (ST8) is executed and the disc tray 307 is transported to a position shown in FIGS. 14, 17 and 18 (This position of the disc tray 307 will be referred to as a "loading/unloading position"). In a step 9 (ST 9), the operator places the DVD disc 309 as an object under printing on the disc tray 307.

Thereafter, the operator turns on the disc loading switch 308 in a step 10 (ST 10). Then, in a step 11 (ST 11), the disc tray 307 is transported, by a rotation force of the main roller 333, to a position shown in FIGS. 19 and 20 (This position will be referred to as a "print start position").

Next, in a step 12 (ST 12), a sensor (not shown) detects whether or not the DVD disc 309 is located on the disc tray 307. If the DVD disc 309 is not located, a step 22 (ST 22) is executed and the disc tray 307 moves to a print ready position shown in FIG. 21. If the DVD disc 309 is located, a step 13 (ST 13) is executed to issue a print instruction, and in a step 14 (ST 14), operation of printing on the DVD disc 309 is performed.

In a step 15 (ST 15), if the printing on the DVD disc 309 ends, the disc tray 307 moves to the loading/unloading position in a step 16 (ST 16). In a step 17 (ST 17), the operator takes out the DVD disc 309 after the printing operation ends. And a step 18 (ST 18) is executed.

In a step 18 (ST 18), the operator places a new DVD disc 309 on the disc tray 307, and in a step 19 (ST 19), and turns on the disc loading switch 308. In a step 20 (ST 20), the disc tray 307 is transported to the print start position shown in FIGS. 19 and 20. In a step 21 (ST 21), a sensor (not shown) detects whether or not the DVD disc 309 is located on the disc tray 307.

When the DVD disc 309 is placed on the disc tray 307 in the step 21 (ST 21), the step 13 (ST 13) is executed, and the operation of printing on the DVD disc 309 is performed.

Figure 21:
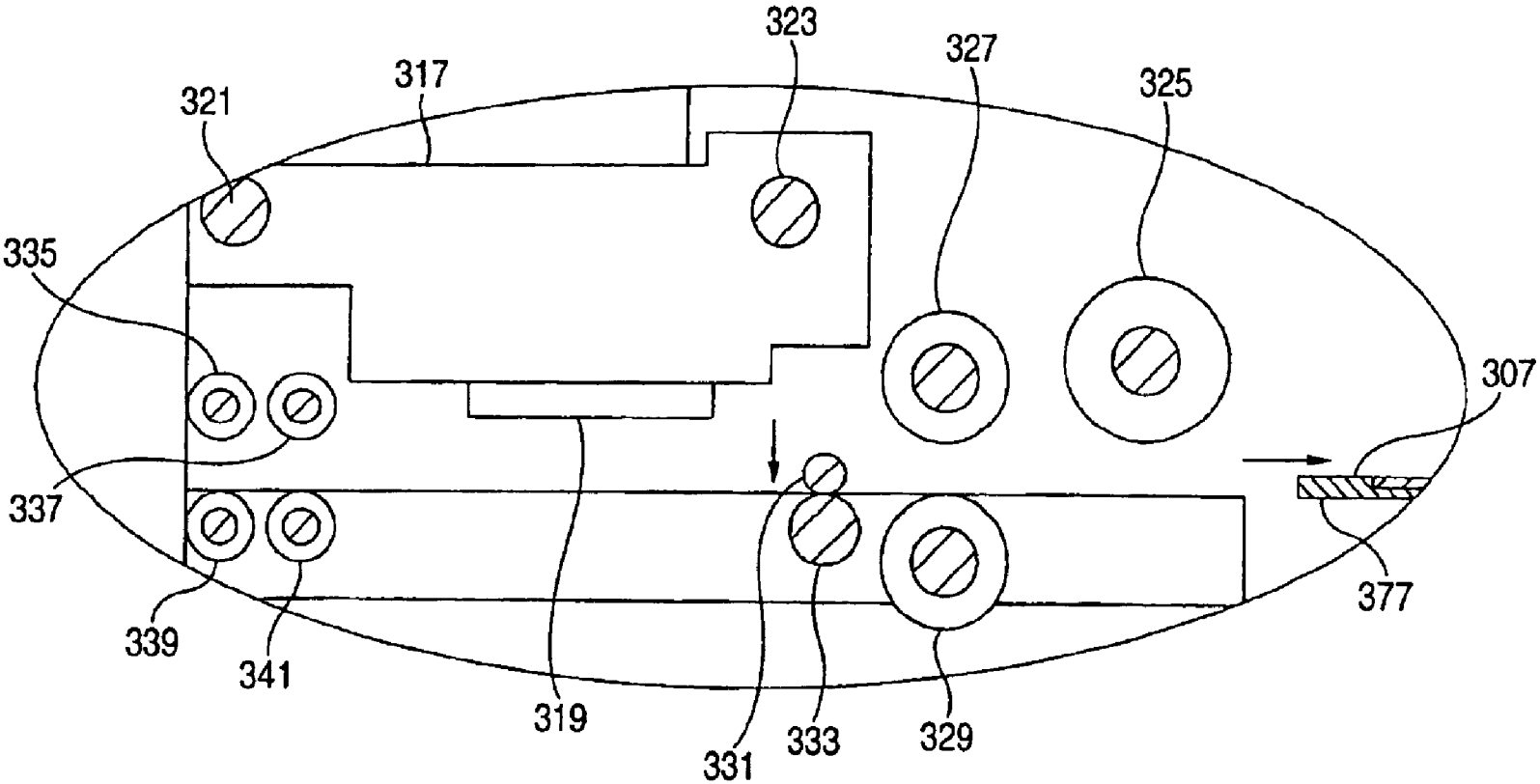
FIG. 21 is an enlarged view showing a key portion of the innards of the ink jet recording apparatus of the embodiment of the invention when an operation step is ST 22.

If the DVD disc 309 is not present on the disc tray 307 in the step 21 (ST 21), the step 22 (ST 22) is executed, and the disc tray 307 is transported to the print ready position shown in FIG. 21 by a transporting force of the main roller 333 and the motor 345. If during the course of movement to the print ready position, if the end 377 of the disc tray 307 passes under the pinch roller 331, the pinch roller 331 automatically descends to a normal position shown in FIG. 21 by a pressing force of a spring (not shown).

Thereafter, in a step 23 (ST 23), the carriage 317, the pickup roller 325, the feed roller 327, and the free rollers 335 and 337 are adjusted to a normal sheet height shown in FIGS. 5, 6 and 9 by a link mechanism, and then a print ready position is set up in a step 24 (ST 24).

As described above, in other cases than the case where the operator inserts the DVD disc 309 into and draws it out of the ink jet recording apparatus or takes out the discharging sheet therefrom, the disc tray 307 is accommodated in the ink jet recording apparatus 301, and hence, a part protruded to outside the recording device is not present. Further, the operations, such as the insertion/drawing-out of the DVD disc 309, the operation of the disc loading switch 308, the taking-out of the discharging sheet, loading/unloading of the sheet feed tray 303, may all be performed on the main operation panel. Accordingly, the ink jet recording apparatus 301 may be accommodated compactly in, for example, a television rack in a home.

The height of the pinch roller 331 may be preset in accordance with a thickness of an object under printing. In alternative, a thickness of the object under printing is detected by a sensor (not shown), and the height of the pinch roller 331 may automatically be adjusted according to the detected thickness.

The DVD disc 309 is exemplarily presented as the first recording medium in the first embodiment described above. However, the first recording medium may be any other recording medium if it is smaller than the ink jet recording apparatus 301, and may be placed on the disc tray 307 having a predetermined configuration. Examples of the first recording media are an optical recording medium, e.g., CD, a magnetic recording medium, e.g., a flexible disc, an electronic recording medium, e.g., an IC card or a semiconductor memory, a plastic card, e.g., a credit card or a cash card, a resin solid material, e.g., a name card case, and a metal solid material, e.g., an aluminum plate.

<Second Embodiment>

Figure 25:
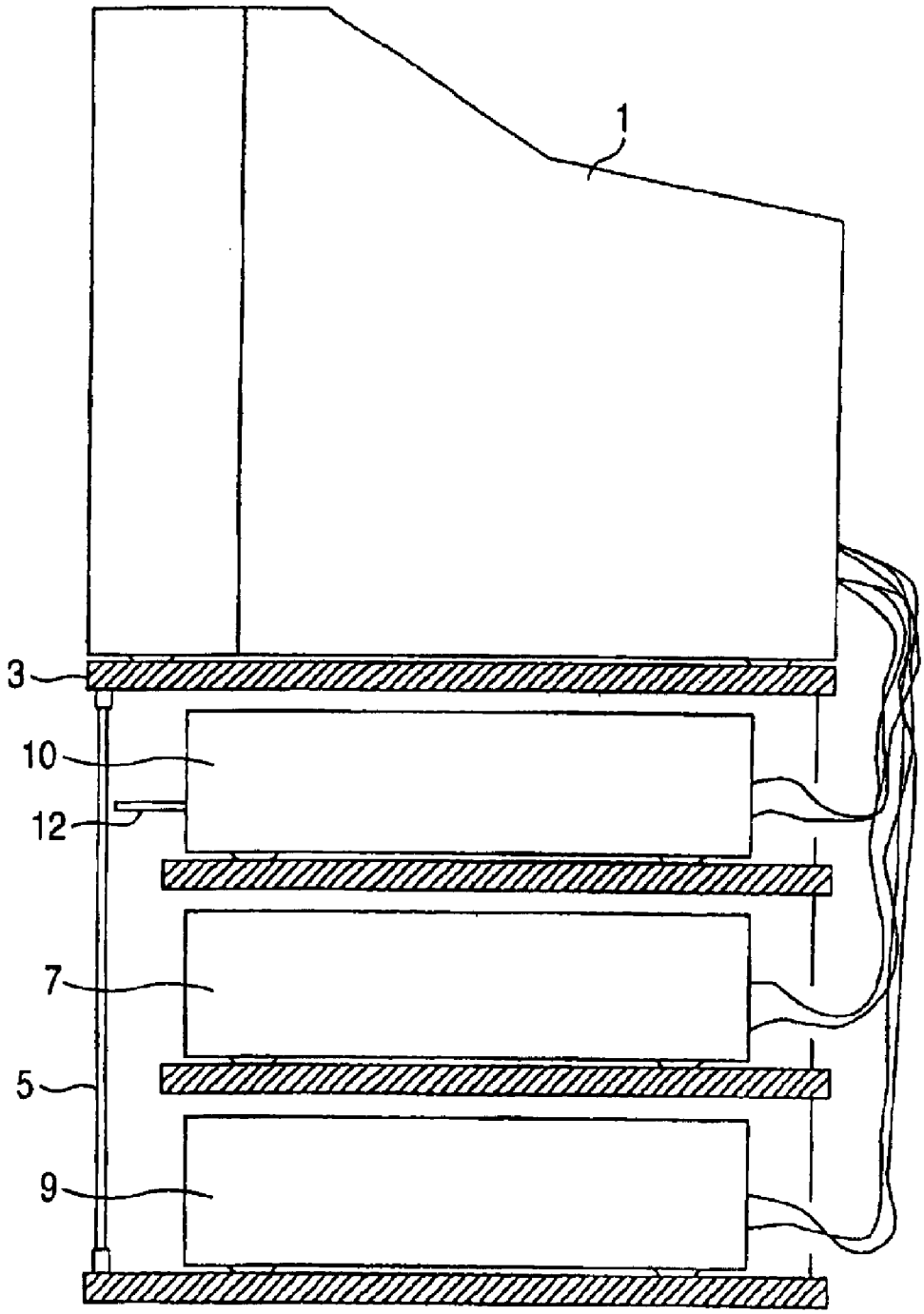
FIG. 25 is a side view conceptually showing an exemplary application of an ink jet recording device as an embodiment of the invention when it is installed in a home-use television rack.

FIG. 25 is a side view conceptually showing an exemplary application of an ink jet recording device as an embodiment of the invention when it is installed in a home-use television rack. In the figure, a television set 1 is placed on a rack 3, which is provided with a glass door 5 that may be opened and closed.

A videocassette recorder (VCR) 7, a DVD recorder 9, and an ink jet recording device 10 as a second embodiment of the invention are accommodated in the rack 3 in a stacked fashion.

A discharge tray 12 to be described later is illustrated in a state that it is protruded outside from the ink jet recording device 10 so as to enable an operator to load an optical recording medium, such as CD or DVD, and to take out a discharging sheet.

Figure 26:
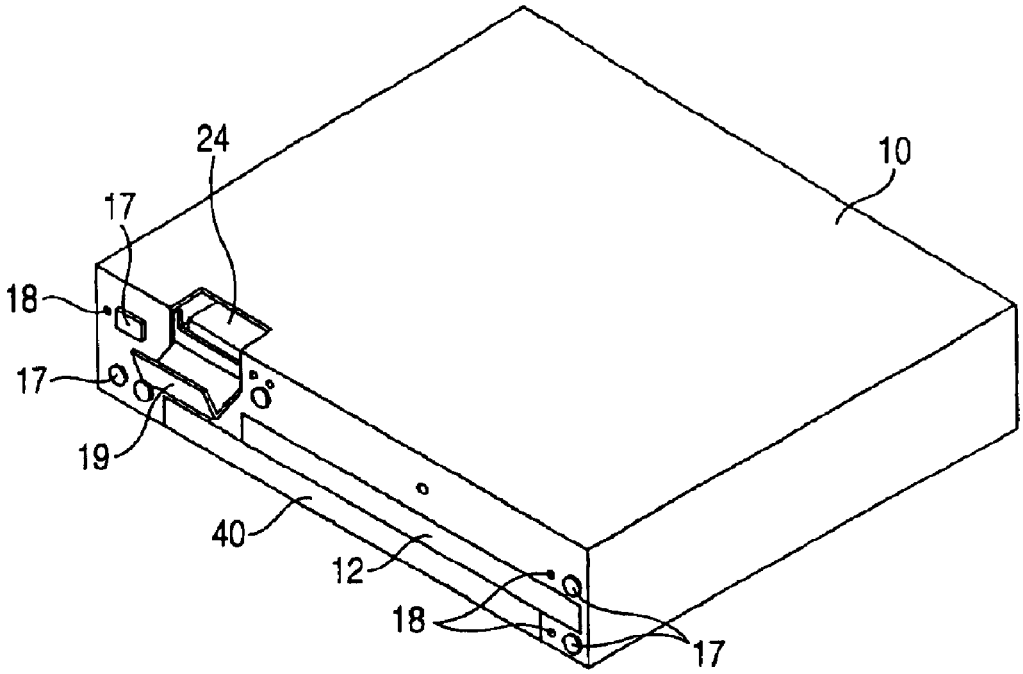
FIG. 26 is a perspective view showing an external appearance of an ink jet recording device as a second embodiment of the invention.

FIG. 26 is a perspective view showing an external appearance of an ink jet recording device 10 which is a second embodiment of the invention in a state that the discharge tray 12 is accommodated in the recording device.

Figure 27:
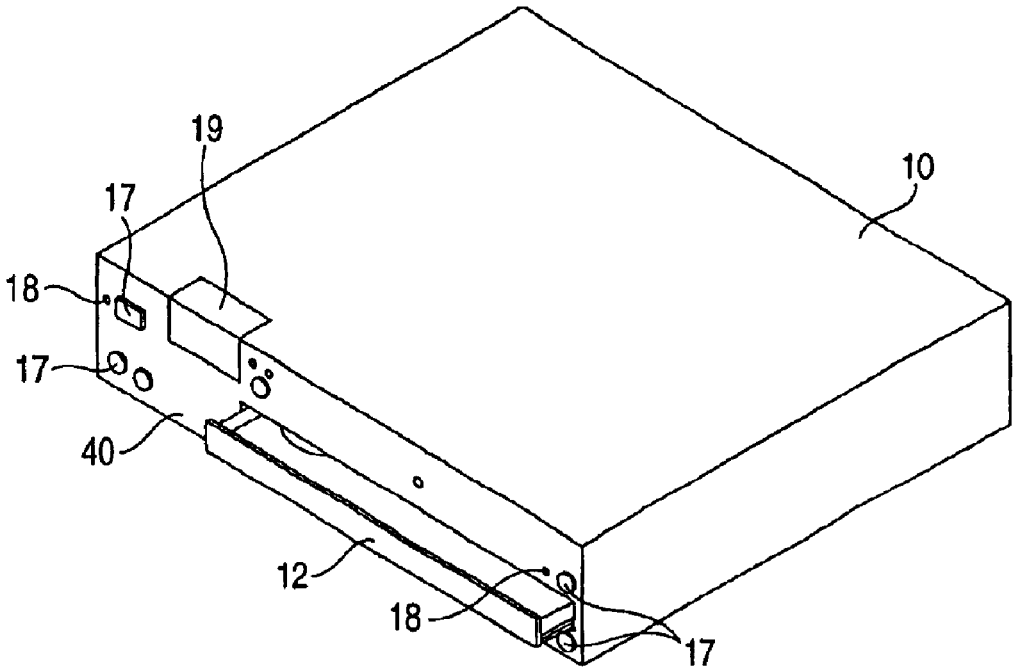
FIG. 27 is a perspective view showing an external appearance of the ink jet recording device when a discharge tray is in a discharge-tray open position.
Figure 28:
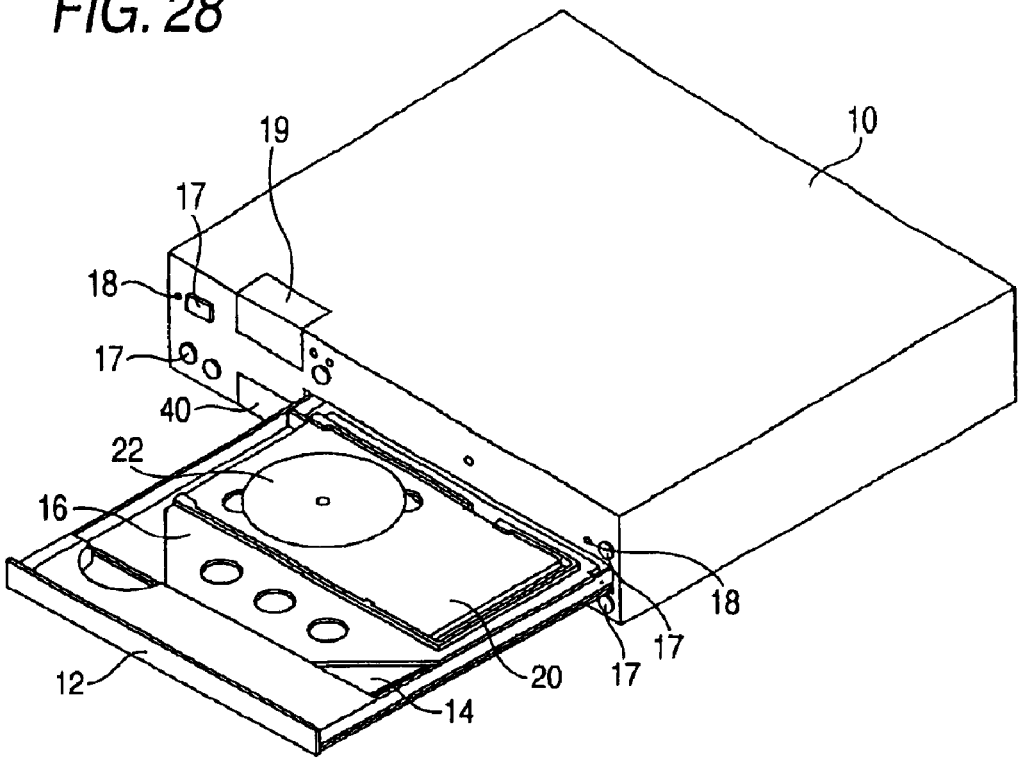
FIG. 28 is a perspective view showing an external appearance of the ink jet recording device when the discharge tray is in a discharge-tray maximum drawn-out position.
Figure 29:
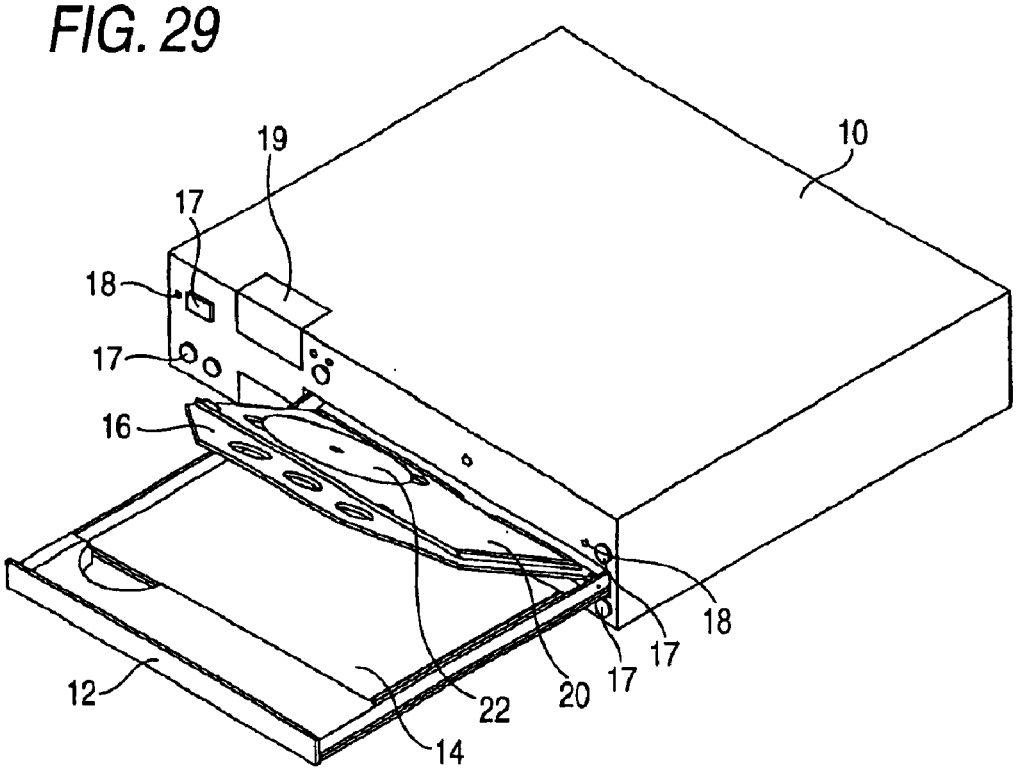
FIG. 29 is a perspective view showing an external appearance of the ink jet recording device in a state that a tray guide is pulled up in order to take out a discharged sheet at the discharge-tray maximum drawn-out position.

FIG. 27 is a perspective view showing an external appearance of the ink jet recording device 10 in a state that apart of the discharge tray is protruded outside the device (A position of the discharge tray in this state will be referred to as "discharge-tray open position", hereinafter). FIG. 28 is a perspective view showing an external appearance of the ink jet recording device 10 in a state that the discharge tray 12 is drawn out to the full extent (A position of the discharge tray in this state will be referred to as "discharge-tray maximum drawn-out position", hereinafter). FIG. 29 is a perspective view showing an external appearance of the ink jet recording device 10 in a state that a tray guide 16 is pulled up in order to take out a discharging sheet 14 at the discharge-tray maximum drawn-out position.

In FIGS. 26 through 29, various switches 17 of the on/off type, such as a power switch and a discharge-tray open switch, and various indicator lamps 18 for indicating statuses of those switches 17 are installed on a main operation panel of the ink jet recording device 10.

An ink replacement cover 19 is used in such a manner that when an ink cartridge 24 is replaced with another cartridge, it is opened as shown in FIG. 26.

The tray guide 16 is integrally formed on the discharge tray 12, and a guide part 72 for guiding the disc tray 20 is formed on the tray guide 16.

The disc tray 20 is mounted on the tray guide 16, and a DVD disc 22 is placed at a predetermined position to be described later on the disc tray 20.

Figure 42:
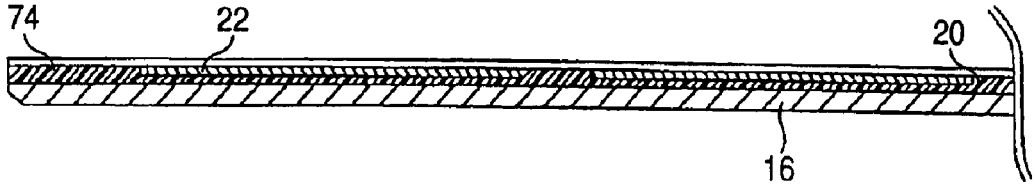
FIG. 42 is a partially enlarged view showing a structural relationship among the tray guide, a disc tray and a DVD disc in the ink jet recording device.

A partially enlarged view showing a structural relationship among the tray guide 16, the disc tray 20 and the DVD disc 22 is shown in FIG. 42.

Figure 30:
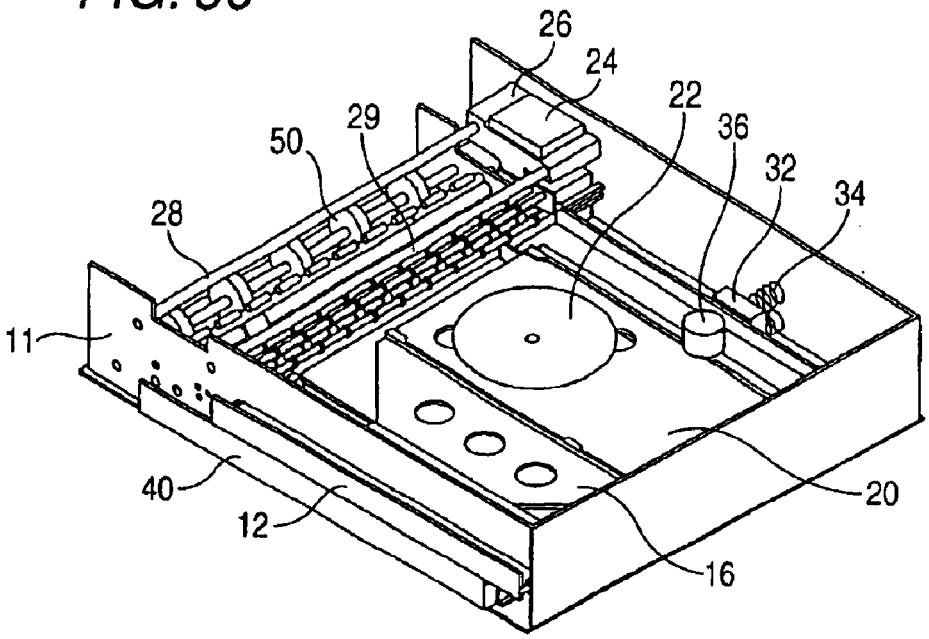
FIG. 30 is a perspective view showing a key portion of the ink jet recording device as the second embodiment of the invention.

FIG. 30 is a perspective view showing a key portion of the innards of the ink jet recording device 10 as the second embodiment of the invention. A carriage 26 on which the ink cartridge 24 and a recording head 30 (FIG. 32) supplied with ink from the ink cartridge 24 are mounted, is supported on cr transmitting means (not shown), such as timing pulleys and a timing belt, and is reciprocatively movable in the main scan directions (parallel to the shafts 28 and 29).

Specific mechanical components necessary for the printing, such as the ink cartridge 24, the carriage 26 and the recording head 30, may basically be those which are known. Those disclosed in Japanese patent application No. 2002-038117 (filed on Feb. 15, 2002 (Heisei 14) by the same Applicant as of the present patent application) may be used for those mechanical components.

A plastic plate 32 as a pressing member presses the discharge tray 12 toward the main operation panel with the aid of a coiled spring 34. A similar combination of the plastic plate and the coiled spring, both not shown, are likewise contained also in a sheet feed cassette 40.

The disc tray 20 is provided with a motor 36 having a pinion 3. When this pinion 35 engages with a gear part 38, which is provided at an end of the disc tray 20, a drive force of the motor 36 is transmitted to the disc tray 20, and the he disc tray 20, which holds the DVD disc 22, is transported in a direction orthogonal to the carriage shafts 28 and 29.

Figure 33A:
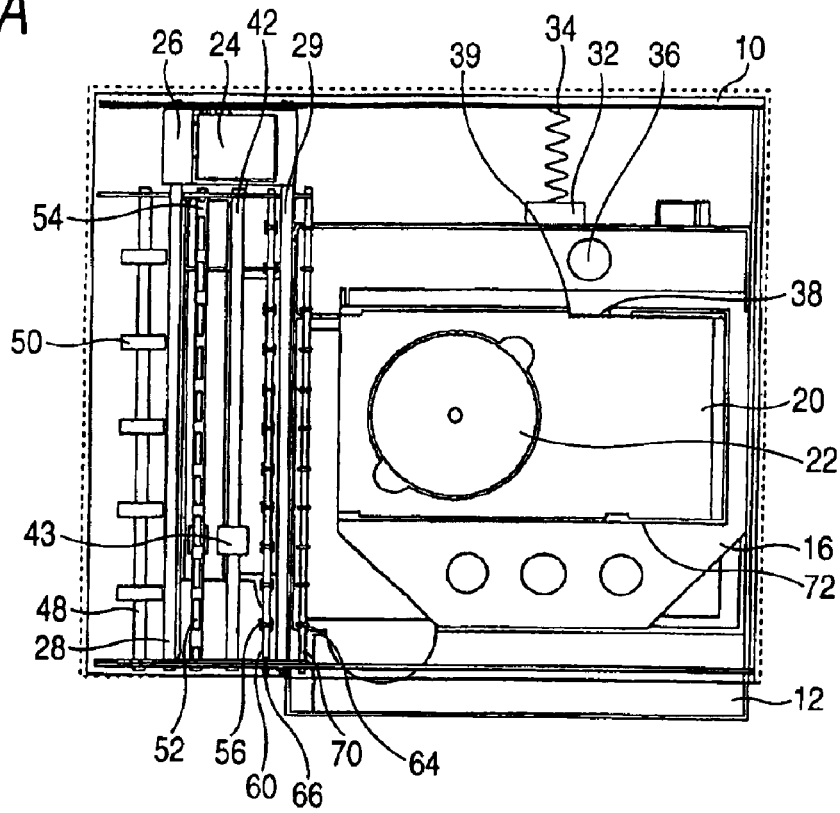
FIG. 33A is a top view showing the innards of the ink jet recording device at a discharge-tray open position in the second embodiment of the invention.

An engagement cutout 39 shown in FIG. 33A is formed at a part of the guide part 72 provided on the tray guide 16. At the engagement cutout 39, the pinion 35 provided on the engagement cutout 39 engages with the gear part 38 provided at an end of the disc tray 20.

Figure 33B:
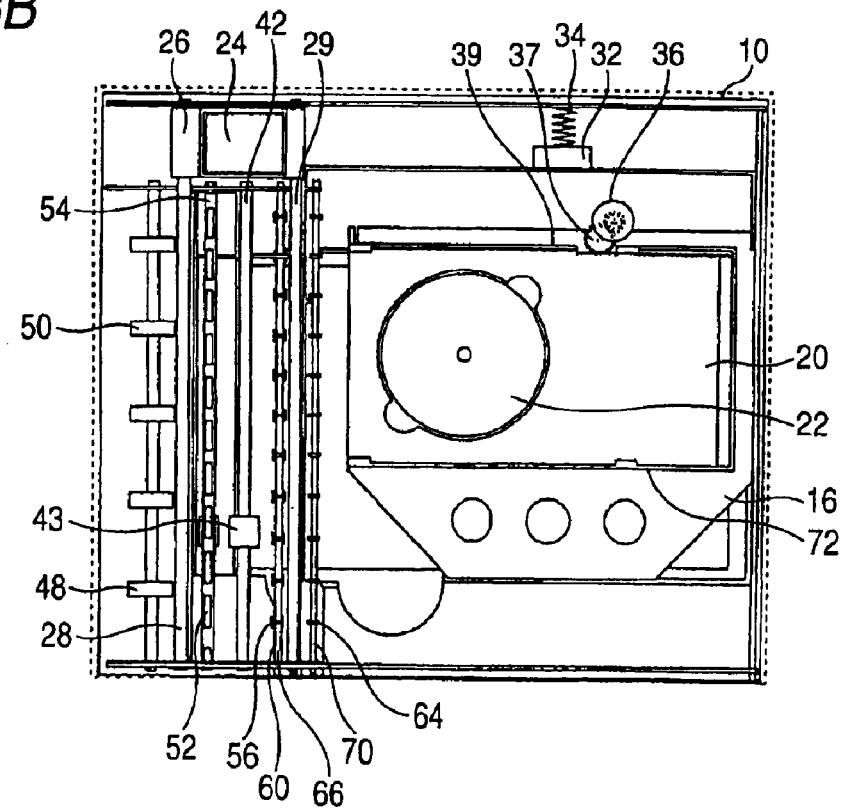
FIG. 33B is a top view showing a modification of the second embodiment of the invention shown in FIG. 33A.

As shown in FIG. 33B, an idle gear 37 maybe interposed between the pinion 35 of the motor 36 and the gear part 38, while being provided on the tray guide 16.

In this case, the idle gear 37 and the pinion 35 are preferably arranged such that their axial centers are shifted from each other in a direction orthogonal to the main scan direction. Where so arranged, when the tray guide 16 moves and the idle gear 37 comes in contact with the pinion 35, the idle gear 37 are brought into engagement with the pinion 35 such that the teeth of the idle gear 37 obliquely contact with the teeth of the pinion 35, thereby ensuring a reliable engagement of them.

The details of the construction and an outline of operation of the ink jet recording device 10 of the present embodiment will be described with reference to FIGS. 31 through 45.

Figure 31:
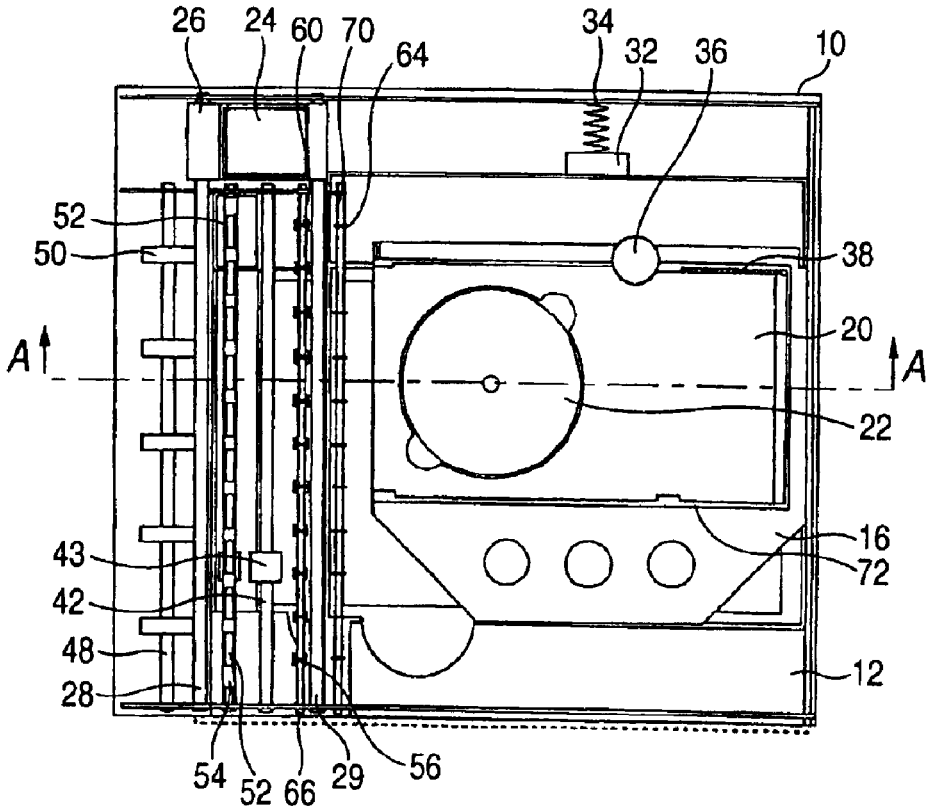
FIG. 31 is a top view showing the innards of the ink jet recording device at a print ready position in the second embodiment of the invention.
Figure 32:
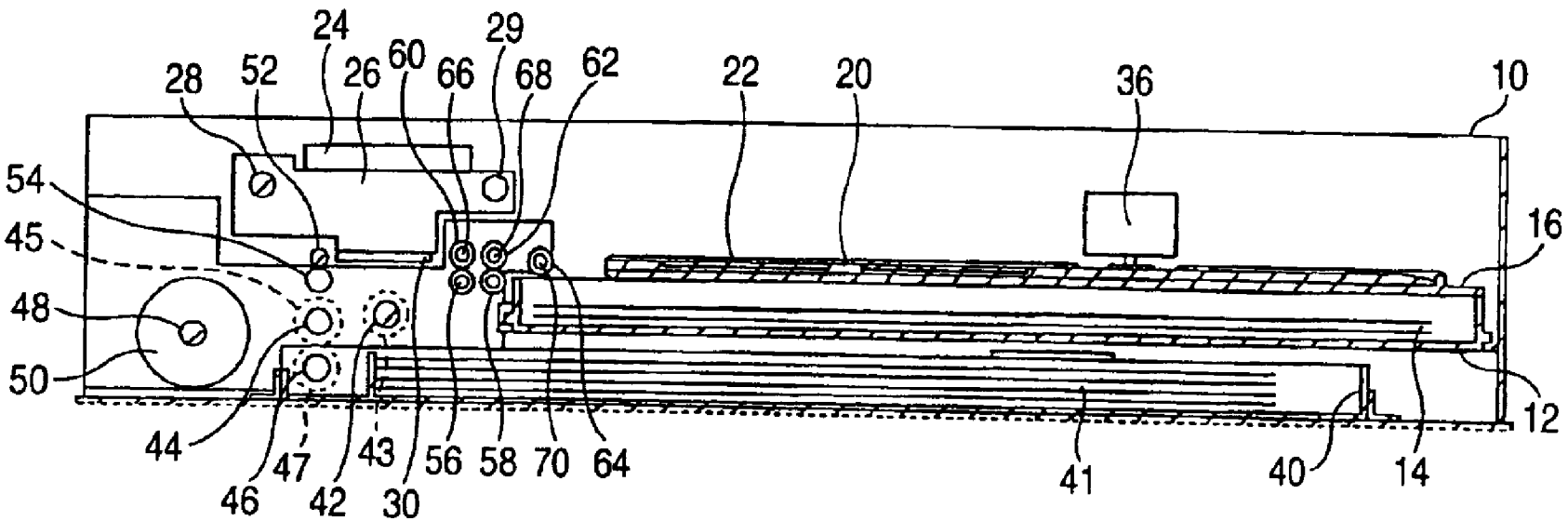
FIG. 32 is a cross sectional view taken on line A—A in FIG. 31.
Figure 34:
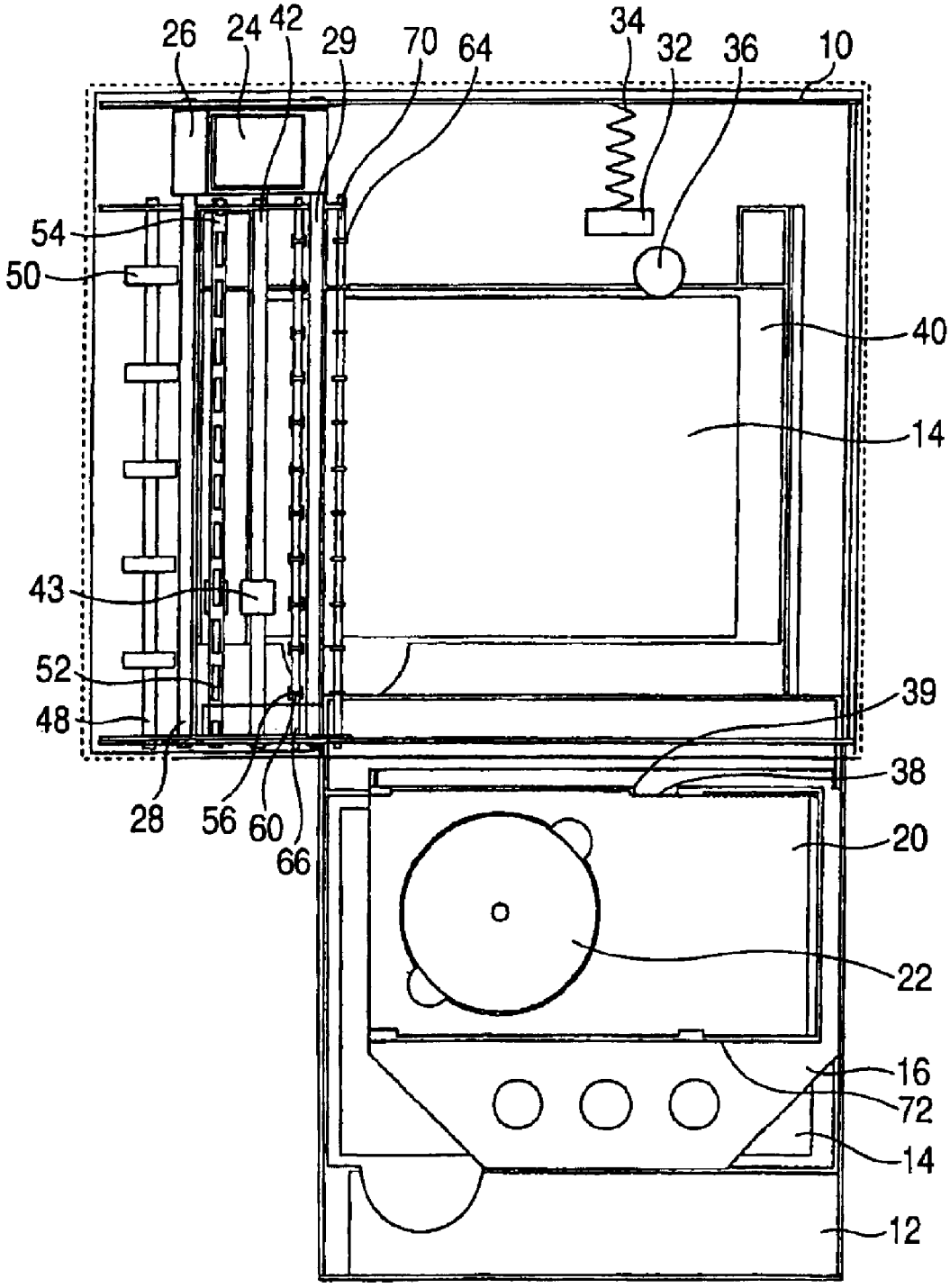
FIG. 34 is a top view showing the innards of the ink jet recording device at a discharge-tray maximum drawn-out position in the second embodiment of the invention.

Reference is made to FIGS. 31 and 32. In those figures, by an operation by an operator on the main operation panel, the DVD disc 22 as a first recording medium is placed on the disc tray 20 as a medium holding plate in a state that the discharge tray 12 shown in FIGS. 28, 29 and 34 is maximumly protruded outside (discharge-tray maximum drawn-out position). Then, the discharge tray 12 is accommodated into the ink jet recording device 10 by manual operation or an electric motor (not shown), and in this state (FIG. 26), the ink jet recording device is in a print ready state (A position of the disc tray 20 in this state will be referred to as a "print ready position").

In FIGS. 27 and 33A, there is illustrated a state that a part of the discharge tray 12 is protruded outside (discharge-tray open position).

Printing on a recording sheet 41 as is stored in the sheet feed cassette 40 will first be described.

As in the case of the discharge tray 12, from the main operation panel, recording sheets 41 have been set in the sheet feed cassette 40 as a medium supplying part, which is accommodated in the ink jet recording device 10. The recording sheets 41 are picked up sheet by sheet by a pickup roller 43 supported on a shaft 42. Thereafter, the recording sheet 41 picked up is transported by sheet feed rollers 45 and 47, which are both rotated clockwise, and reaches a U-turn roller 50 supported by a shaft 48.

Figure 41:
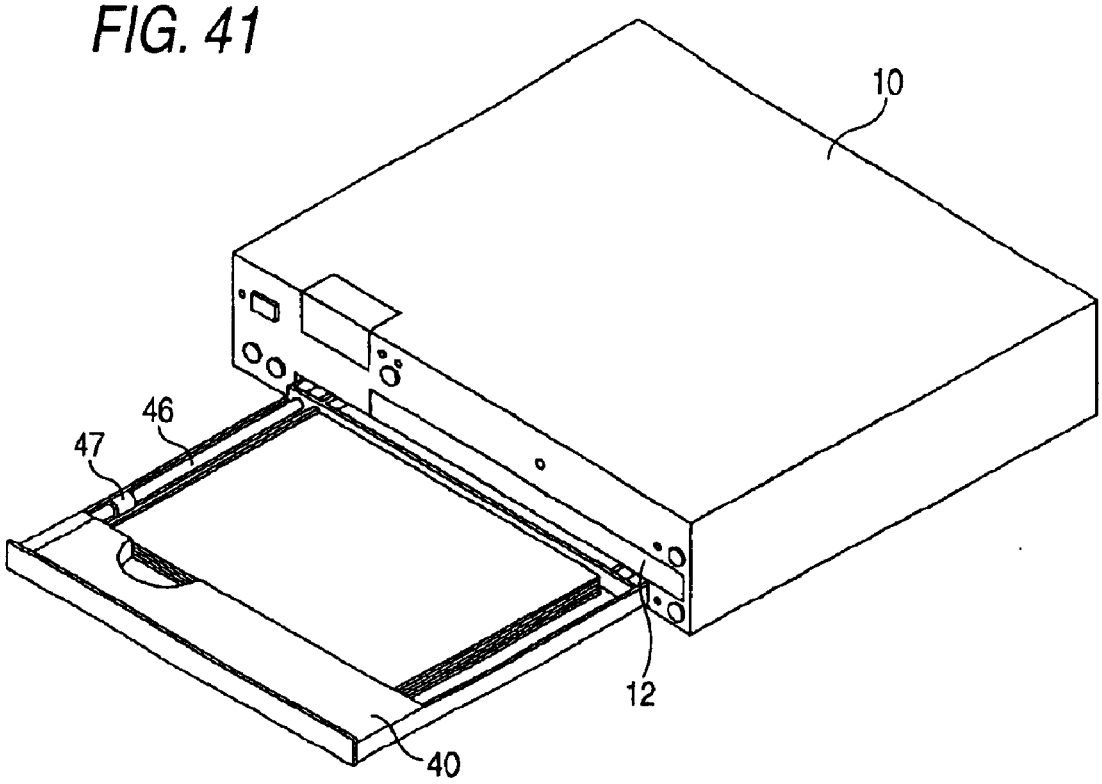
FIG. 41 is a perspective view showing an external appearance showing the ink jet recording device in the second embodiment of the invention when a sheet feed cassette is drawn out.

A shaft 46 and the sheet feed roller 47 are provided in the sheet feed cassette 40, as shown in FIG. 41. The recording sheet 41, which is reversed in its transporting direction by the U-turn roller 50, gains a further transporting force between a pinch roller 52 and a main roller 54.

The main roller 54, which determines a transporting accuracy of the recording sheet, includes a rotary encoder (not shown) for measuring a rotation accuracy, which is mounted on the same shaft as of the main roller.

The rotary encoder is preferably located at a position where it does not hinder the loading/unloading of the ink cartridge 24 and setting/removing of the recording sheets.

The recording sheet 41 having passed through between the pinch roller 52 and the main roller 54 is subjected to an image forming process. In the process, the recording head 30 ejects ink onto the recording sheet to form a given image thereon. Then, the recording sheet passes between the plurality of discharge rollers 56 and 58, and the free rollers 60, 62 and 64, and is discharged into the discharge tray 12.

A plurality of free rollers 60 are supported on a shaft 66; a plurality of free rollers 62, on a shaft 68; and a plurality of free rollers 64, on a shaft 70. Those free rollers 60, 62 and 64 are provided to minimize an area on the recording sheet 41 which receives ink ejected from the recording head 30 and hence, to prevent its ink stain.

Operation of printing on the DVD disc 22 held on the disc tray 20 will be described.

Figure 35:
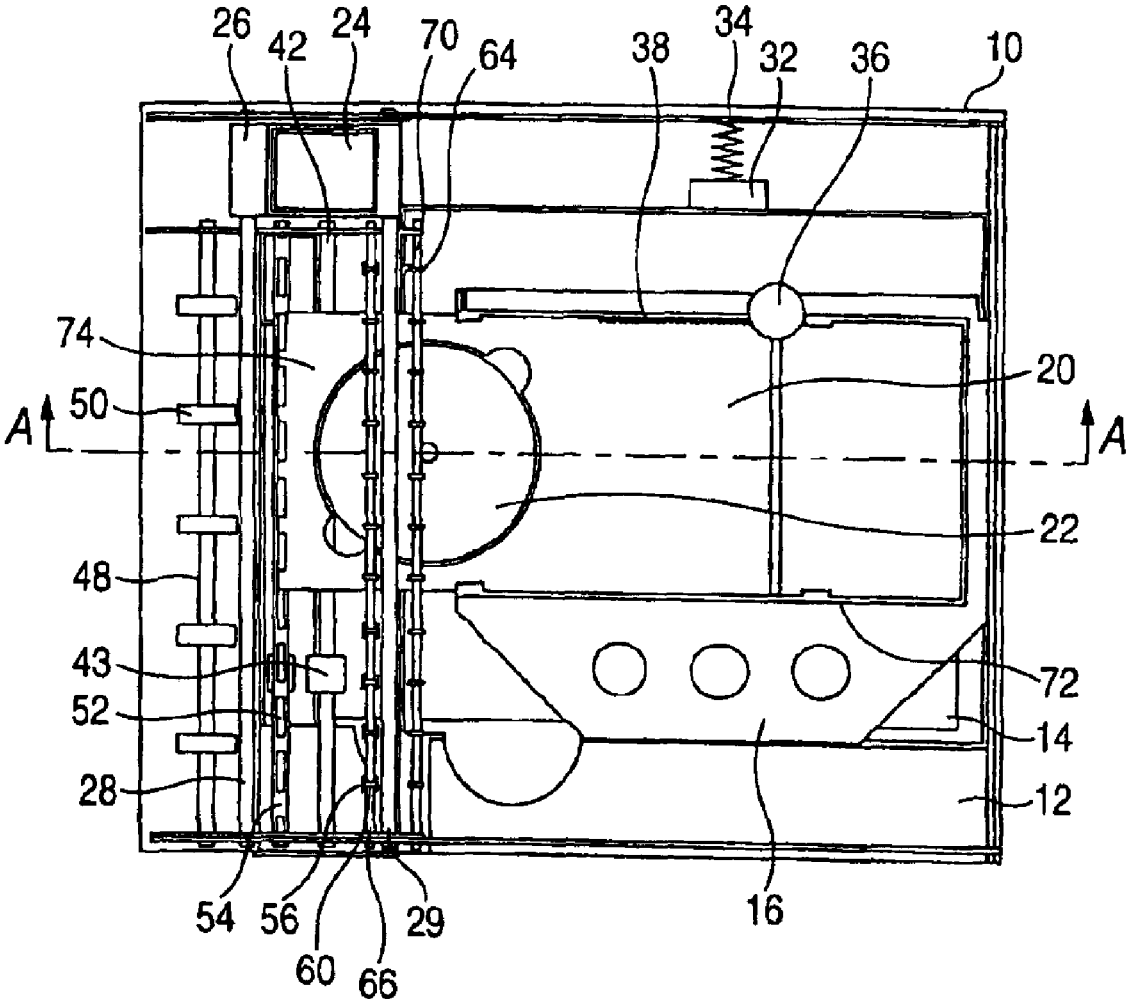
FIG. 35 is a top view showing the innards of the ink jet recording device at a disc tray pull-in position in the second embodiment of the invention.
Figure 36:
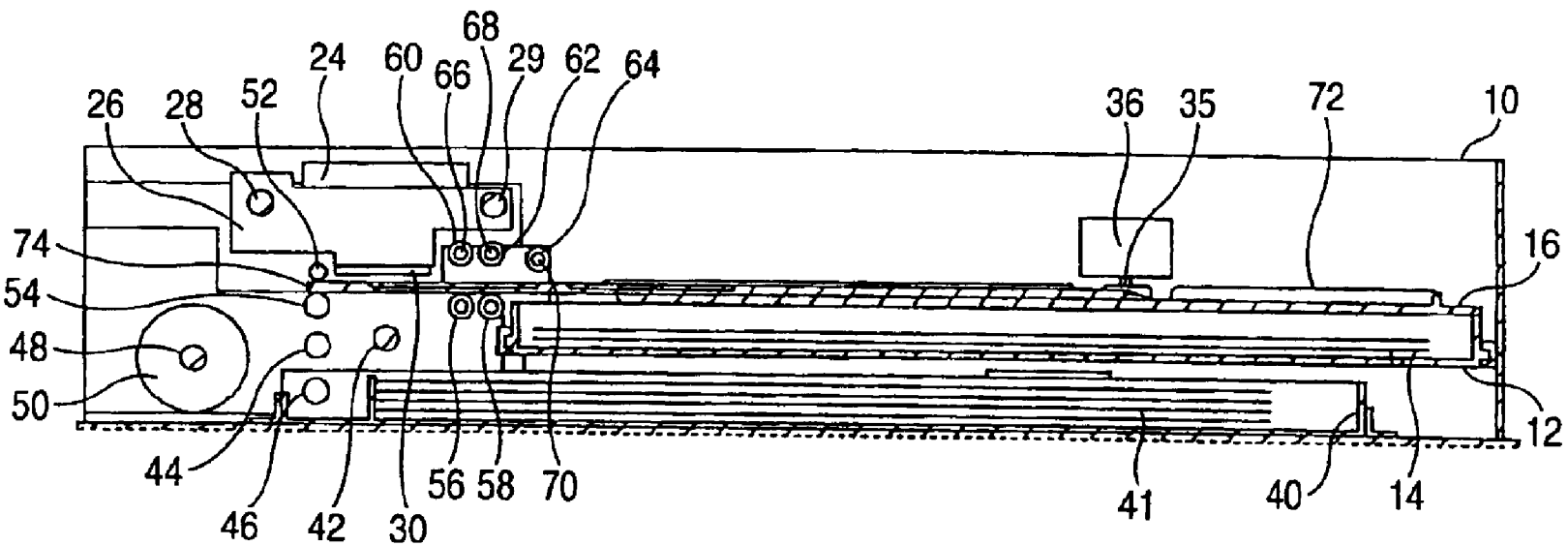
FIG. 36 is a cross sectional view taken on line A—A in FIG. 35.

In a print ready position shown in FIGS. 31 and 32, when the motor 36 is rotated clockwise, the pinion 35 engages with the gear part 38, so that the disc tray 20 is transported toward the carriage shafts 28 and 29 along the guide part 72 provided on the tray guide 16. And as shown in FIGS. 35 and 36, a leading end 74 of the disc tray 20 reaches between the pinch roller 52 and the main roller 54 (a position of the disc tray 20 in this state will be referred to as a "disc tray pull-in position").

In other cases than the printing on the recording sheet 41, inclusive of a case where the disc tray is transported from the print ready position to the disc tray pull-in position, the free gears 60, 62 and 64 automatically move upward by a mechanism to be described later (FIG. 36) to thereby eliminate a chance of damaging the DVD disc 22 by the free gears 60, 62 and 64.

The U-turn roller 50, the main roller 54 and the discharge rollers 56 and 58 are driven in an interlocking mannerm, and the rotational directions of those rollers maybe switched in accordance with a transporting direction of the disc tray 20.

Figure 37:
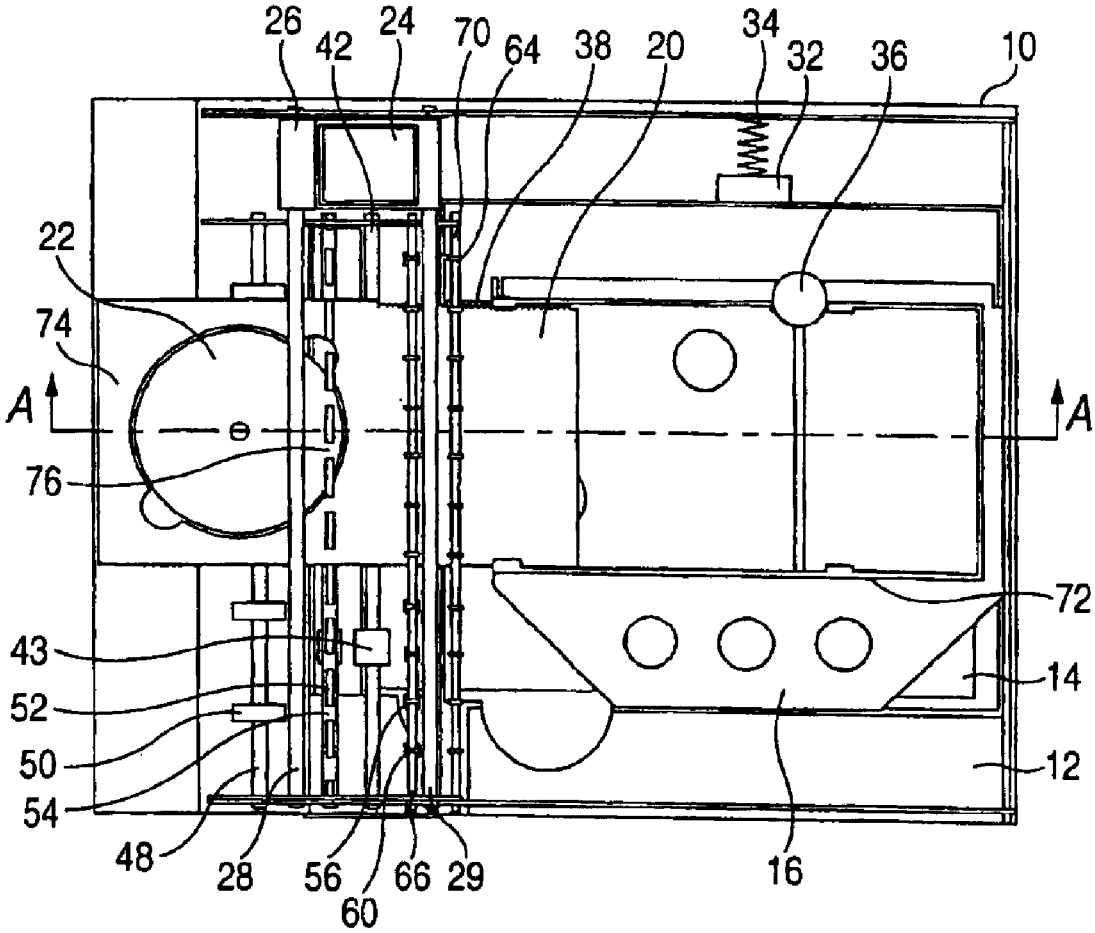
FIG. 37 is a top view showing the innards of the ink jet recording device at a print start position in the second embodiment of the invention.
Figure 38:
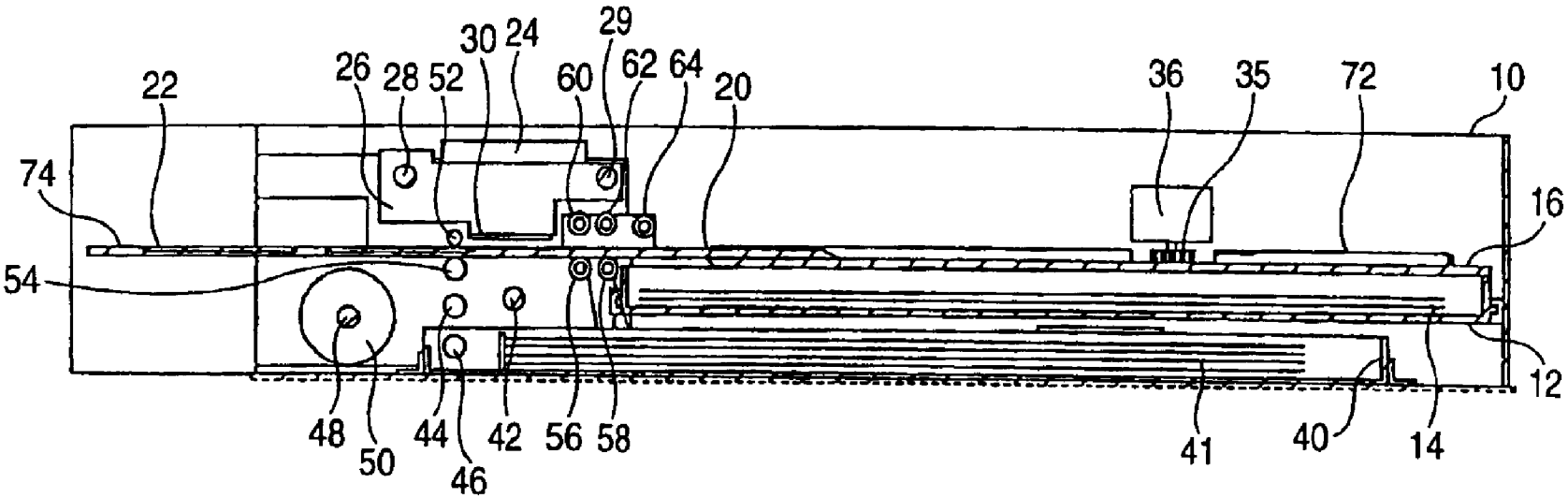
FIG. 38 is a cross sectional view taken line A—A in FIG. 37.

When the disc tray 20 passes a region (first region) where it is driven by the motor 36 and the leading end 74 of the disc tray 20 reaches a position between the pinch roller 52 and the main roller 54, then the pinch roller 52 descends. In a region located further ahead (second region), the disc tray 20 is transported by the combination of the pinch roller 52 and the main roller 54. As shown in FIGS. 37 and 38, a trailing end 76 of the DVD disc 22 is located at a position closer to the U-turn roller 50 than the recording head 30 (This position of the disc tray 20 will be referred to as a "print start position").

Thereafter, the disc tray 20 is transported from the print start position toward the first region by the combination of the pinch roller 52 and the main roller 54, while at the same time the recording head 30 prints on the DVD disc 22.

Figure 39:
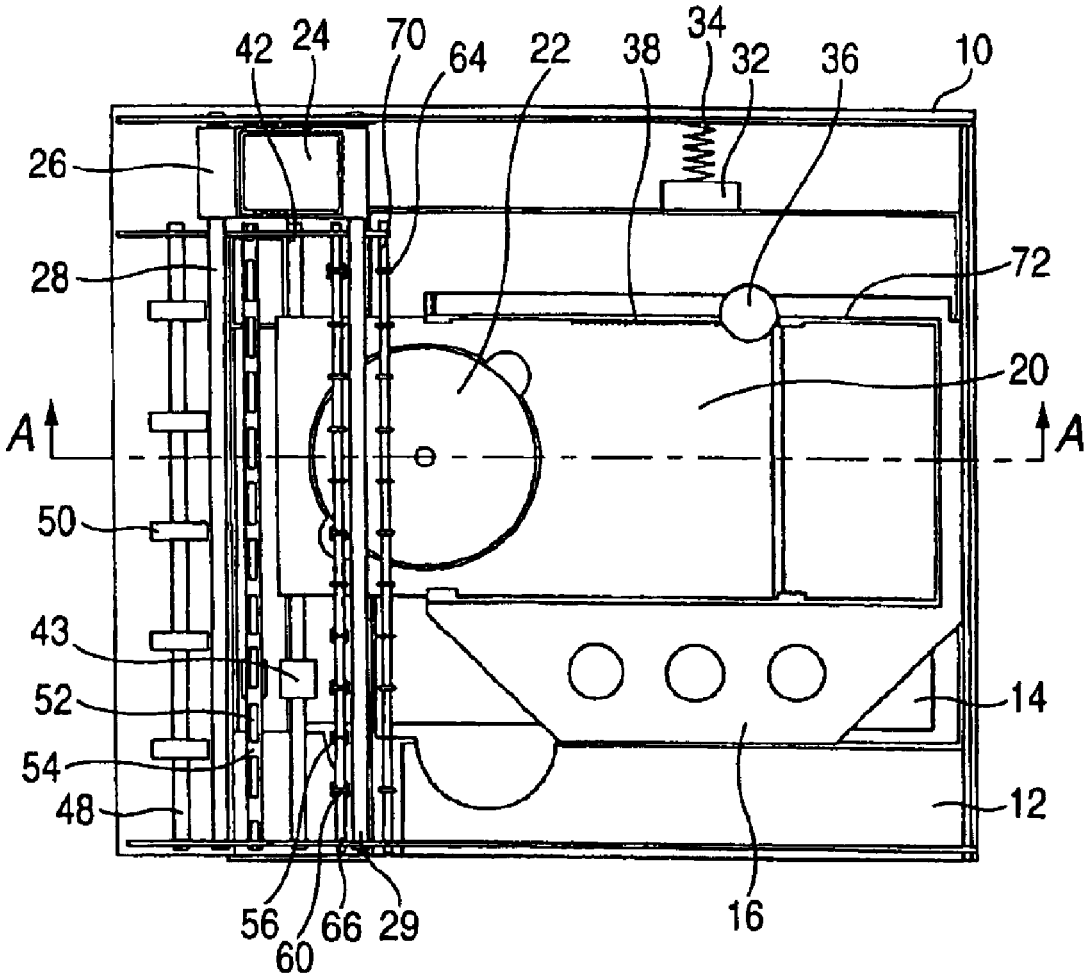
FIG. 39 is a top view showing the innards of the ink jet recording device at a print end position in the second embodiment of the invention.
Figure 40:
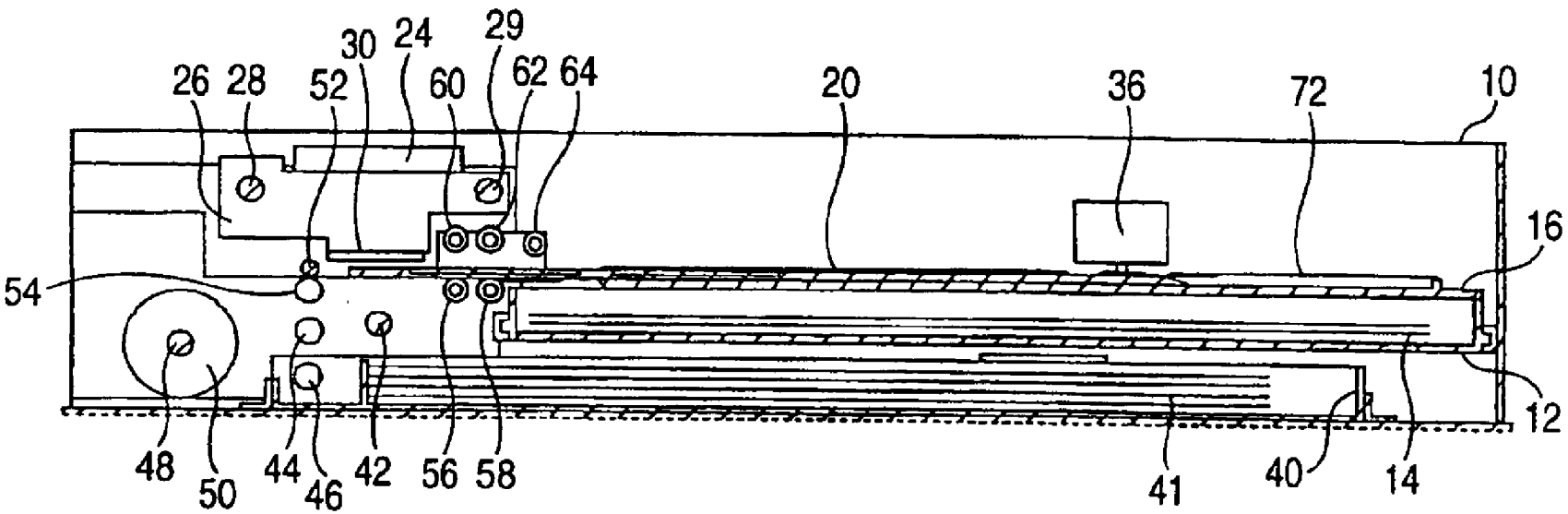
FIG. 40 is a cross sectional view taken line A—A in FIG. 39.

Upon completion of the printing operation on the DVD disc 22 by the recording head 30 and the transportation of the disc tray toward the first region by the combination of the pinch roller 52 and the main roller 54, the disc tray 20 moves to the first region as shown in FIGS. 39 and 40 (A position of the disc tray 20 shown in FIGS. 39 and 40 will be referred to as a "print end position"), and is transported to the print ready position by the motor 36.

In the light of preventing the irregular transportation, it is preferable that the disc tray 20 is flush with the DVD disc 22.

In the present embodiment, after the printing on the DVD disc 22 ends, the disc tray 20 is transported to the print ready position shown in FIGS. 31 and 32, and the indicator lamp 18 is energized to show the end of printing to the operator. In place of using the indicator lamp 18 to show the end of printing, the following alternative may be employed. The disc tray is automatically moved to the discharge-tray open position or the discharge-tray maximum drawn-out position by use of a motor (not shown), to thereby show the end of printing.

In another alternative, after the end of printing, the disc tray stays at the print end position, and the operator operates one of the switches 17, whereby the motor 36 and another motor (not shown) are operated and the disc tray 20 is automatically ejected outside.

Figure 43:
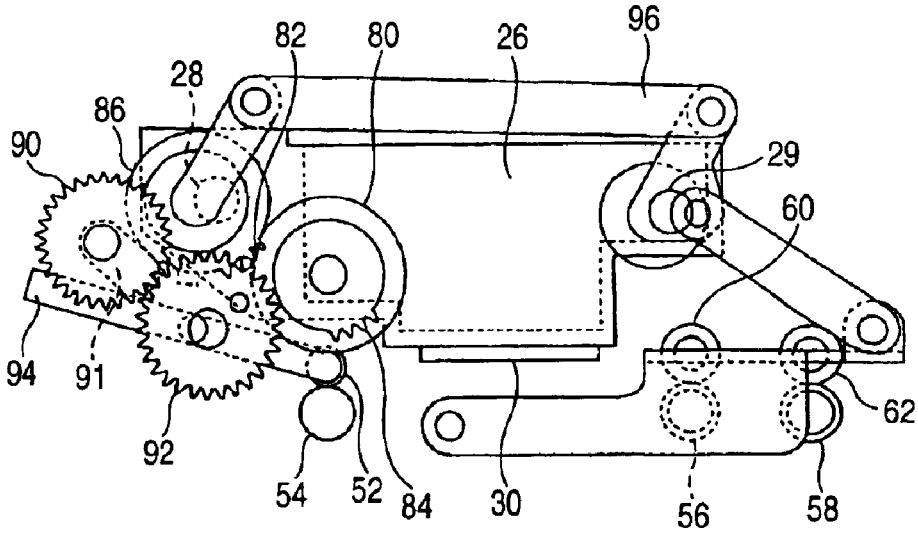
FIG. 43 is a conceptual diagram showing a key portion of a moving mechanism (pinch-roller distance changing mechanism) including a carriage, a pinch roller, and free gears.
Figure 44:
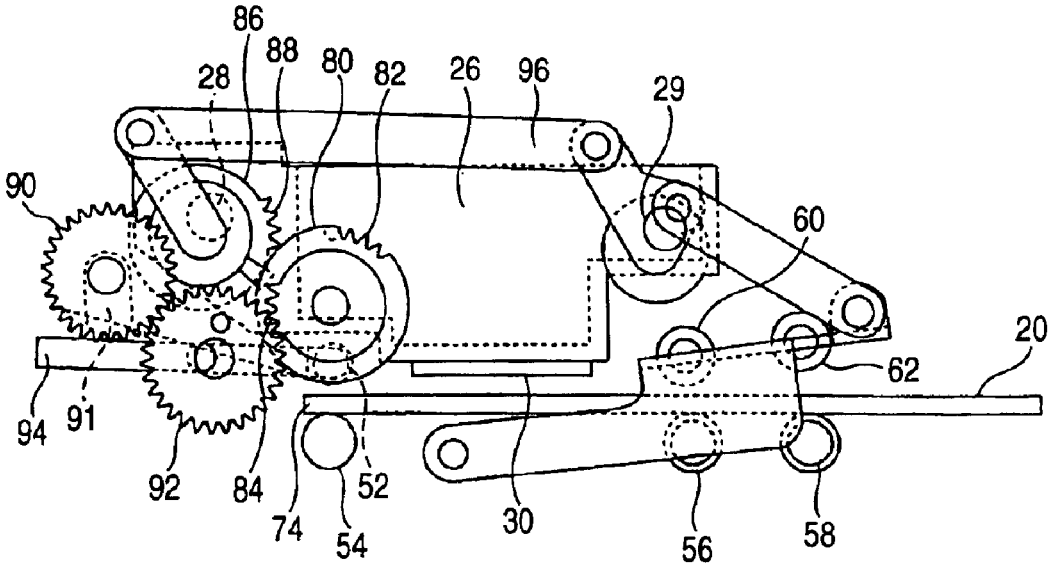
FIG. 44 is a conceptual diagram showing a key portion of a moving mechanism (pinch-roller distance changing mechanism) including a carriage, a pinch roller, and free gears in the second embodiment of the invention when the discharge tray is at a disc tray pull-in position.
Figure 45:
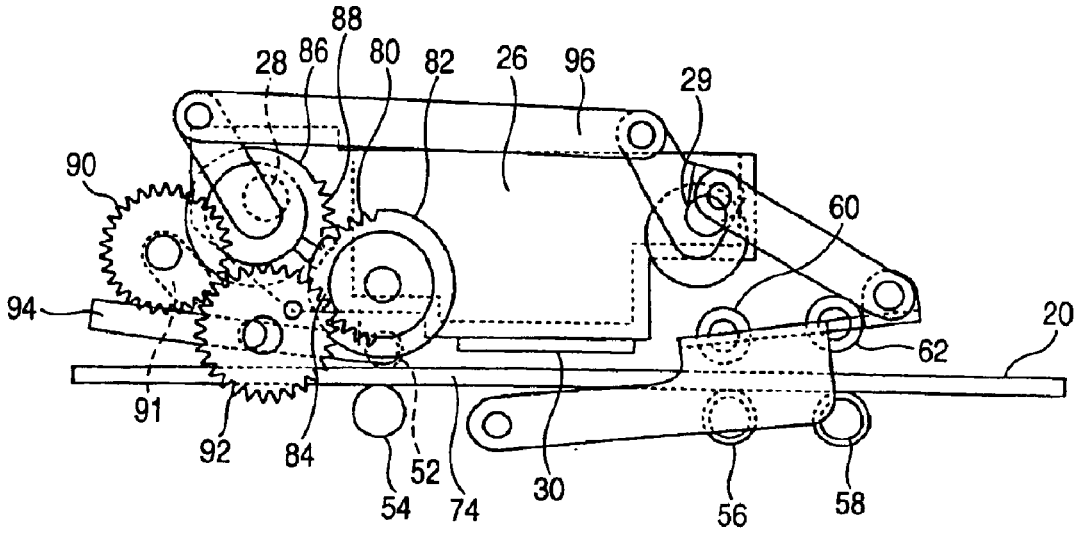
FIG. 45 is a conceptual diagram showing a key portion of a moving mechanism (pinch-roller distance changing mechanism) including a carriage, a pinch roller, and free gears in the second embodiment of the invention when the ink jet recording device is during printing.

A major part of a moving mechanism including the carriage 26, the pinch roller 52, and the free gears 60, 62 and 64 is shown in FIGS. 43 to 45.

The free roller 64 is omitted for ease of explanation.

Figure 47:
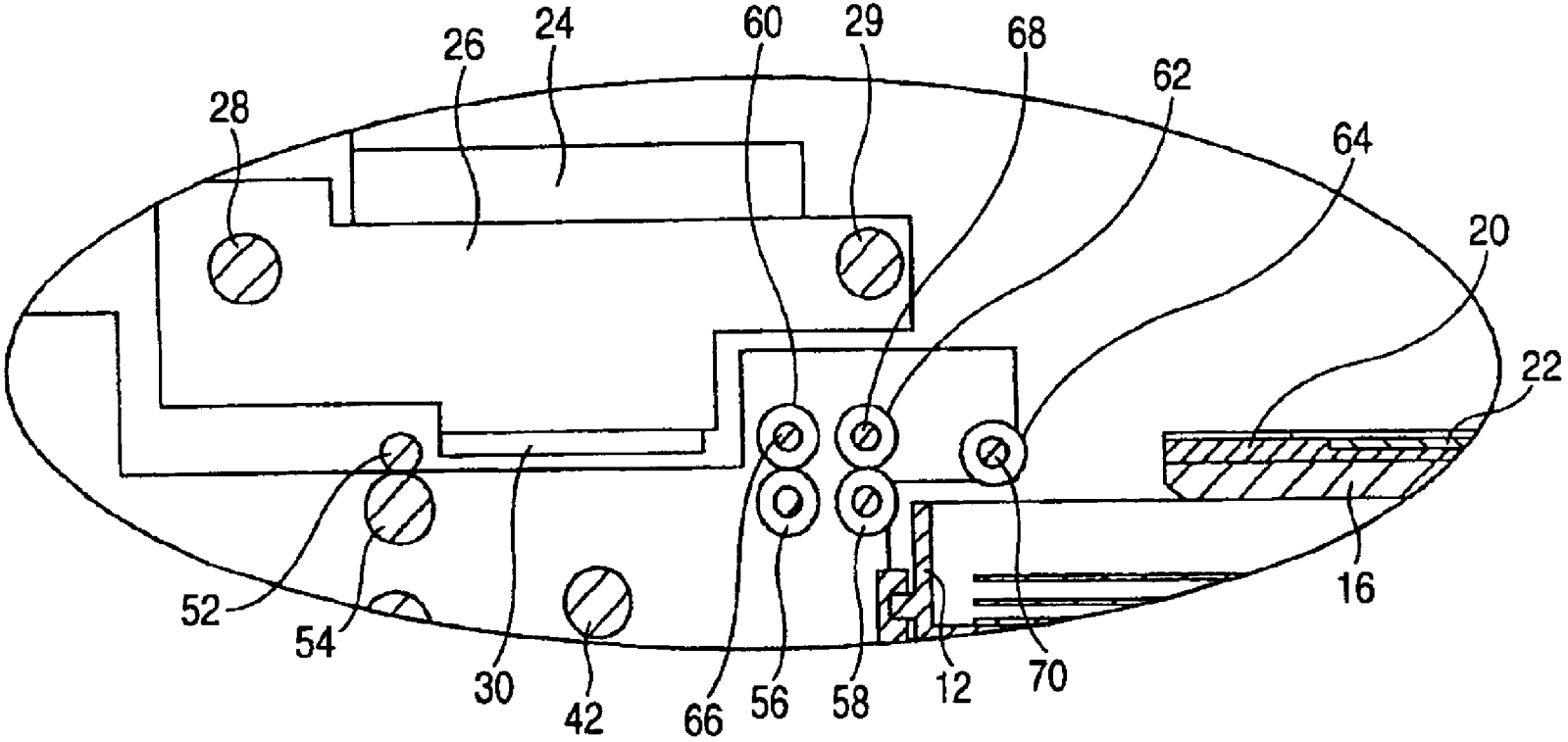
FIG. 47 is an enlarged, conceptual diagram showing a key portion of a pinch-roller distance changing mechanism in the second embodiment of the invention when the discharge tray is at a normal sheet printing position.

FIGS. 43 and 47 show a position of the disc tray when the ink jet recording device is in a print ready state. The recording head 30, the carriage 26, the pinch roller 52, and the free rollers 60 and 62 are at the same position as at the time of printing on the recording sheet 41 (This position will be referred to as a "normal sheet printing position"). At this position, the recording head 30, the carriage 26, the pinch roller 52, and the free rollers 60 and 62 are at the lowest position.

A gear 80 is provided on a chassis side plate 11. The gear 80 includes a large-diameter part 82 and a small-diameter part 84.

A gear 86 is provided on the carriage shaft 28, and will be in mesh with the large-diameter part 82 of the gear 80.

The small-diameter part 84 of the gear 80 is in mesh with a gear 92, which is in mesh with a gear 90 having a cam 91.

A pinch roll holder 94 rotatably holds the pinch roller 52 at its top end. The pinch roller 52 vertically moves in accordance with a contact state between the cam 91 of the gear 90 and the pinch roll holder 94.

The gear 86 interlocks with the free rollers 60 and 62, through a link mechanism 96.

With such a construction, the carriage shafts 28 and 29 move upward in the drawing under driving of a motor (not shown). With this, the carriage 26 and the recording head 30 move upward.

With this, the gears 86, 80, 92 and 90 also rotate, and the pinch roller 52 moves upward as shown in FIG. 44.

The free gears 60, 62 and 64 also move upward through the link mechanism 96.

At the disc tray pull-in position, the carriage 26, the pinch roller 52, and the free gears 60, 62 and 64 are at a position shown in FIG. 44 (This position will be referred to as a "disc pull-in position").

With this, when the disc tray 20 moves from the first region to the second region, the disc tray 20 is smoothly transported to the second region without hitting the recording head 30, the pinch roller 52, and the free gears 60, 62 and 64. And, there is no danger that the free gears 60, 62 and 64 damage the surface of the DVD disc 22.

When it is detected that the leading end 74 of the disc tray 20 passes under the pinch roller 52, the pinch roller 52 descends as shown in FIG. 45 and comes in contact with the disc tray 20 (The position shown in FIG. 45 will be referred to as a "disc print position"). In the second region, the disc tray 20 is transported by the combination of the pinch roller 52 and the main roller 54.

At the print start position, in-printing, and the print end position, a pinch-roller distance changing mechanism is at the disc print position, the recording head 30 has been raised to an optimum height with respect to the disc tray 20 or the DVD disc 22, and the free gears 60, 62 and 64 has also been raised in link to the recording head. Accordingly, the free gears 60, 62 and 64 do not a but against the DVD disc 22 immediately after the printing. Accordingly, there is no chance of damaging the surface of the DVD disc 22.

At the time of printing, a distance of the recording head 30, which is coupled to the pinch-roller distance changing mechanism, to the DVD disc 22 and the recording sheet 41, is kept at a fixed distance by the pinch-roller distance changing mechanism. Accordingly, an optimum printing state can always be secured.

Detailed operations of the thus constructed ink jet recording device 10 in the present embodiment will be described with reference to FIGS. 46 to 54.

Figure 46:
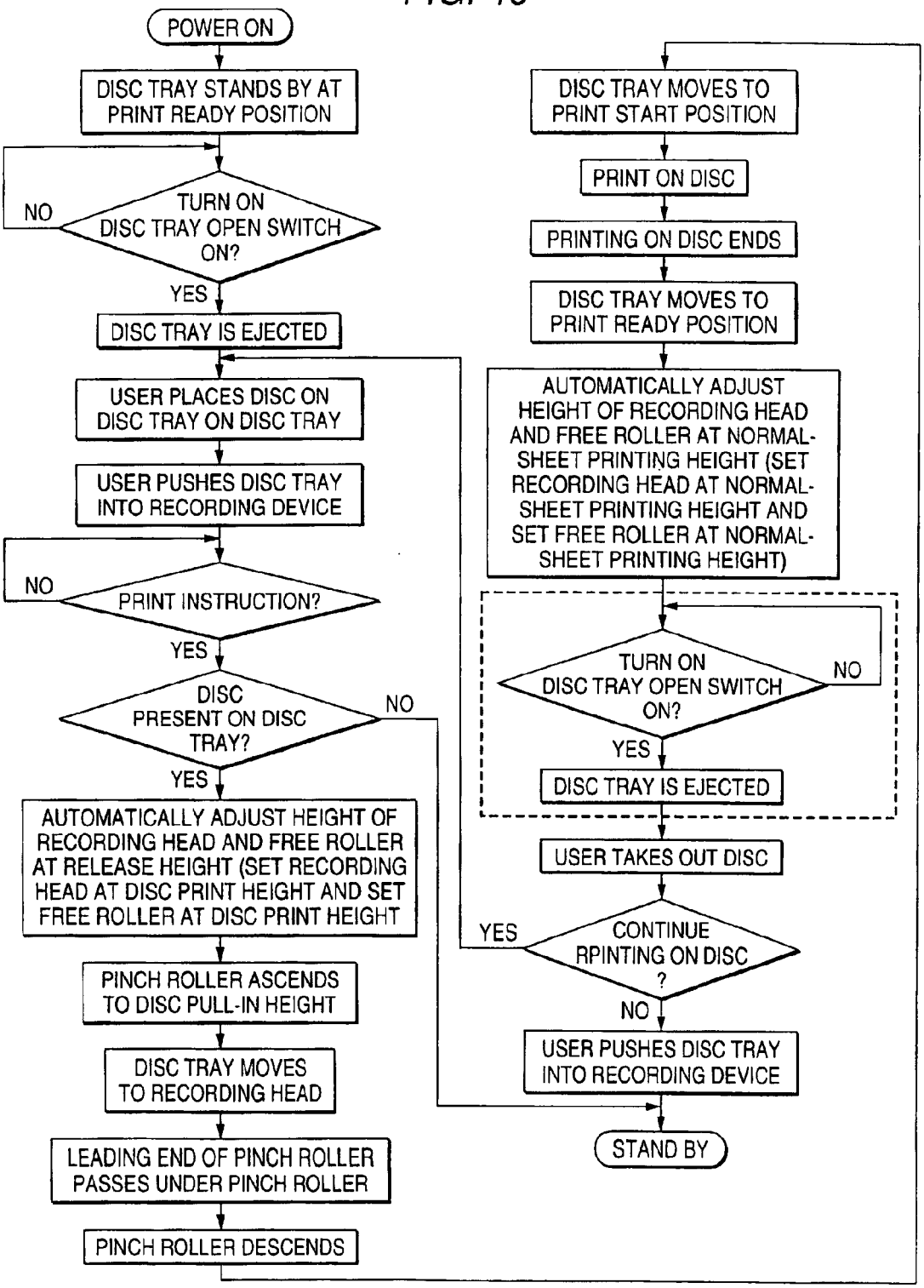
FIG. 46 is a flow chart for explaining operations of the ink jet recording device in the second embodiment of the invention.

FIG. 46 is a flow chart useful in explaining operations of the ink jet recording device 10 in the embodiment.

To start, an operator opens the glass door 5 and turns on a power switch, and then the disc tray 20 watches and waits at the print ready position.

At the print ready position, the carriage 26, the pinch roller 52 and the free gears 60, 62 and 64 are at the normal sheet printing position shown in FIG. 47.

The free rolls 64 are somewhat lower than the free rollers 60 and 62. Accordingly, when the recording head prints on the recording sheet 41 in the sheet feed cassette, it is transported somewhat downwardly by the free roller 64 after the printed recording sheet 41 passes the free rollers 60 and 62, and it is smoothly discharged into the discharge tray 12.

Next, the operator turns on the discharge tray open switch 17. Then, the discharge tray 12 is ejected to the discharge-tray open position shown in FIGS. 27 and 33A.

Then, the operator draws out the discharge tray 12 to the discharge-tray maximum drawn-out position, places a disc 22 on the disc tray 20, and then pushes the discharge tray 12 into the ink jet recording device 10.

To take out a discharging sheet (the recording sheet 41 after the printing thereon is completed) from the discharge tray 12, the disc tray 20 is raised as shown in FIG. 29, and in this state, the discharging sheet is taken out.

When a print instruction is issued, a sensor (not shown) provided in the ink jet recording device 10 judges whether or not a disc 22 is present on the disc tray 20. If the disc is not present, the ink jet recording device, the disc tray stands by as it stands, viz., it stands by at the print ready position shown in FIGS. 31 and 32.

Figure 48:
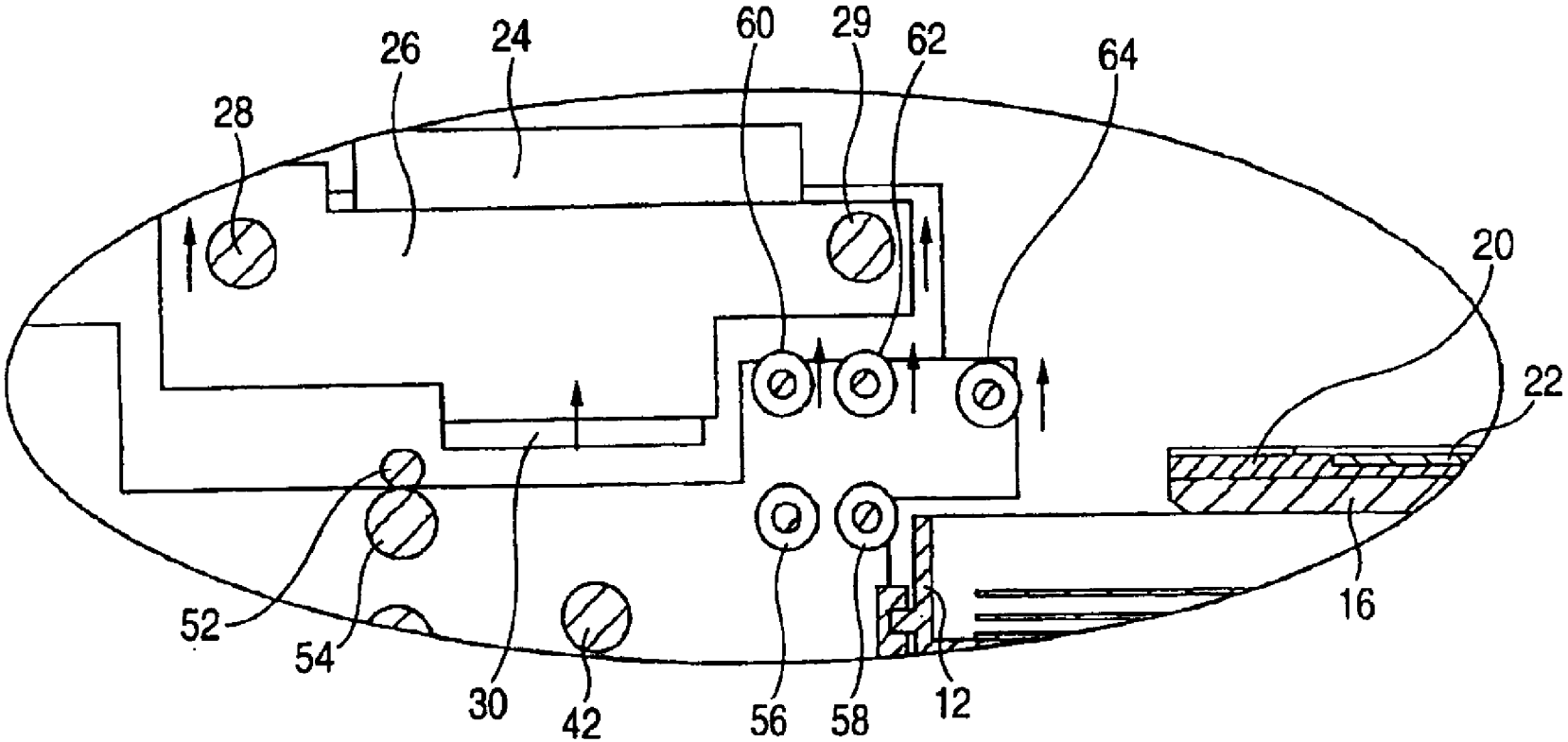
FIG. 48 is an enlarged, conceptual diagram showing a key portion of the pinch-roller distance changing mechanism when the recording head and the free rollers ascend to the disc print position in FIG. 47.
Figure 49:
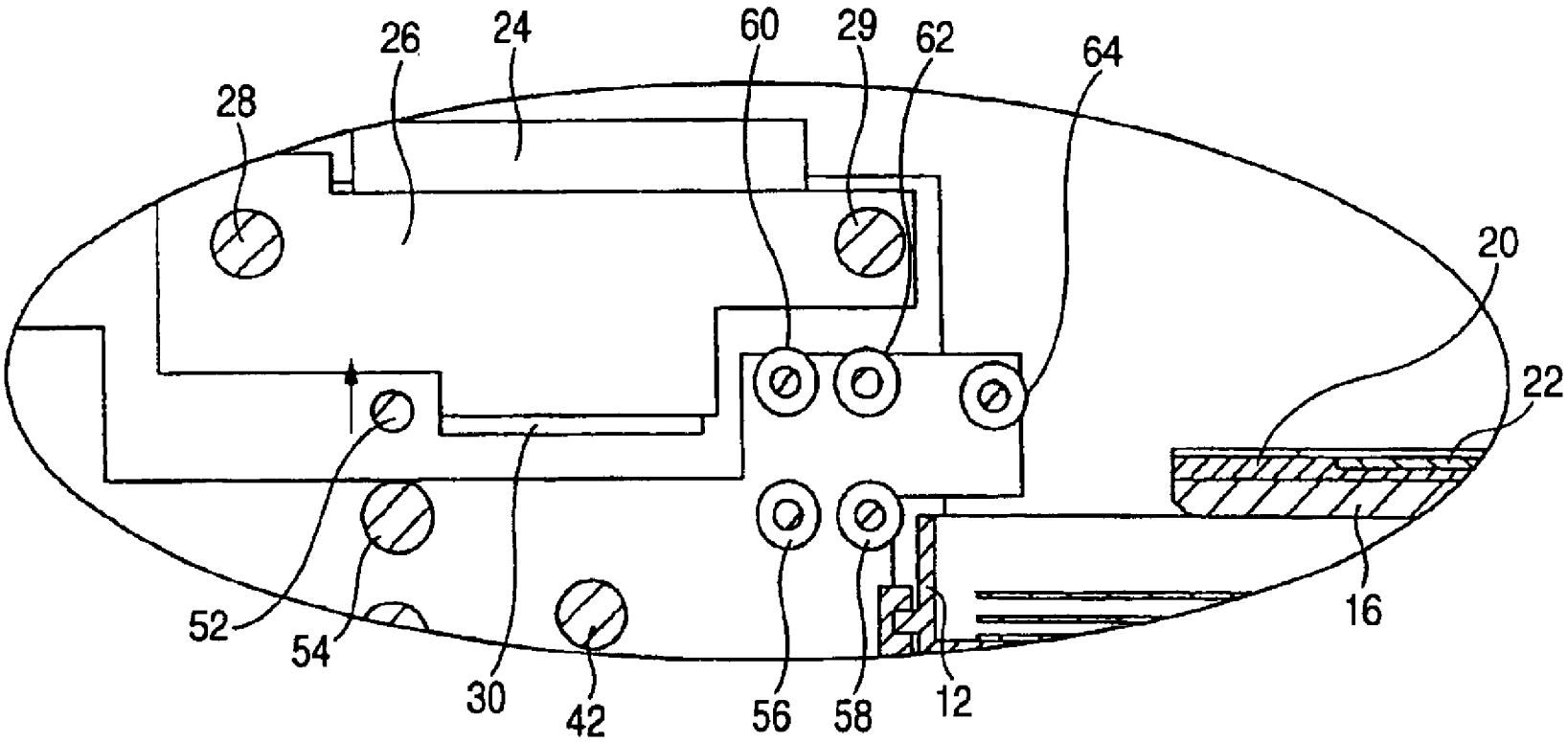
FIG. 49 is an enlarged, conceptual diagram showing a key portion of the pinch-roller distance changing mechanism when the pinch roller ascends to the disc tray pull-in position in FIG. 48.

If the DVD disc 22 is present, the recording head 30 and the free gears 60, 62 and 64 ascends to the disc print position shown in FIG. 48 in accordance with a thickness of the disc tray 20 or the DVD disc 22, and the pinch roller 52 also ascends to the disc tray pull-in height shown in FIG. 49. Those are at the disc pull-in position shown in FIGS. 44 and 49.

Figure 50:
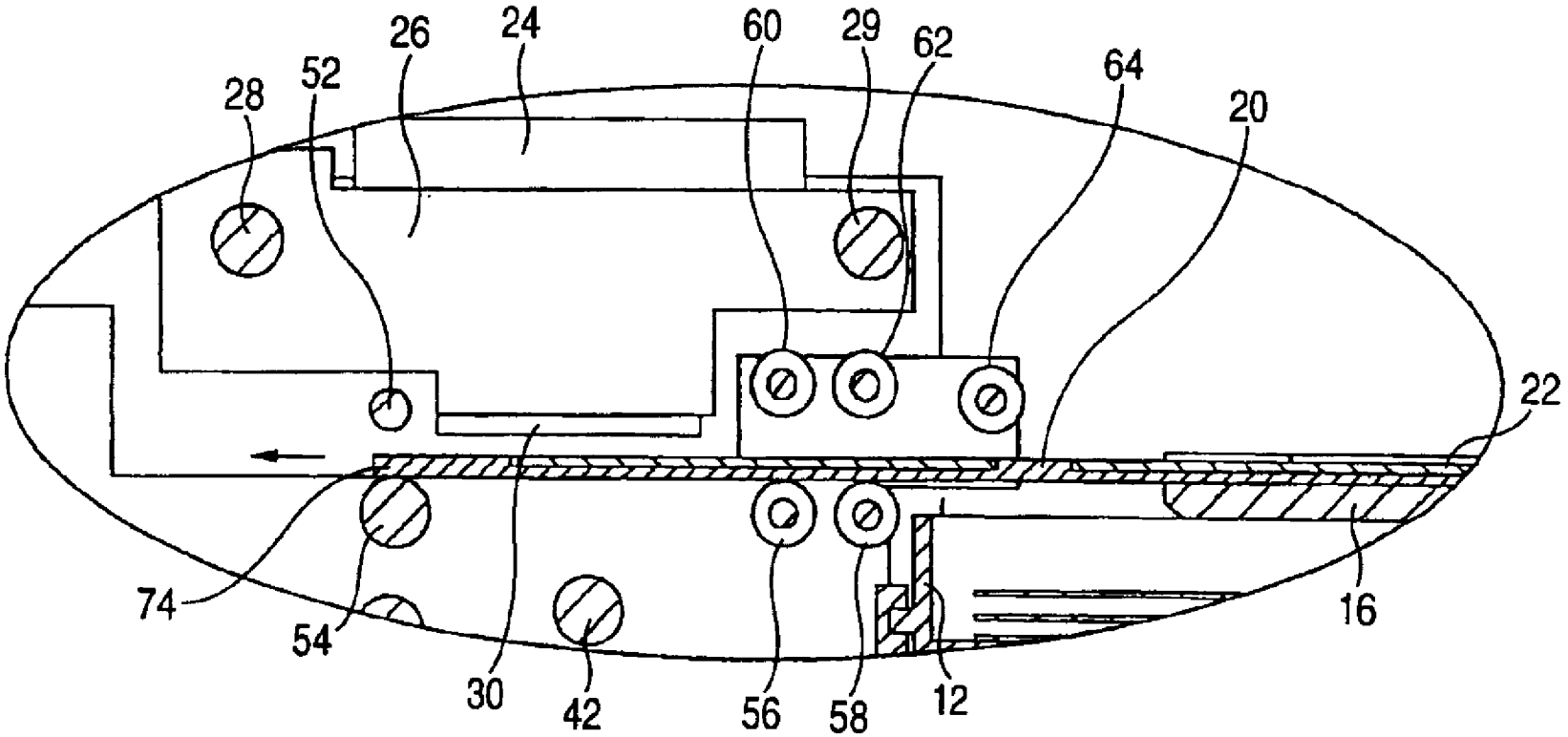
FIG. 50 is an enlarged, conceptual diagram showing a key portion of the pinch-roller distance changing mechanism when the leading end of the discharge tray passes under the pinch roller in FIG. 49.
Figure 51:
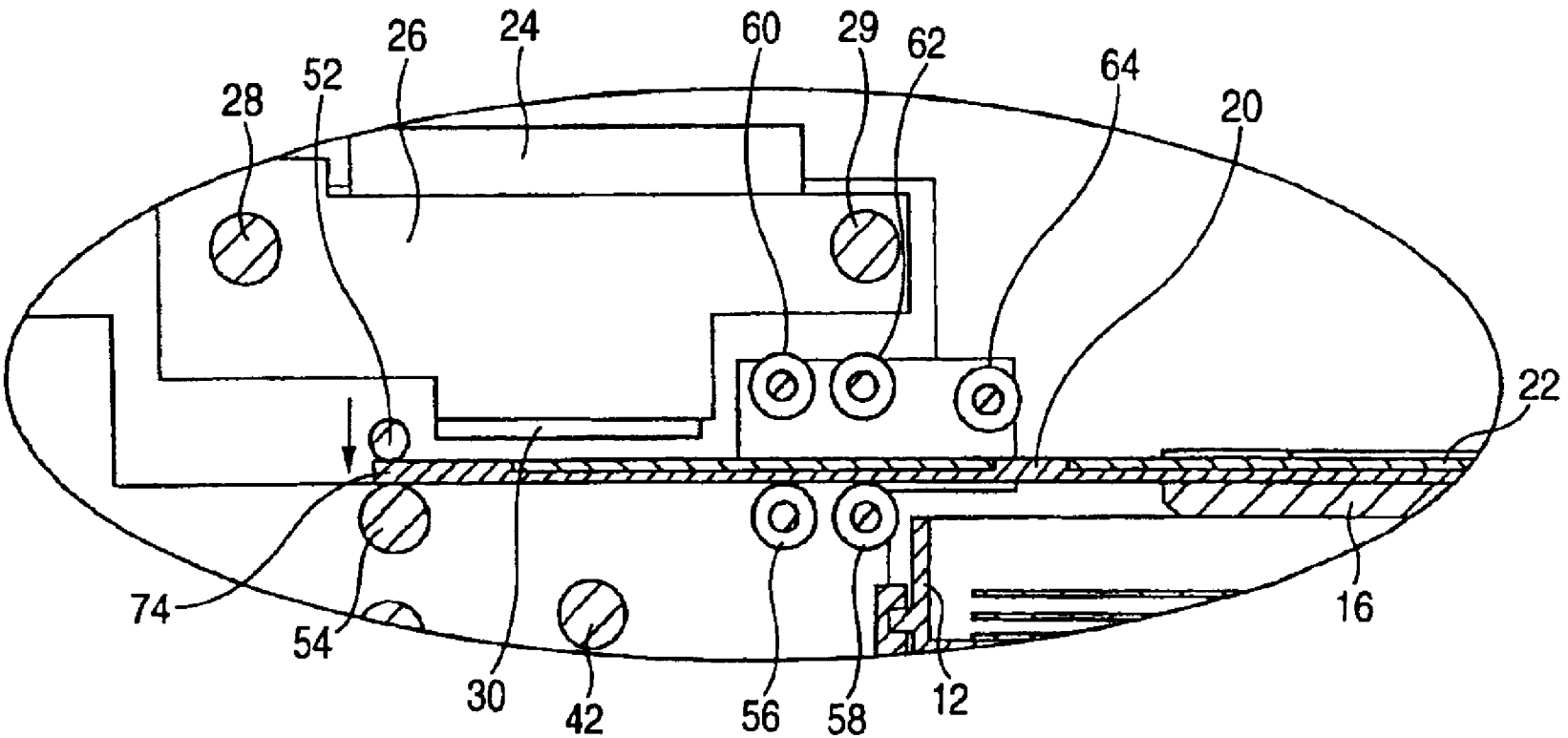
FIG. 51 is an enlarged, conceptual diagram showing a key portion of the pinch-roller distance changing mechanism when the pinch roller descends in FIG. 50.

Thereafter, the disc tray 20 is transported toward the recording head 30, and if it is judged that the leading end 74 of the disc tray 20 passed under the pinch roller 52 as shown in FIG. 50, the pinch roller 52 descends as shown in FIG. 51, and it continues the transportation of the disc tray 20.

Figure 52:
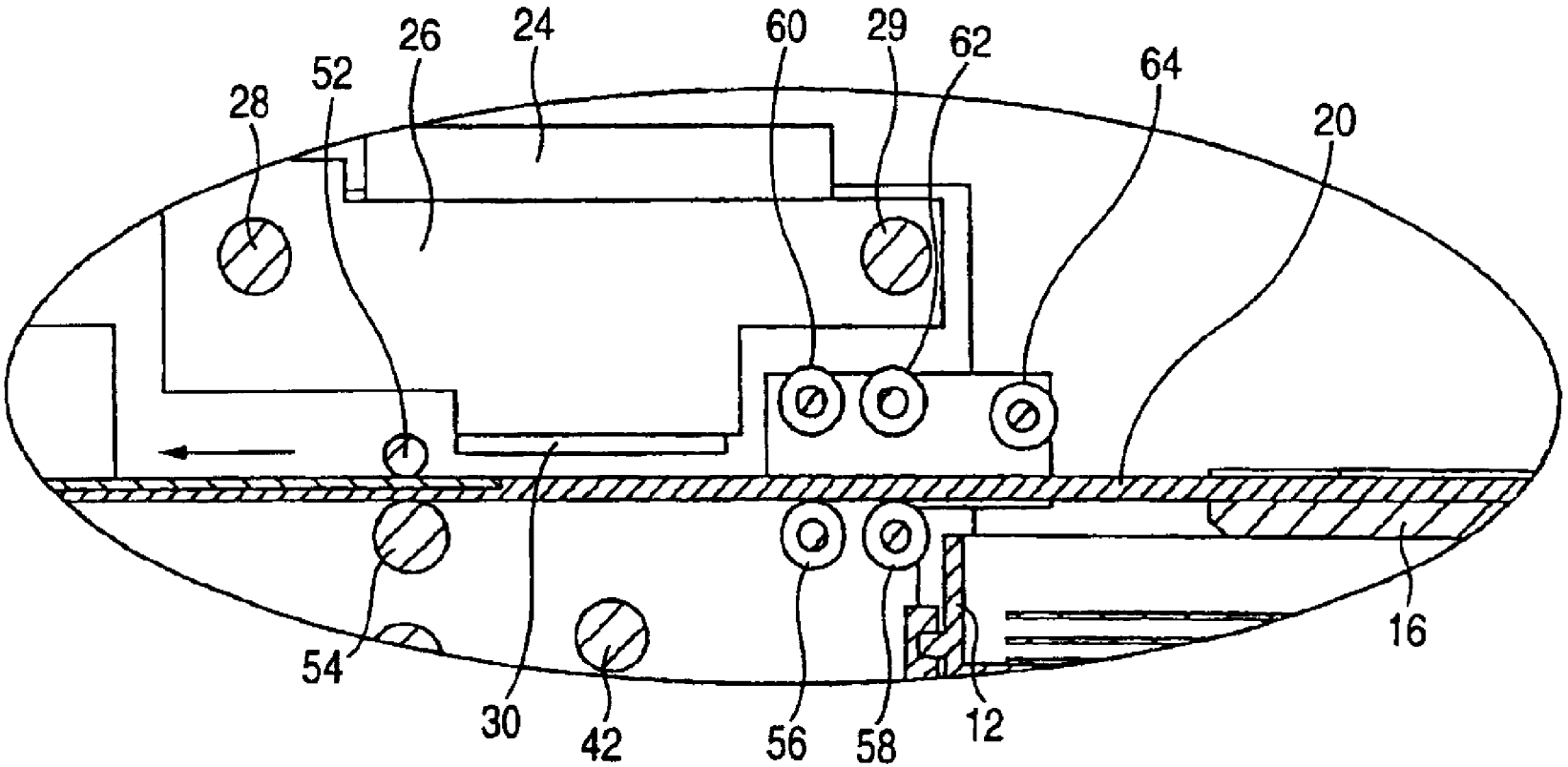
FIG. 52 is an enlarged, conceptual diagram showing a key portion of the pinch-roller distance changing mechanism when the discharge tray is transported to the print start position in FIG. 51.
Figure 53:
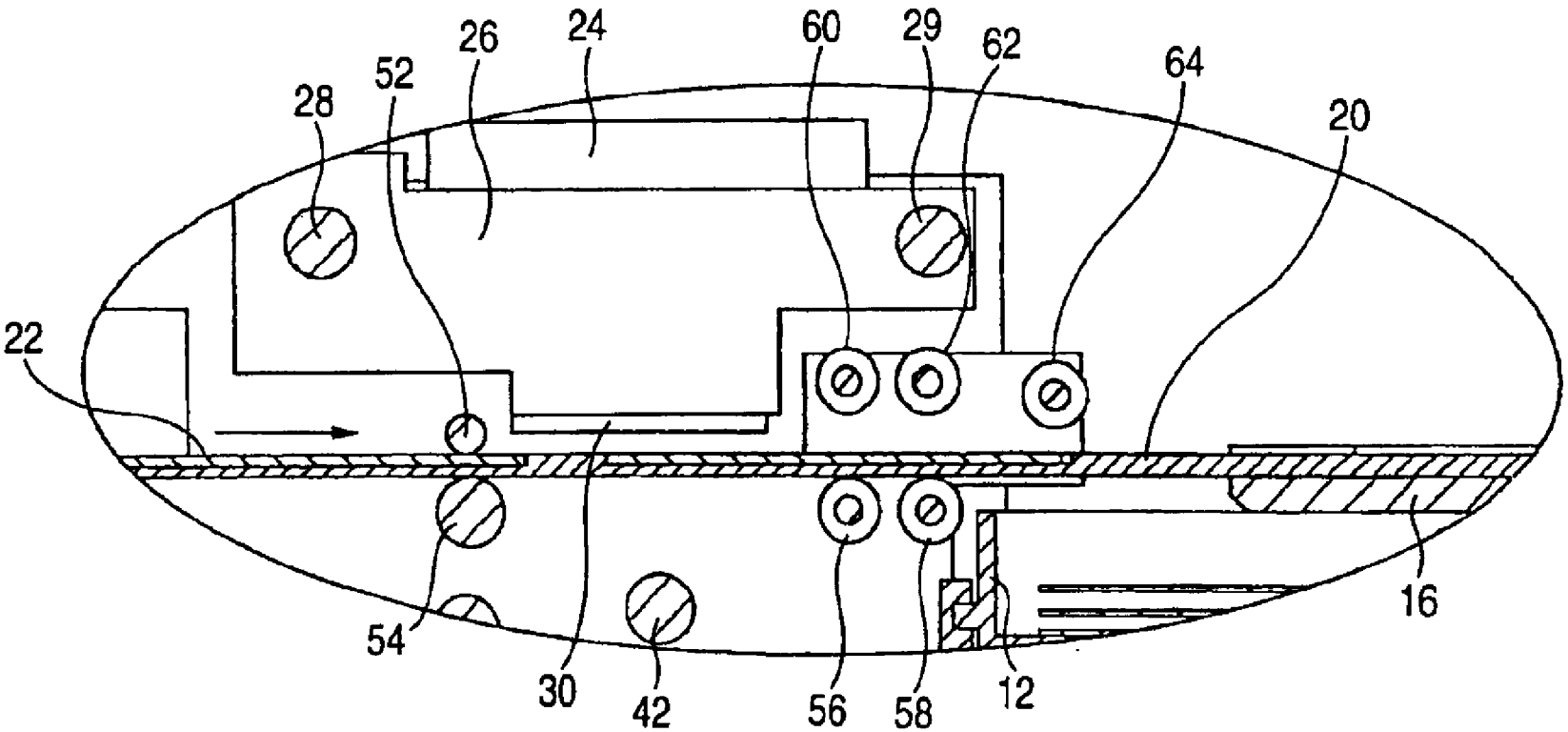
FIG. 53 is an enlarged, conceptual diagram showing a key portion of the pinch-roller distance changing mechanism during the printing on the disc in FIG. 52.

Thereafter, the disc tray 20 moves to the print start position shown in FIGS. 37, 38 and 52, and then an operation of printing on the DVD disc 22 starts (FIG. 53). When the operation of printing on the disc ends, the disc tray 20 is transported to the print end position shown in FIGS. 39 and 40.

Figure 54:
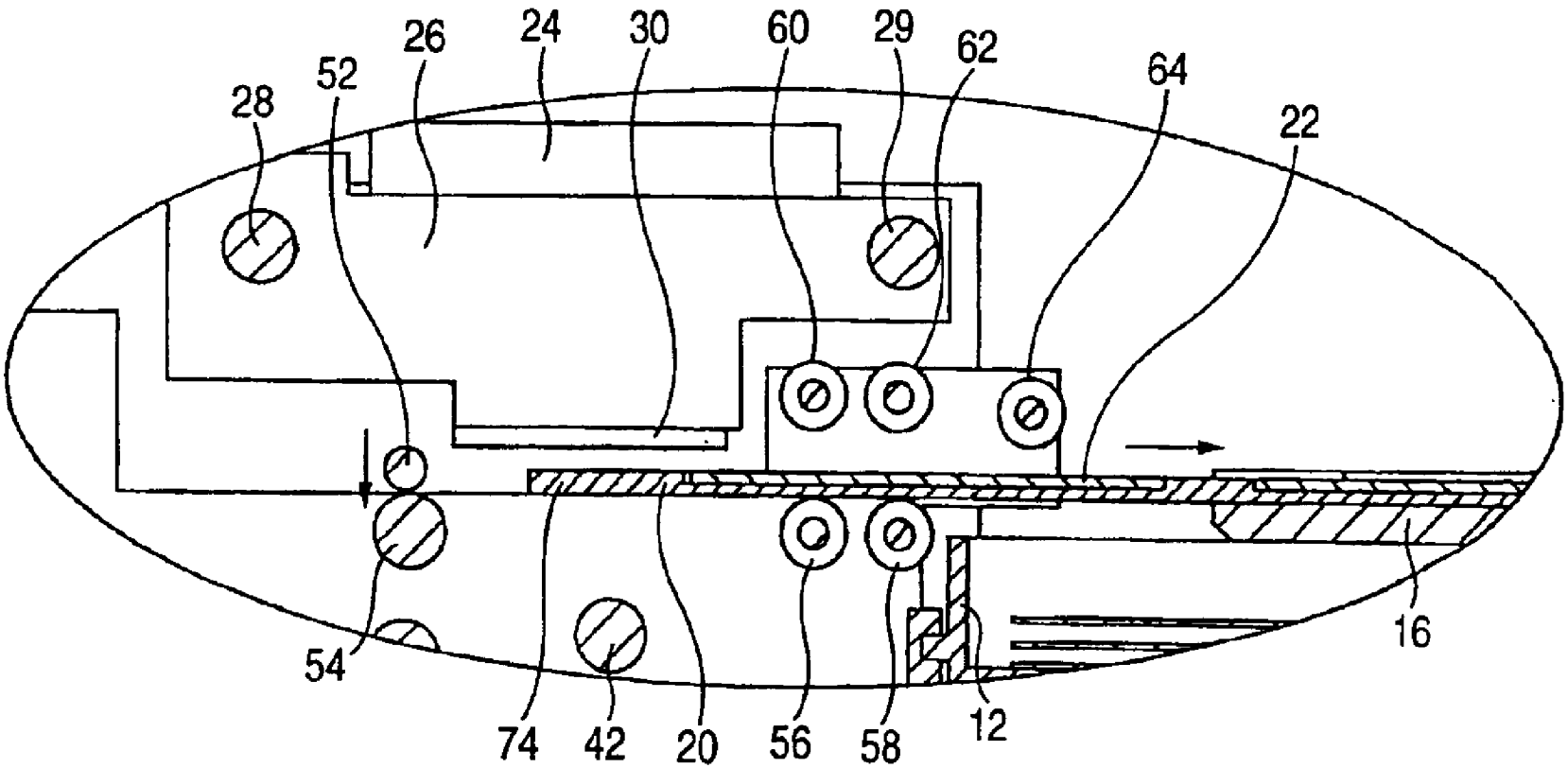
FIG. 54 is an enlarged, conceptual diagram showing a key portion of the pinch-roller distance changing mechanism when the operation of printing on the disc is completed in FIG. 53.

At this time, after the leading end 74 of the disc tray 20 passed under the pinch roller 52, the pinch roller 52 automatically descends to a position shown in FIG. 54

Thereafter, the disc tray 20 is transported, by the motor 36, to the print ready position, and is ready for printing at the print ready position, and the recording head 30 and the free gears 60, 62 and 64 are returned to a position when printing is made on the recording sheet in the sheet feed cassette 40, viz., the normal sheet printing position shown in FIGS. 32 and 47.

If in this print ready state, the operator turns on the discharge tray open switch 17, then the discharge tray 12 is ejected to the discharge-tray open position shown in FIGS. 27 and 33A.

Then, the operator draws out the discharge tray 12 to the discharge-tray maximum drawn-out position, takes out the printed disc 22 on the disc tray 20, and then pushes the discharge tray 12 completely into the ink jet recording device.

Thereafter, the disc tray stands by again at the print ready position shown in FIGS. 31 and 32.

Figure 55:
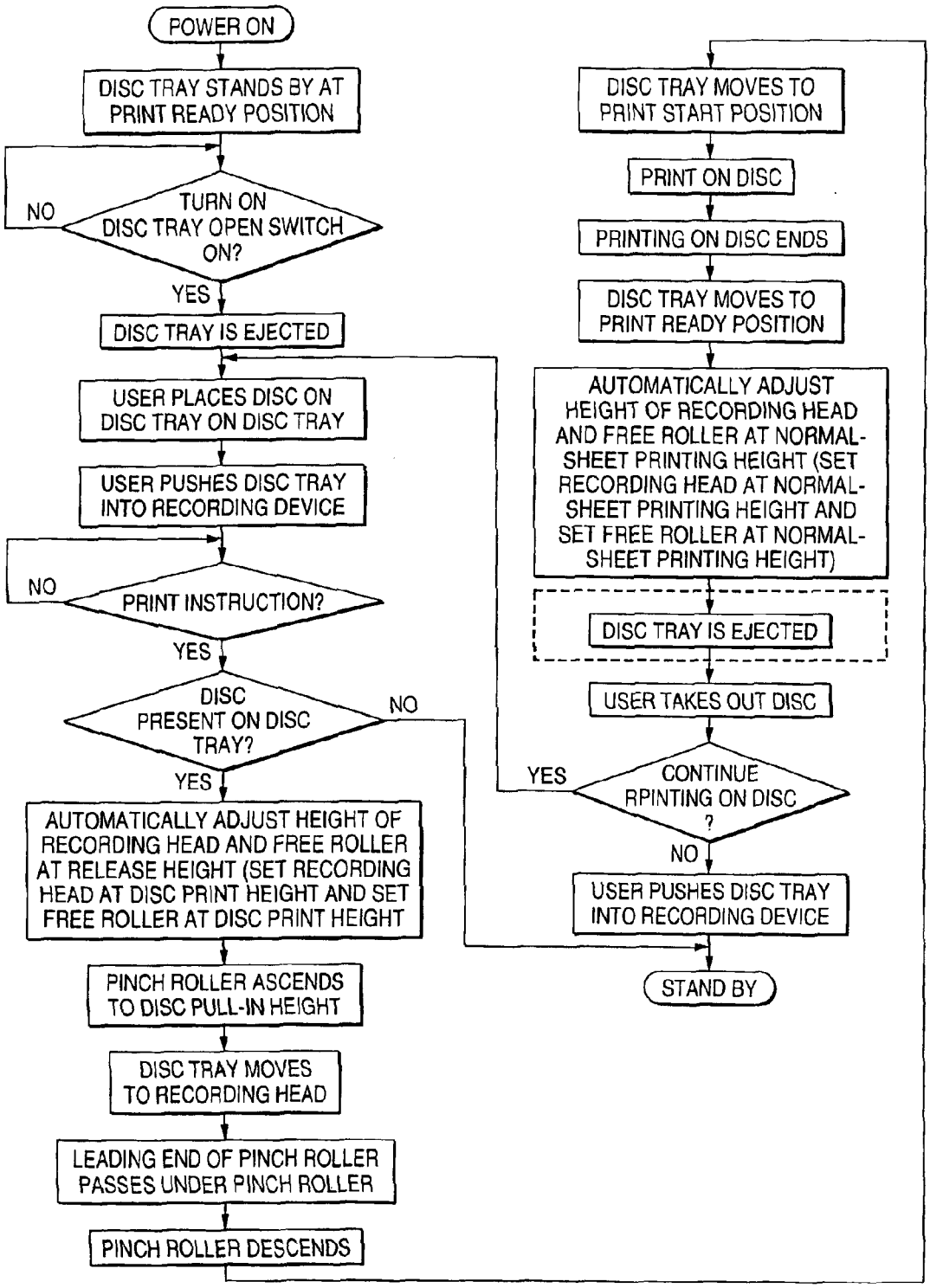
FIG. 55 is a flow chart for explaining operations of a first modification of the second embodiment of the invention.

Modifications of the present embodiment are shown in FIGS. 55 an 56.

A difference of the modification shown in FIG. 55 from the second embodiment mentioned above resides in that after the printing on the disc 22 is completed and the disc tray 20 is moved to the print ready position, the discharge tray 12 is automatically ejected to the discharge-tray open position even if the operator does not turn on the discharge tray open switch 17.

Figure 56:
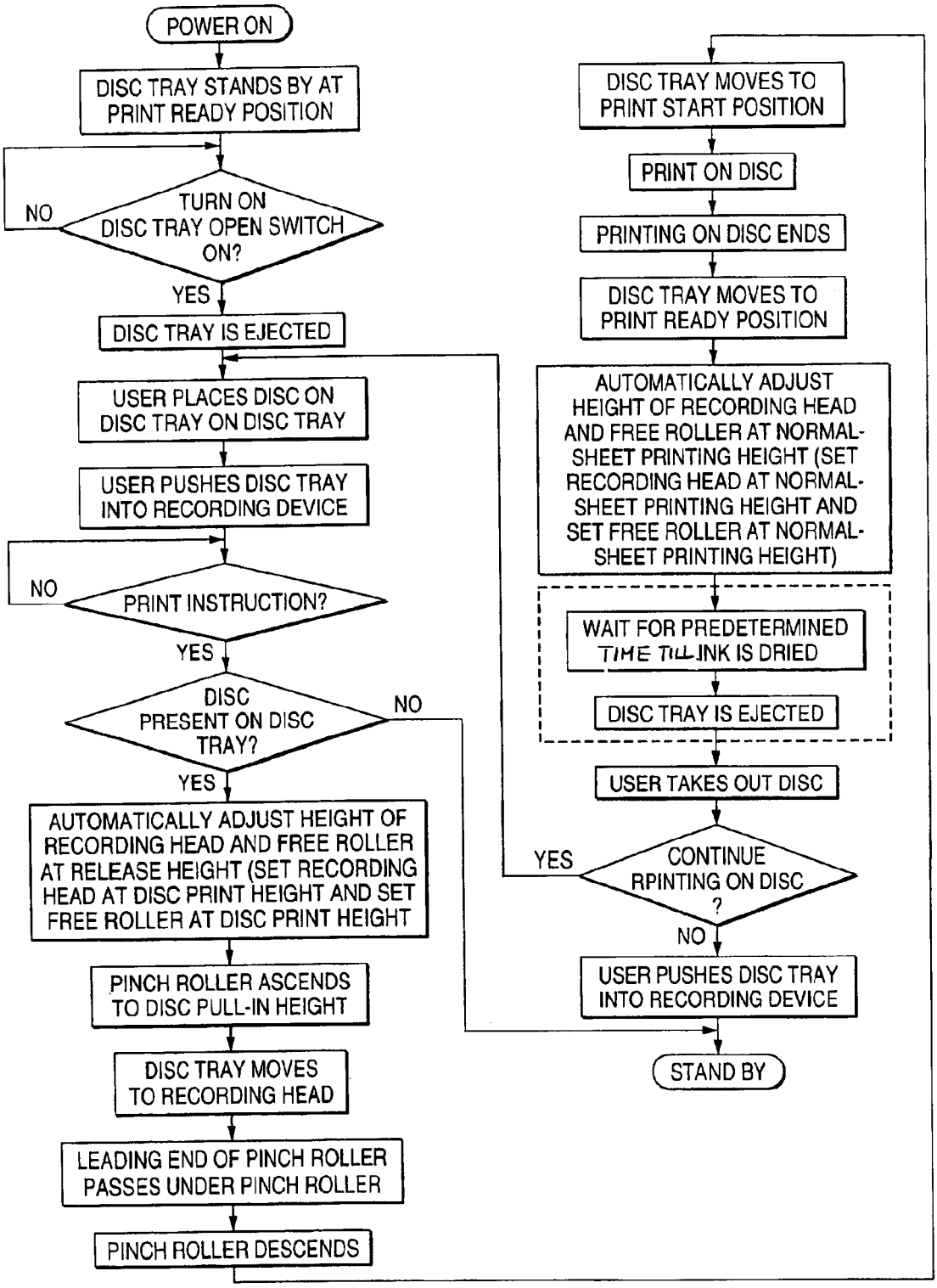
FIG. 56 is a flow chart for explaining operations of a second modification of the second embodiment of the invention.

A difference of another modification shown in FIG. 56 from the second embodiment mentioned above resides in that after the printing on the disc 22 is completed and the disc tray 20 is moved to the print ready position, the discharge tray 12 is automatically ejected to the discharge-tray open position after it stands by till a predetermined time (e.g., 10 seconds or longer) elapses to dry ink on the disc 22.

As described above, in the present embodiment, the disc tray 20 having the DVD disc 22 that was mounted thereon by the operator on the main operation panel, is accommodated into the ink jet recording device 10 in the main scan direction of the recording head 30, and transported in a direction orthogonal to the main scan direction, and then the printing on the disc is performed. Accordingly, the size of the ink jet recording device 10 as viewed in the direction orthogonal to the main scan direction, may be reduced, when comparing with the case where the DVD disc 22 is placed in the direction orthogonal to the main scan direction.

In other cases than the case where the operator inserts the DVD disc 22 into and draws it out of the ink jet recording device or takes out the discharging sheet therefrom, the disc tray 20 is accommodated in the ink jet recording device 10. Further, the operations, such as the insertion/drawing-out of the DVD disc 22, the taking-out of the discharging sheet, loading/unloading of the sheet feed cassette, may all be performed on the main operation panel. Therefore, the operator can execute the printing process by use of the ink jet recording device even in a state that the glass door 5 of a television rack or the like is left closed, and the ink jet recording device 10 may be accommodated compactly in, for example, a television rack in a home.

When the disc tray 20 is transported in the direction orthogonal to the main scan direction, a reliable transportation of the disc tray in a first direction which is orthogonal to the main scan direction is ensured since the first region where the disc tray is transported under driving of the motor 36 and the second region where the discharge tray is transported by the combination of the pinch roller 52 and the main roller 54 are provided.

When the first region where the disc tray is transported under driving of the motor 36 and the second region where the discharge tray is transported by the combination of the pinch roller 52 and the main roller 54 are disposed while partially overlapping with each other, the transportation of the discharge tray in the second region smoothly succeeds the transportation of the discharge tray in the first region.

In printing on a recording sheet as a second recording medium, a given image is formed on the image-bearing recording sheet by ink ejected from the recording head 30, and then the recording sheet passes between the discharge rollers 56 and 58 and the free gears 60, 62 and 64, and is discharged into the discharge tray 12. The discharge tray 12 is disposed between the tray guide 16 and the sheet feed cassette 40, while being parallel to the latter. Therefore, the ink jet recording device 10 is reduced in size.

It is most preferable that the discharge tray 12 is disposed between the tray guide 16 and the sheet feed cassette 40. If required, it maybe disposed under the sheet feed cassette or above the tray guide 16.

By adjusting a height of the pinch roller 52 by use of the pinch-roller distance changing mechanism shown in FIGS. 43 to 45, a part of the transporting system of the disc tray 20 and a part of the transporting system of the recording sheet 41, viz., the pinch roller 52 and the main roller 54, may be used in common. Accordingly, the size of the whole device is reduced. As a result, the ink jet recording device 10 may be accommodated compactly in, for example, a television rack in a home.

The height of the pinch roller 52 may be set in advance in accordance with a thickness of an object under printing. In an alternative, a thickness of the object under printing is detected by a sensor (not shown), and a height of the pinch roller 52 is automatically adjusted in accordance with the thickness detected.

Linking with the selection of the height of the pinch roller 52 by the pinch-roller distance changing mechanism shown in FIGS. 43 through 45, the height of the recording head 30 and the free gears 60, 62 and 64 is also adjusted. Therefore, there is no need of providing individual drive mechanisms, and hence, device size reduction is realized.

The DVD disc 22 is exemplarily presented as the first recording medium in the second embodiment described above. However, the first recording medium may be any other recording medium if it is smaller than the ink jet recording device, and may be placed on the disc tray 20 having a predetermined configuration. Examples of the first recording media are an optical recording medium, e.g., CD, a magnetic recording medium, e.g., a flexible disc, an electronic recording medium, e.g., an IC card or a semiconductor memory, a plastic card, e.g., a credit card or a cash card, a resin solid material, e.g., a name card case, and a metal solid material, e.g., an aluminum plate.

The tray guide 16 as the guide part is formed on the discharge tray 12. When the disc tray 20 is moved in a second direction parallel to the main scan direction, the disc tray 20 is held and fixed to the tray guide 16. When the disc tray 20 is moved in the first direction orthogonal to the main scan direction, the tray guide 16 is prohibited from moving, but only the disc tray 20 is permitted to move. Accordingly, for the movement of the DVD disc 22 in the first direction, only the disc tray 20 is transported, and for the movement of the DVD disc 22 in the second direction, only the tray guide 16 is driven. Thus, the disc tray 20 may be moved in two different directions (perpendicular to each other) and compactly. Further, the ink jet recording device may be operated from the front side of the rack.

<Third Embodiment>

An ink jet recording device 100 which is a third embodiment of the invention will be described with reference to FIGS. 57 through 73.

Throughout the drawings, in the descriptions of the second and subsequent embodiments of the invention, like or equivalent portions will be designated by like reference numerals, for simplicity.

Figure 57:
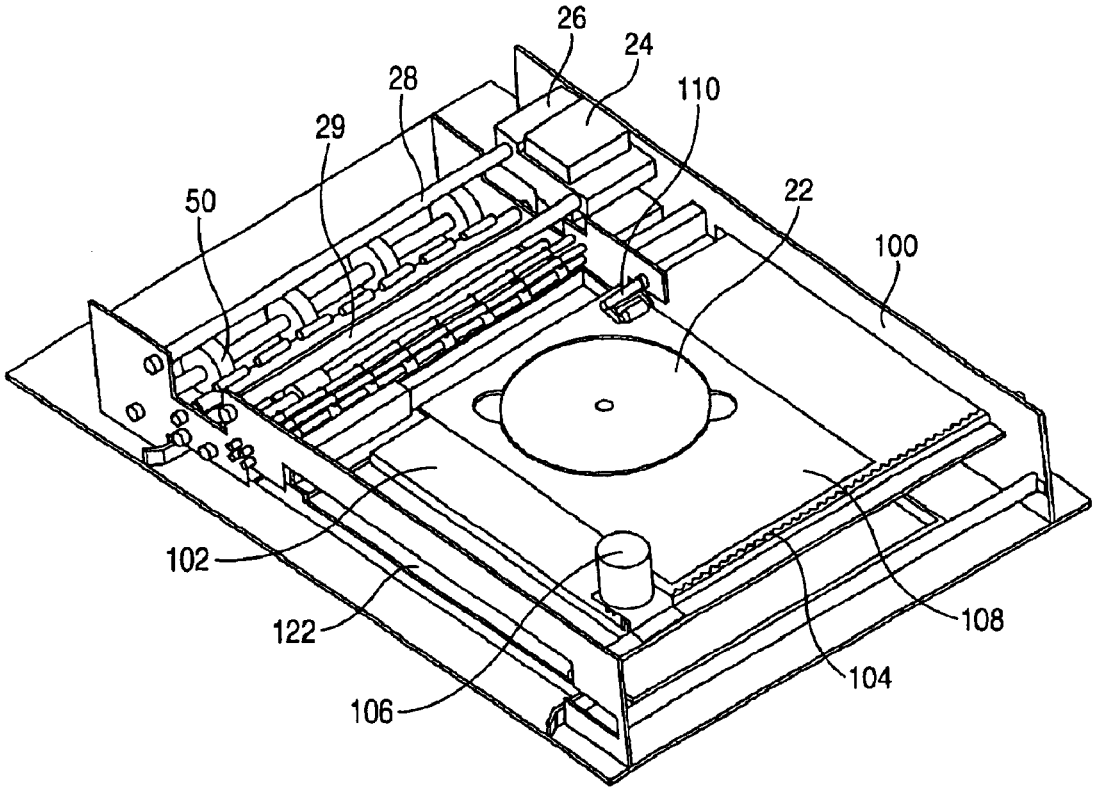
FIG. 57 is a perspective view showing a key portion of the innards of the ink jet recording device at the print ready position in the third embodiment of the invention.

FIG. 57 is a perspective view showing a key portion of the innards of the ink jet recording device in the third embodiment of the invention. The third embodiment is greatly different from the second embodiment in the following points. The tray guide 102 is not integral with a discharge tray 120, but is supported on a tray guide holder 122. A tray guide 102 is driven to move in directions parallel to the carriage shafts 28 and 29 by a combination of a pinion 107 provided on a motor 106 and a rack 104 provided on the tray guide 102. A transportation of a disc tray 108 in a direction orthogonal to the carriage shafts 28 and 29 in a first region is performed by use of an auxiliary roller 112 coupled to a tray transporting roller 116 and a roller shaft 110 containing a spring mechanism therein.

Other points are substantially the same as those in the second embodiment.

Operations of the ink jet recording device 100 of the third embodiment shown in FIGS. 57 through 73 will be described with reference to FIG. 73.

Figure 73:
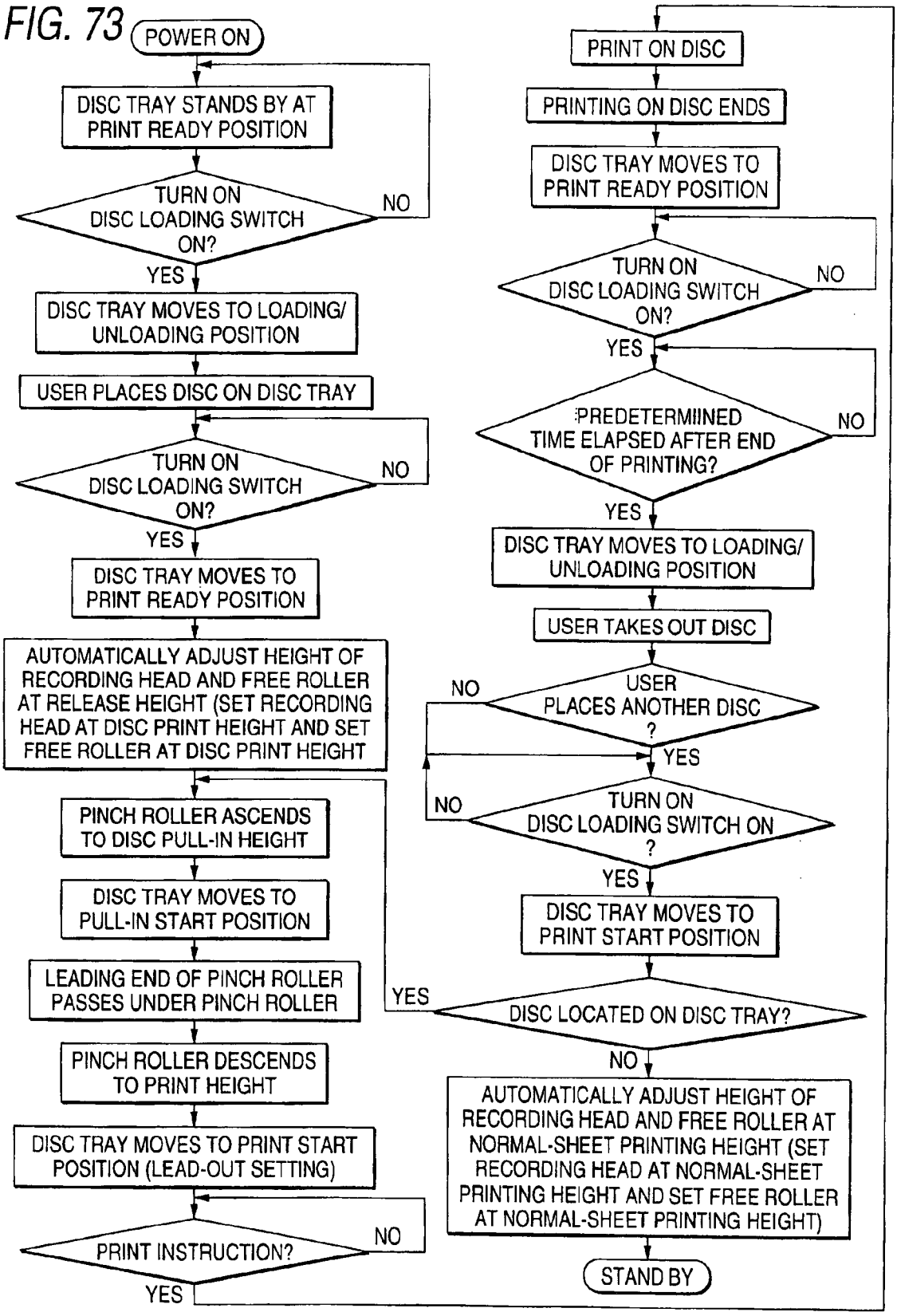
FIG. 73 is a flow chart showing operations of the ink jet recording device in the third embodiment of the invention.

As shown in FIG. 73, an operator first turns on a power switch. Then, the tray guide 102 with the disc tray 108 put thereon is placed to a print ready state at a print ready position shown in FIGS. 59 to 61.

Figure 62:
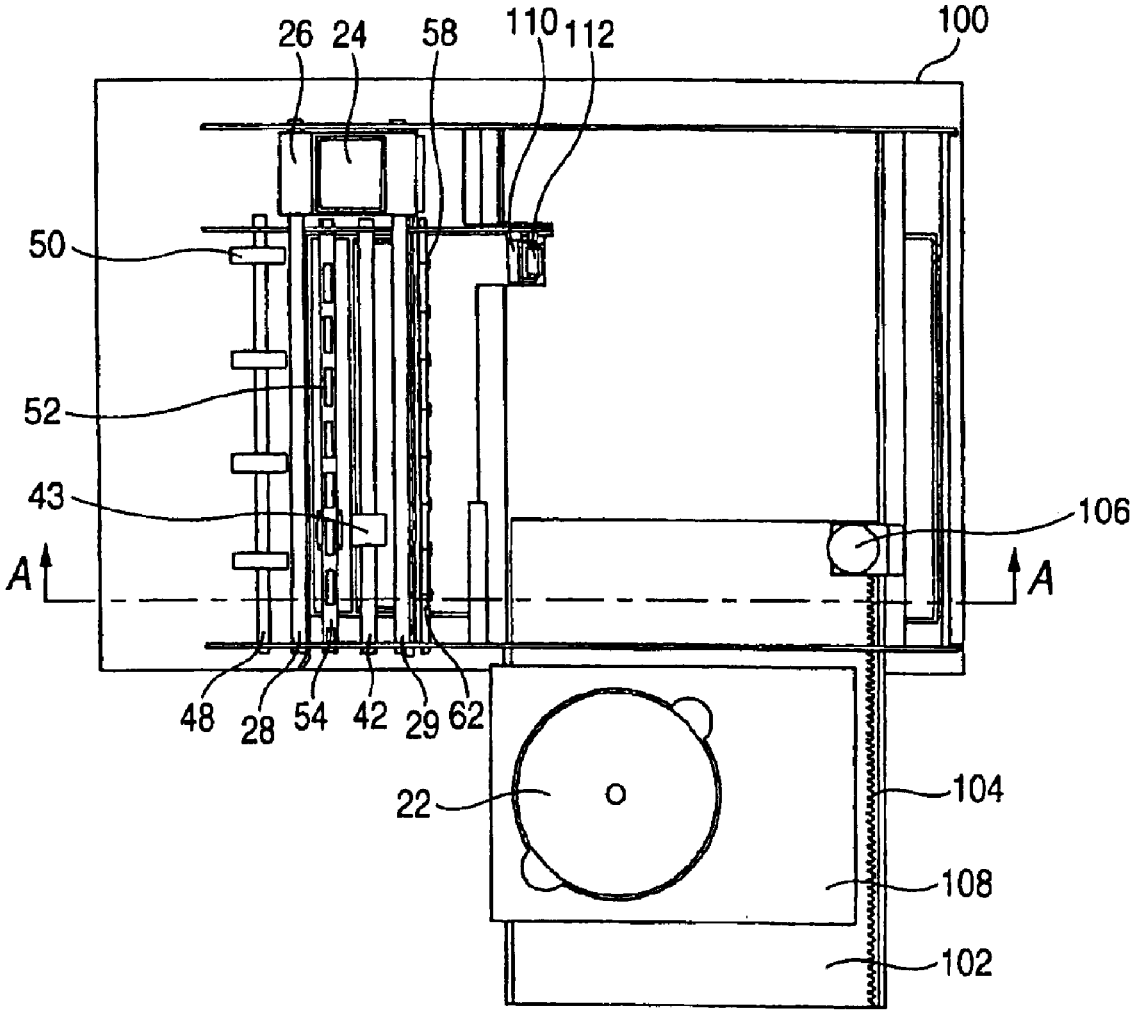
FIG. 62 is a top view showing the innards of the ink jet recording device at a disc loading/unloading position in the third embodiment of the invention.
Figure 63:
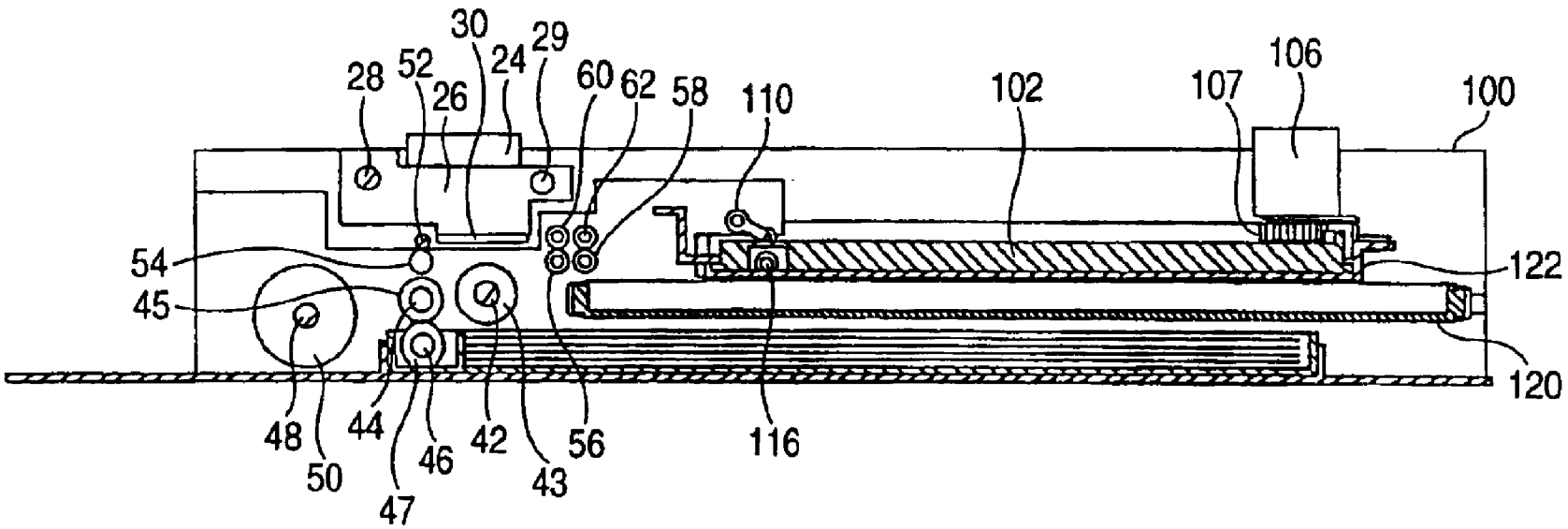
FIG. 63 is a cross sectional view taken on line A—A in FIG. 62.

When the operator turns on a disc loading switch (not shown), the motor 106 is driven to move the tray guide 102 to a disc loading/unloading position shown in FIGS. 62 and 63.

Then, the operator places the disc 22 on the disc tray 108 on the tray guide 102, and turns on again the disc loading switch. In turn, the tray guide 102 moves to the print ready position.

Figure 58:
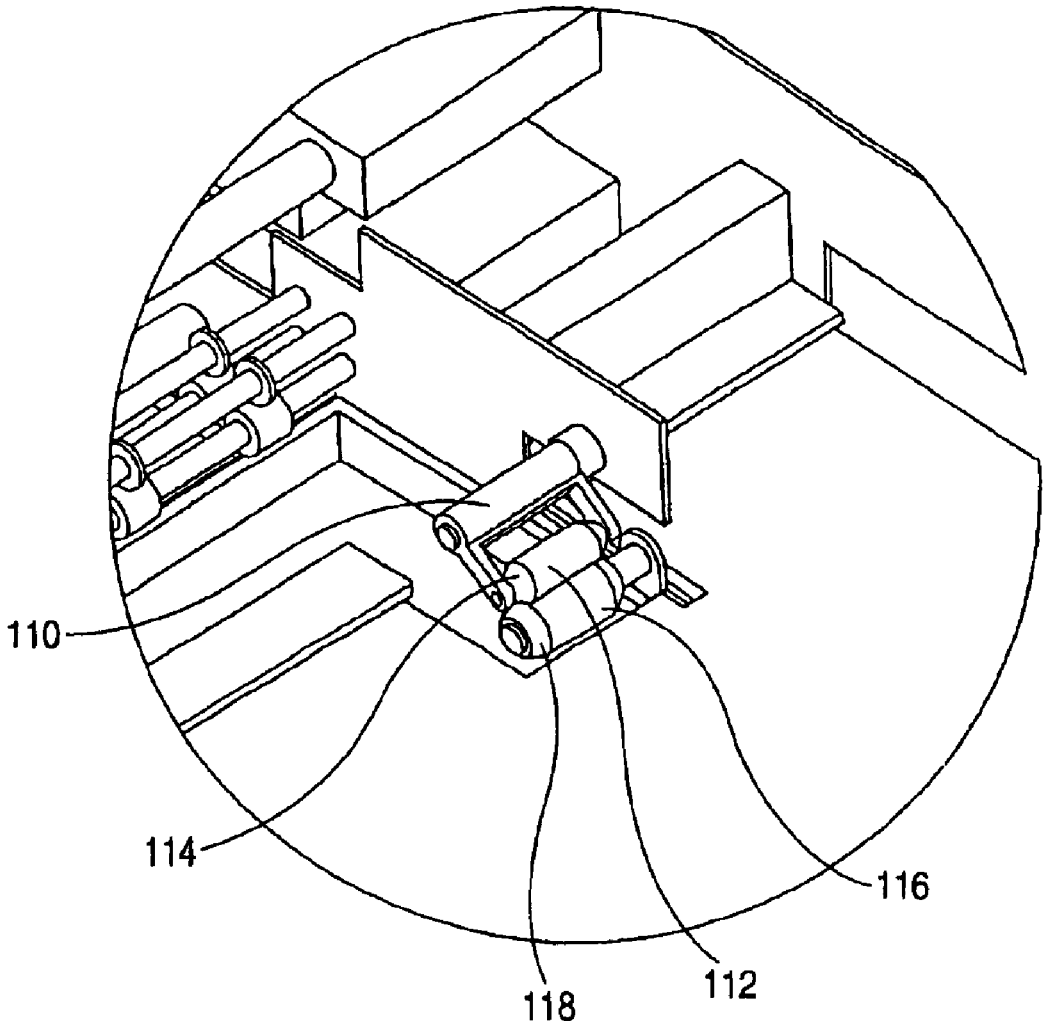
FIG. 58 is an enlarged, perspective view showing an auxiliary roller and a tray transporting roller in the third embodiment of the invention.

Tapered parts 114 and 118, as shown in FIG. 58, are formed on the auxiliary roller 112 and the tray transporting roller 116 driven by a motor (not shown). Accordingly, the disc tray 108 is smoothly disposed between the auxiliary roller 112 and the tray transporting roller 116.

And, the recording head 30 and the free rollers 60 and 62 ascend to the disc print position, and the pinch roller 52 also ascends to the disc tray pull-in position.

Figure 64:
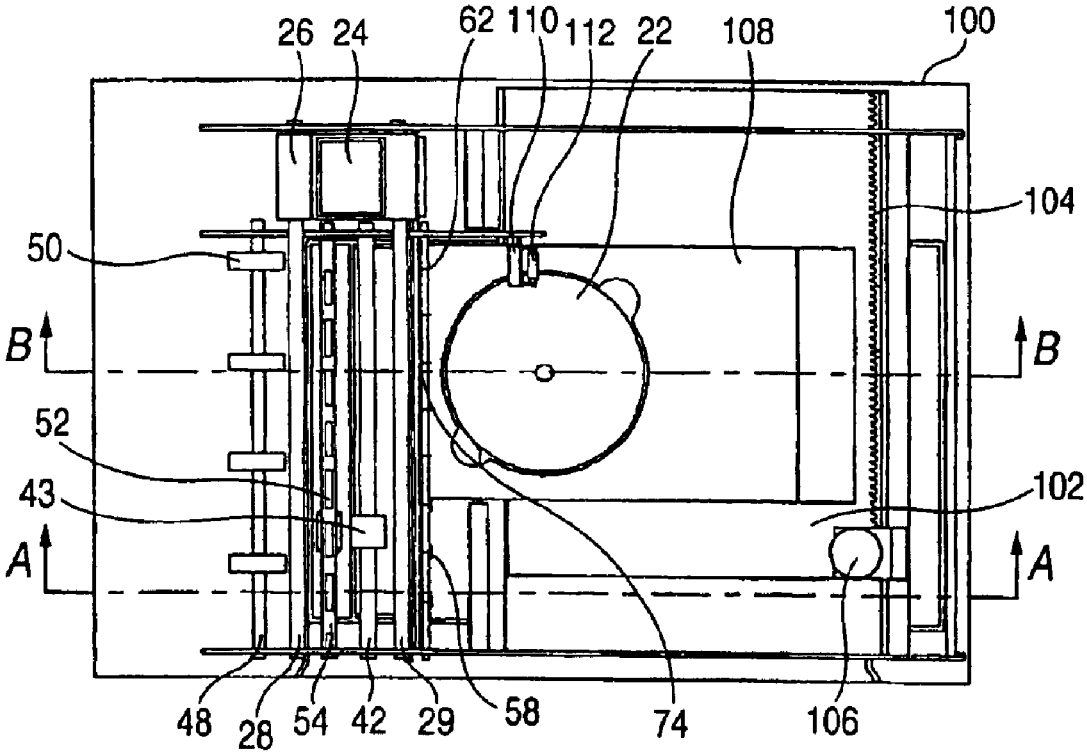
FIG. 64 is a top view showing the innards of the ink jet recording device at the disc pull-in start position in the third embodiment.
Figure 65:
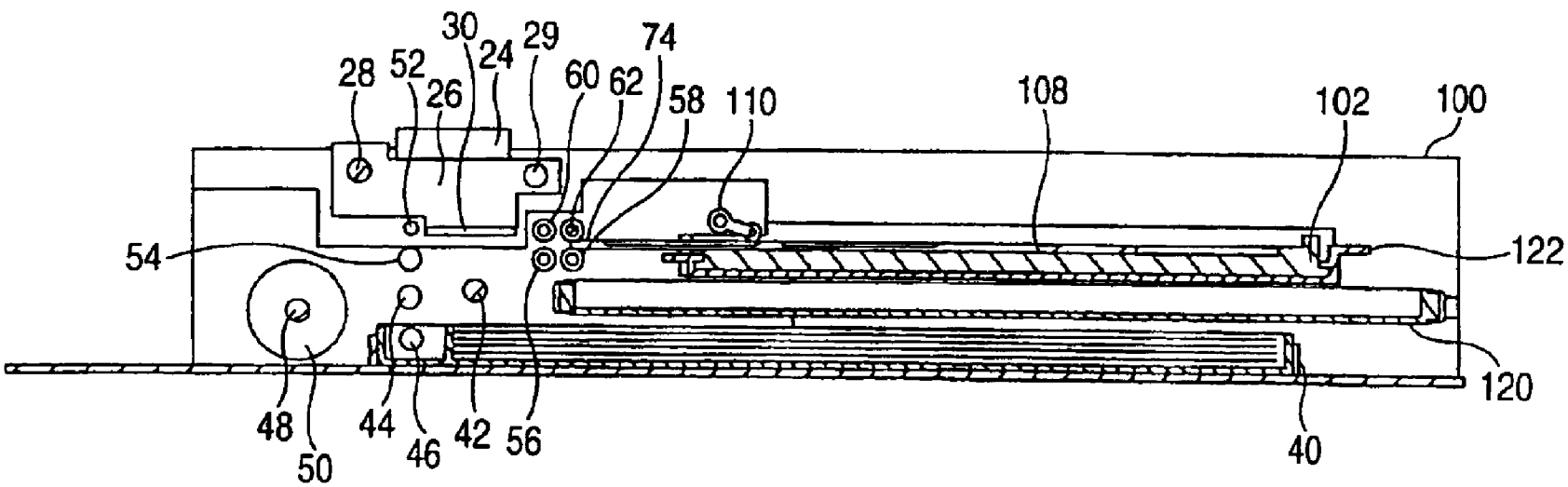
FIG. 65 is a cross sectional view taken on line B—B in FIG. 64.
Figure 66:
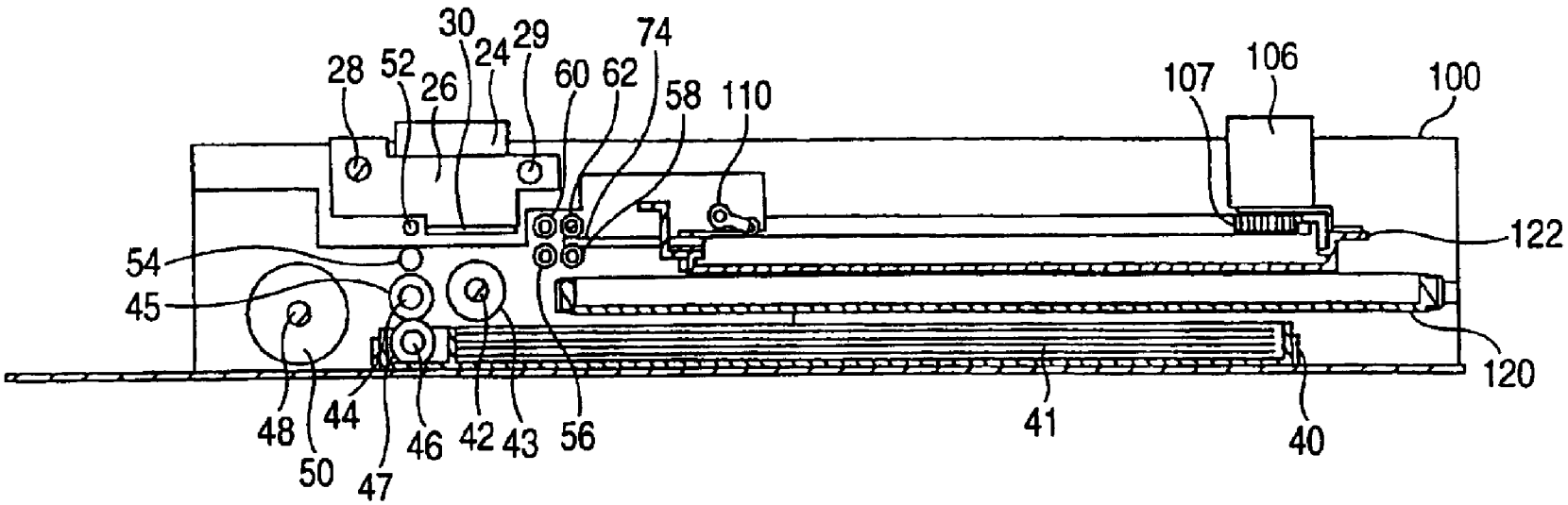
FIG. 66 is a cross sectional view taken on line A—A in FIG. 64.
Figure 67:
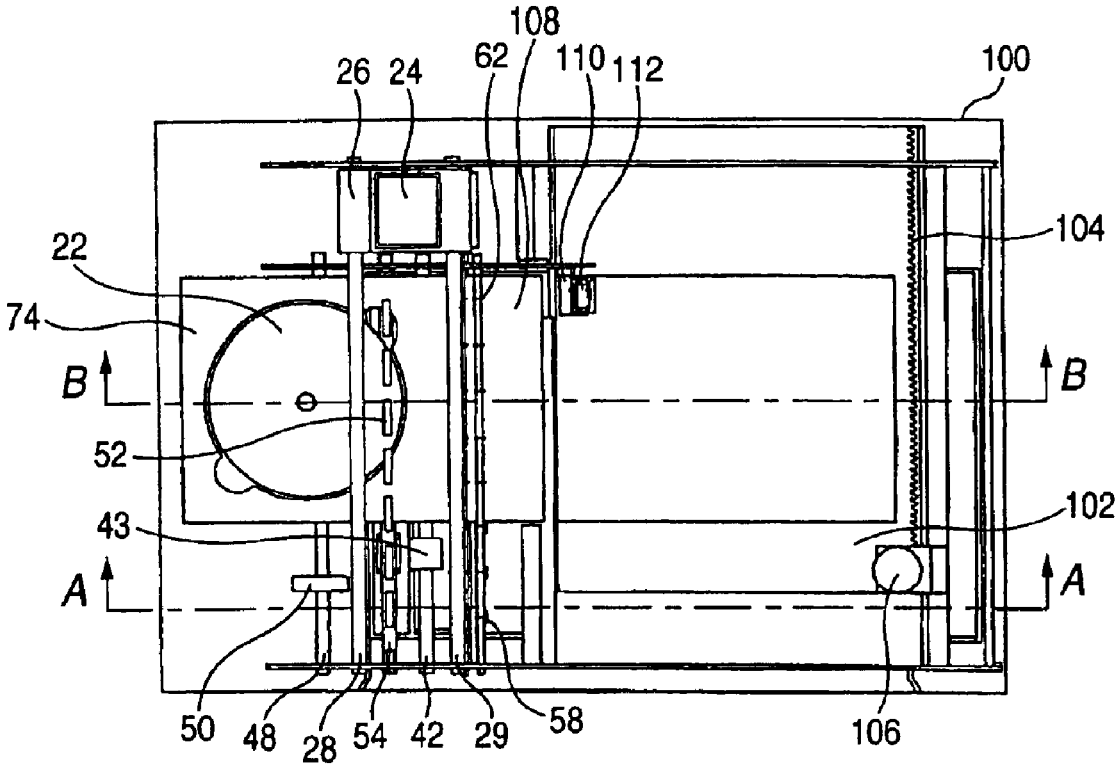
FIG. 67 is a top view showing the innards of the ink jet recording device at the print start position in the third embodiment.
Figure 68:
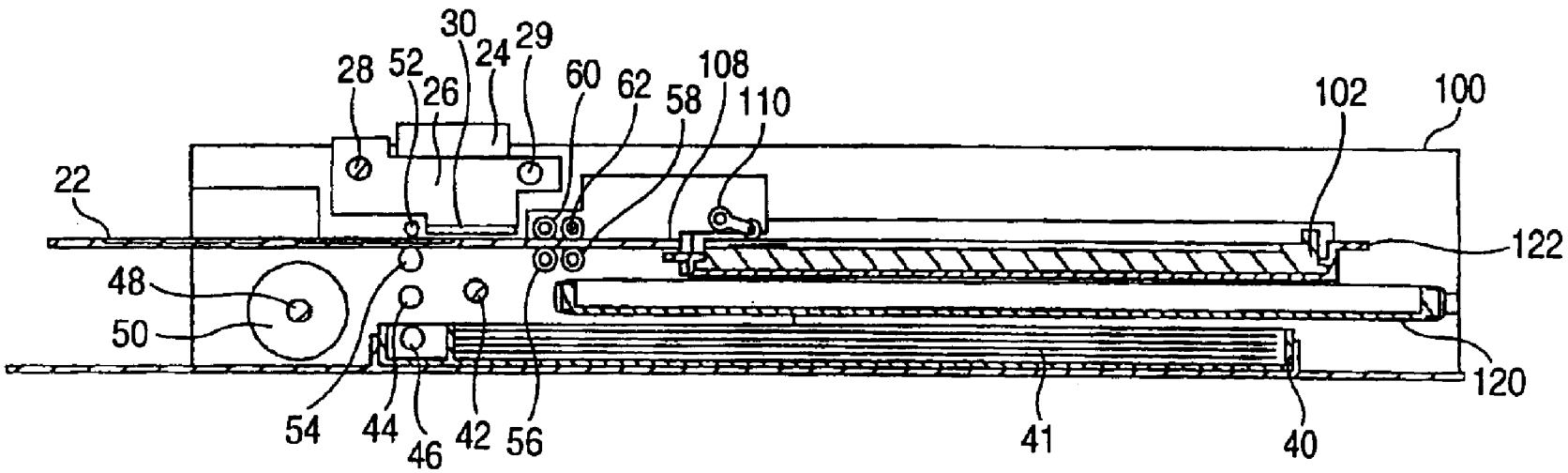
FIG. 68 is a cross sectional view taken on line B—B in FIG. 67.
Figure 69:
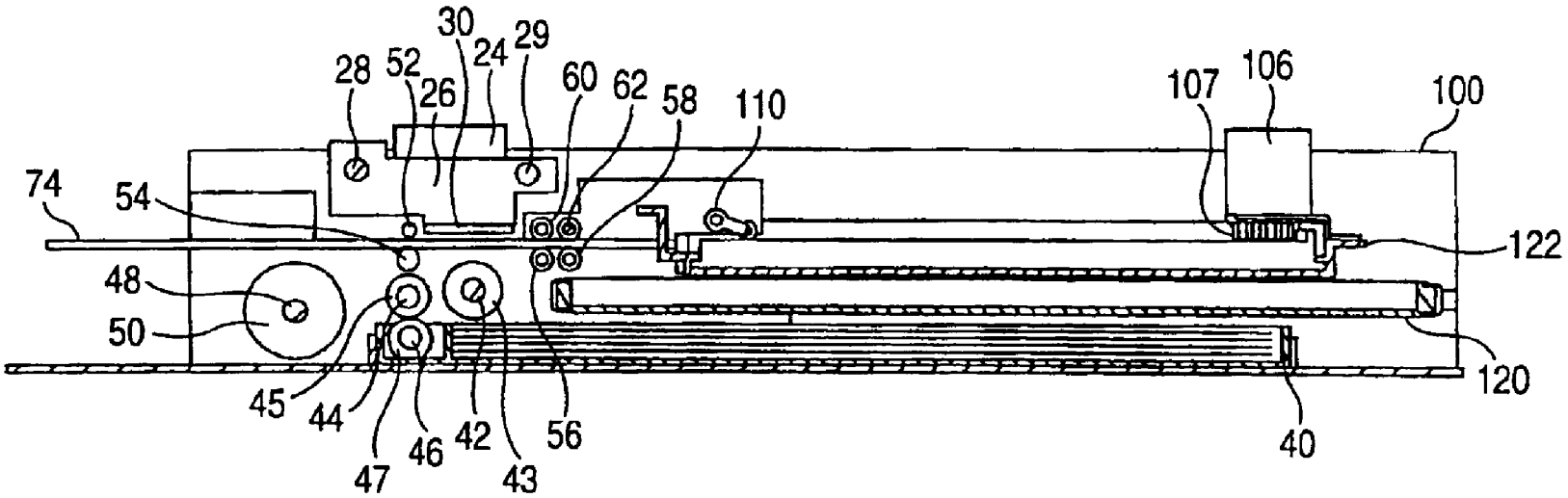
FIG. 69 is a cross sectional view taken on line A—A in FIG. 67

By a drive force of the tray transporting roller 116, the disc tray 108 is transported toward the recording head 30, and reaches a disc pull-in start position shown in FIGS. 64, 65 and 66.

When it is judged that the leading end 74 of the disc tray 20 passed under the pinch roller 52, the pinch roller 52 descends. Thereafter, the disc tray 108 moves to the print start position shown in FIGS. 67, 68 and 69, and then operation of printing on the disc 22 starts.

Figure 70:
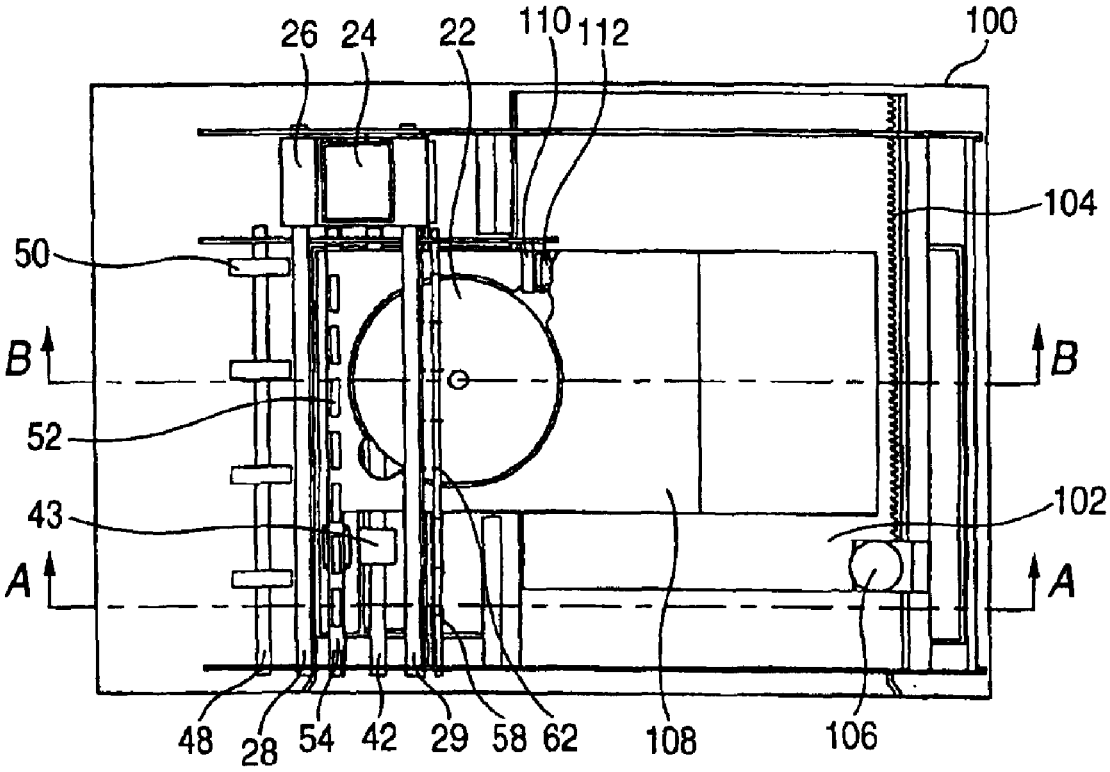
FIG. 70 is a top view showing the innards of the ink jet recording device at the print end position in the third embodiment.
Figure 71:
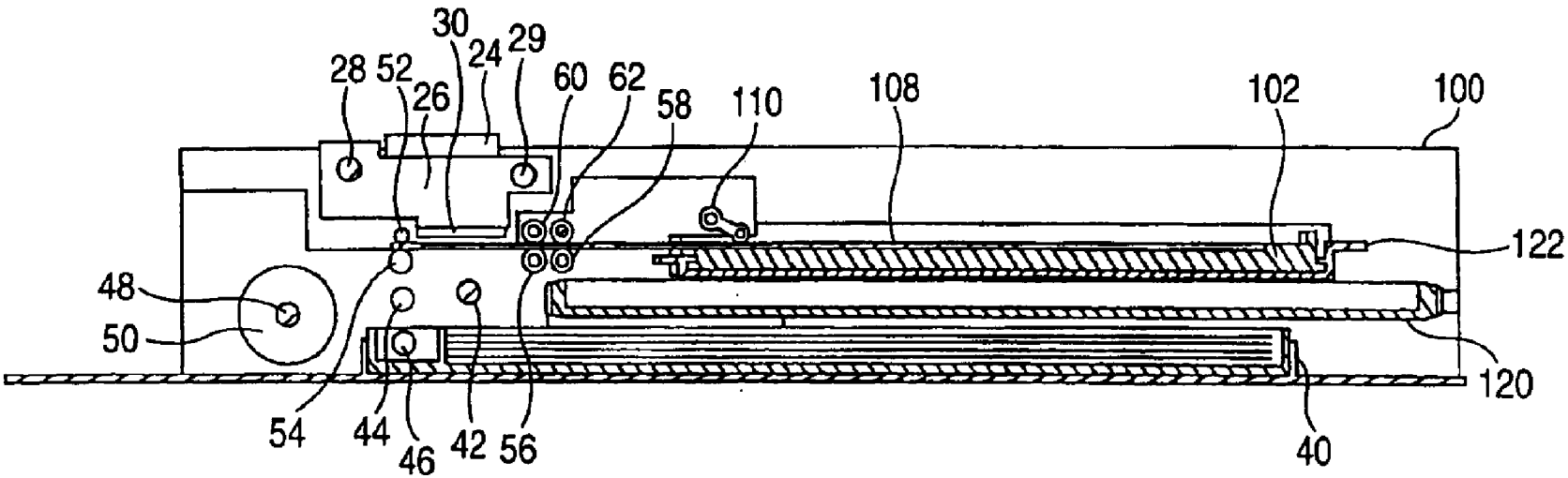
FIG. 71 is a cross sectional view taken on line B—B in FIG. 70.
Figure 72:
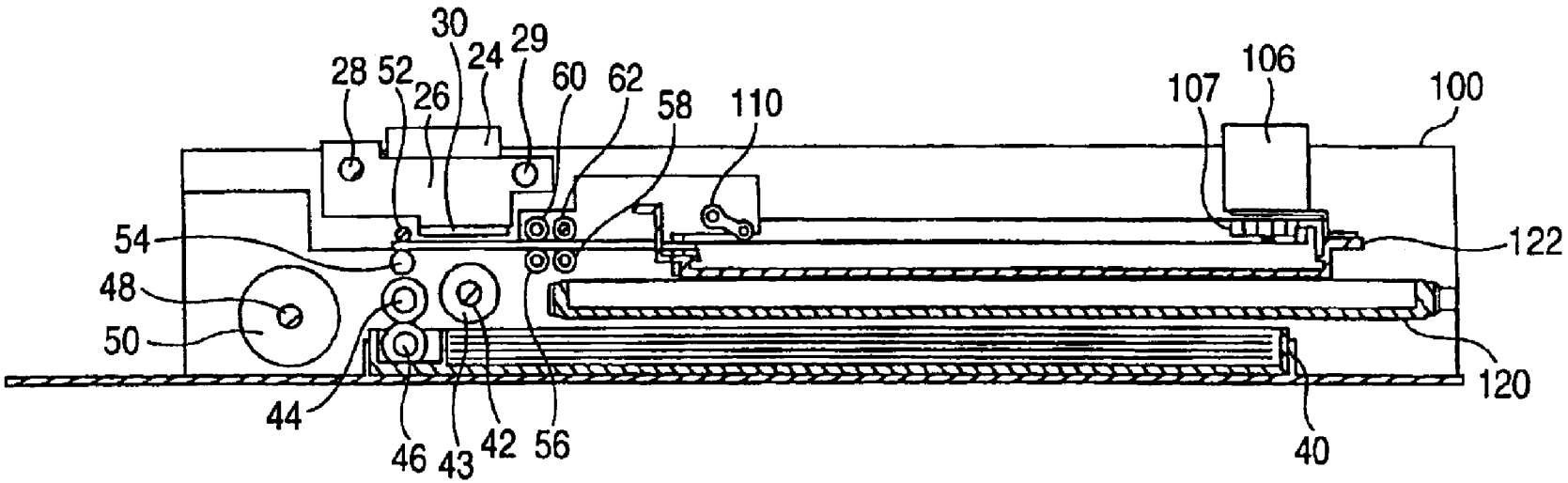
FIG. 72 is a cross sectional view taken on line A—A in FIG. 70.

When the operation of printing on the disc 22 ends, the disc tray 108 is transported to the print end position shown in FIGS. 70, 71, and 72.

Figure 59:
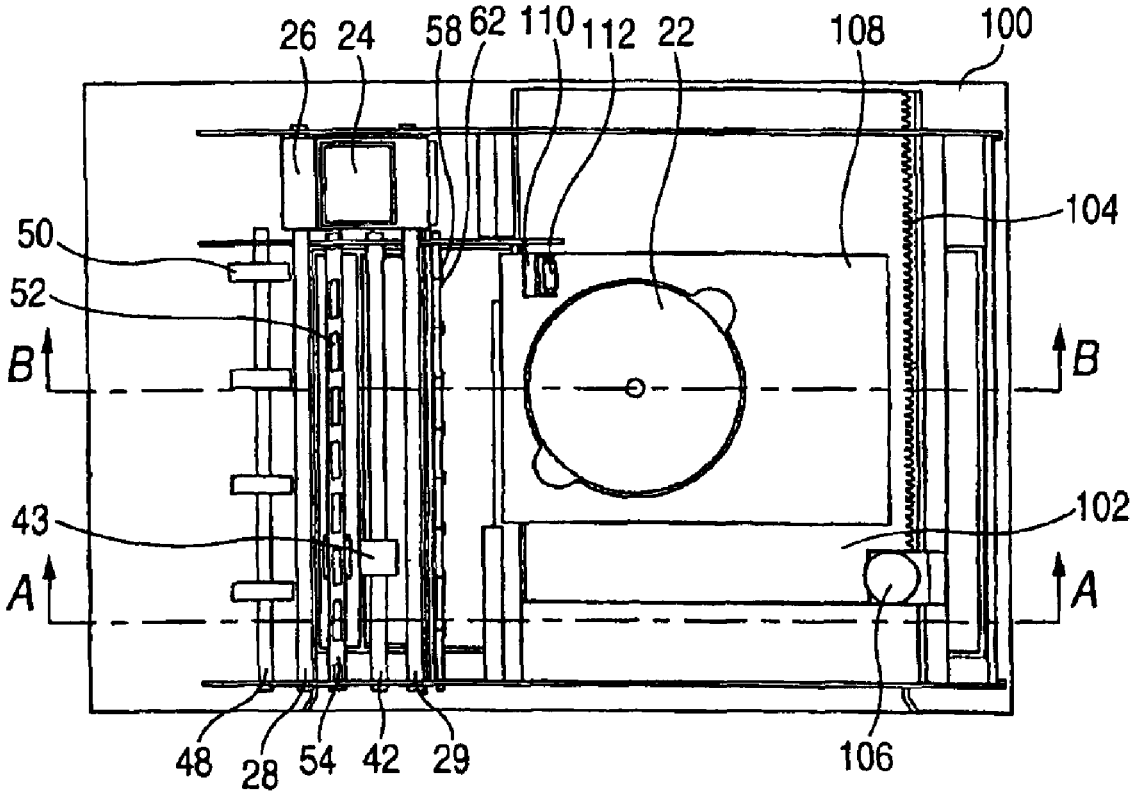
FIG. 59 is a top view showing the innards of the ink jet recording device at the print ready position in the third embodiment of the invention.
Figure 60:
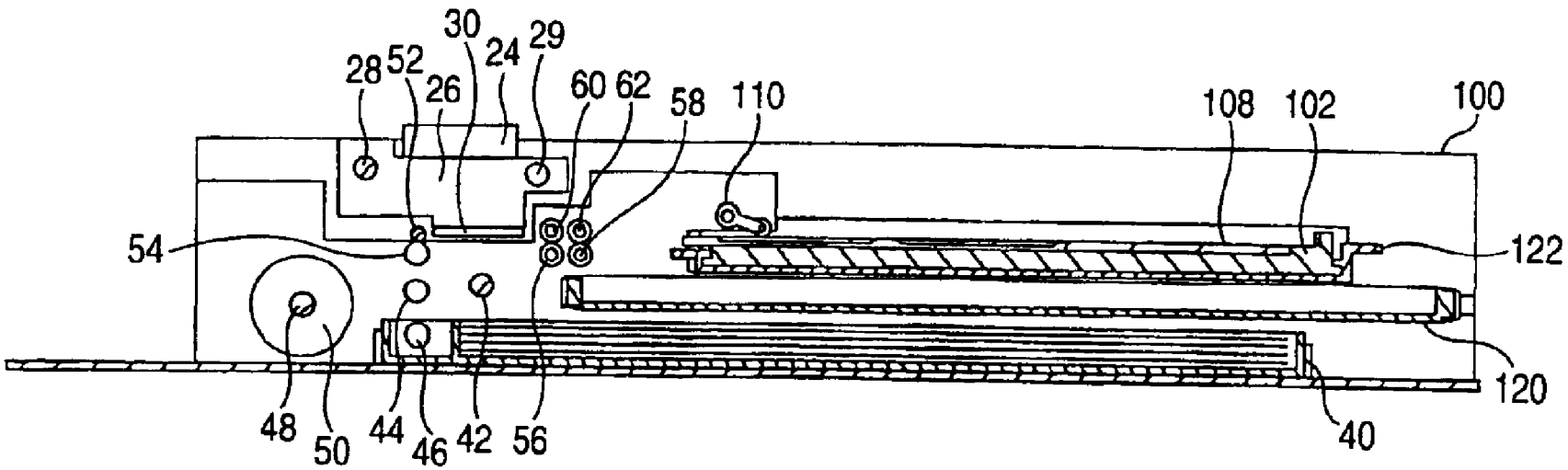
FIG. 60 is a cross sectional view taken on line B—B in FIG. 59.
Figure 61:
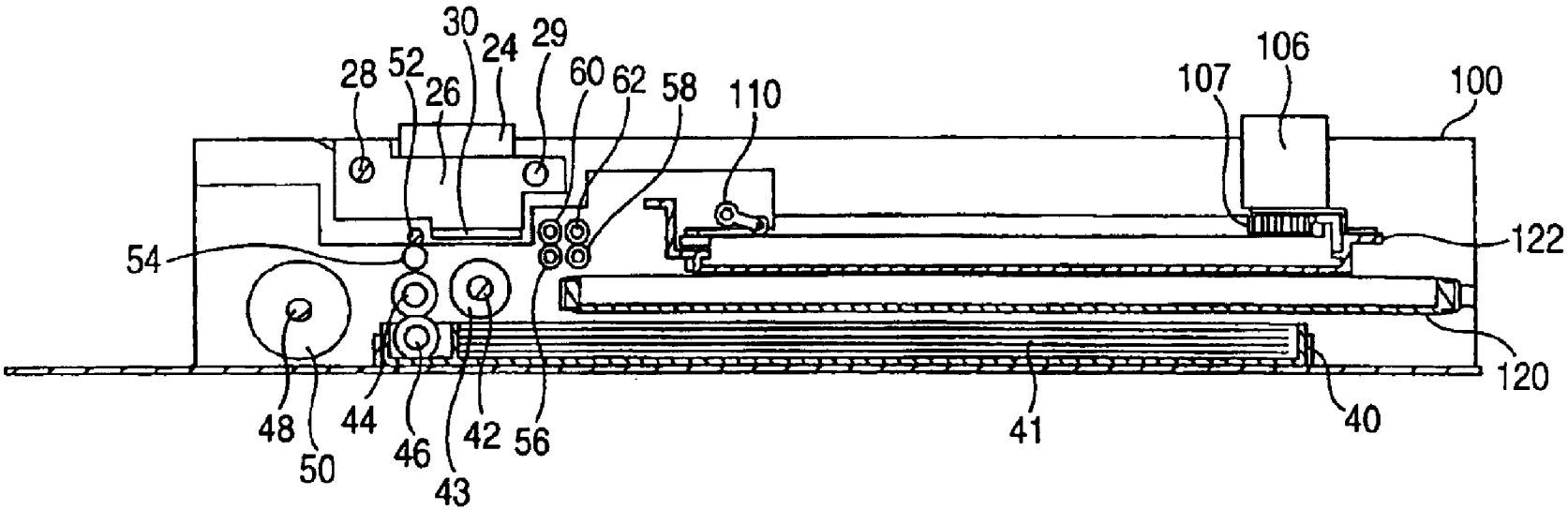
FIG. 61 is a cross sectional view taken on line A—A in FIG. 59.

Thereafter, the disc tray 108 is transported to the print ready position shown in FIGS. 59, 60 and 61, and put to a print ready state.

When it is judged that in this state, the operator turned on the disc loading switch, a computer (not shown) contained in the ink jet recording device 100 judges whether or not a predetermined time (e.g., 10 seconds) has elapsed after the operation of printing on the disc 22 ends. If the predetermined time has not elapsed, the disc tray is held in the print ready state at the print ready position. If the predetermined time has elapsed, the tray guide 102 having the disc tray 108 put thereon is moved to the disc loading/unloading position shown in FIGS. 62 and 63. And, the operator may take out the printed disc 22.

Thereafter, the operator turns on the disc loading switch to return the tray guide 102 to the print ready position. Then, a sensor (not shown) installed to the ink jet recording device 100 detects whether or not a new disc 22 is located on the disc tray 108. If the disc 22 is located thereon, the pinch roller 52 is raised to the disc pull-in position, and subsequently, a similar printing operation is performed. If the new disc 22 is not located, the recording head 30, the pinch roller 52 and the free rollers 60 and 62 are moved to the normal sheet printing position, and the disc tray 108 is held at the print ready position.

As described above, the present embodiment has the following advantages, in addition to the advantages of the second embodiment. The tray guide 102 having the disc tray 108 put thereon can be driven to move by the motor 106 without the need of operator's manual operations of drawing out the discharge tray from or pushing it into the ink jet recording device. As a result, operator's convenience is improved.

Further, the discharge tray 120 and the disc tray 108 may be operated independently.

<Fourth Embodiment>

An ink jet recording device 200 which is a fourth embodiment of the present invention shown in FIGS. 74 to 104 will be described.

The fourth embodiment is greatly different from the third embodiment in that the discharge tray is turned by 90° when it is inserted into and drawn out of the ink jet recording device.

Figure 74:
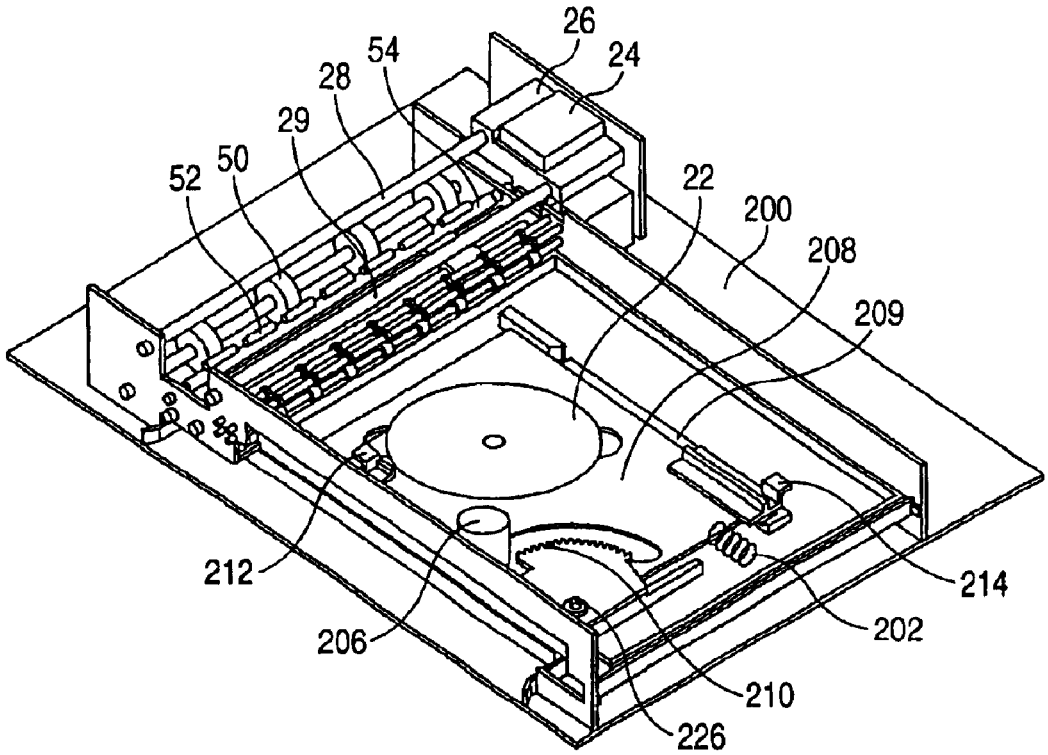
FIG. 74 is a perspective view showing a major portion of an ink jet recording device in a fourth embodiment of the invention.
Figure 75:
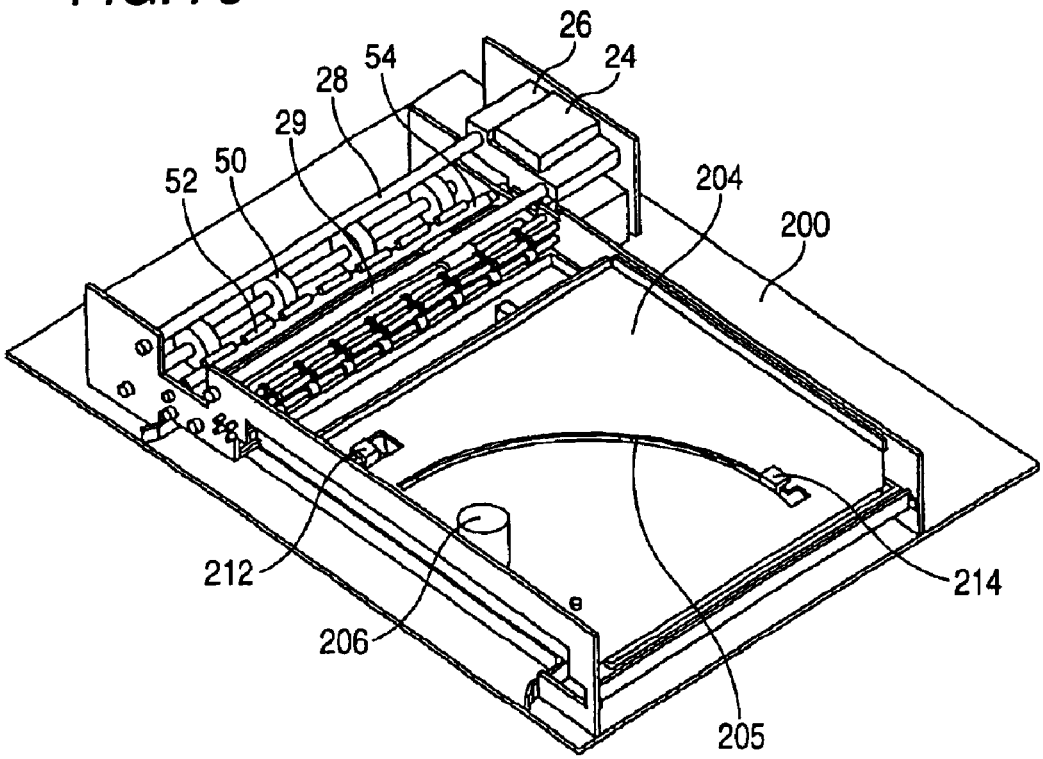
FIG. 75 is a perspective view showing a key portion of the innards of the ink jet recording device shown in FIG. 74 in which a tray-guide support plate is additionally illustrated.

FIGS. 74 and 75 are each a perspective view showing a major portion of an ink jet recording device 200 as a fourth embodiment of the invention. In the illustration of FIG. 74, a tray-guide support plate 204 in FIG. 75 is omitted for ease of explanation.

In the illustrations of the figures other than FIGS. 75, 90, 91, 94 and 95, the tray-guide support plate 204 is omitted for ease of explanation.

The tray-guide support plate 204 is fixed to a housing of the ink jet recording device 200. An arcuate slit 205 is formed in the tray-guide support plate.

A tray guide 209 for holding a disc tray 208 on which a disc 22 is to be placed includes hook parts 214 and 212 each shaped like L. The hook part 214 is provided in a state that it is hooked to the arcuate slit 205 of the tray-guide support plate 204 and is movable along the arcuate slit 205.

Further, the tray guide 209 is rotatably coupled to the tray-guide support plate 204 by means of a pin 226.

The tray guide 209, as shown in FIGS. 77 to 80, includes a gear part 210 which is extended from the main body of the tray guide 209 in a U-shaped fashion. The gear part 210 comes in engagement with a pinion 224 of a motor 206 (see FIGS. 81 to 86).

Figure 76:
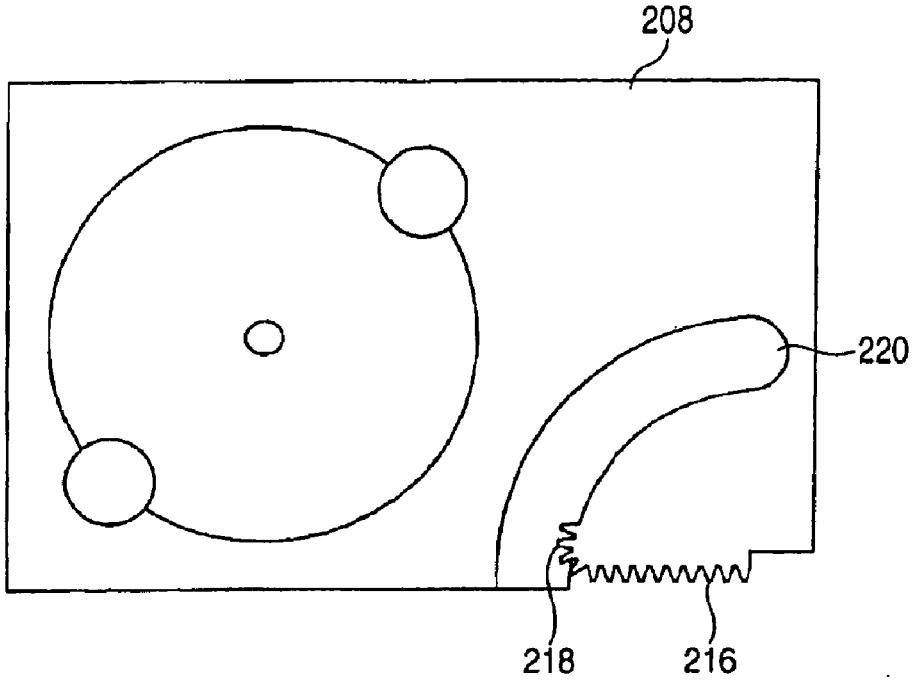
FIG. 76 is a top view showing a discharge tray in the fourth embodiment of the invention.
Figure 77:
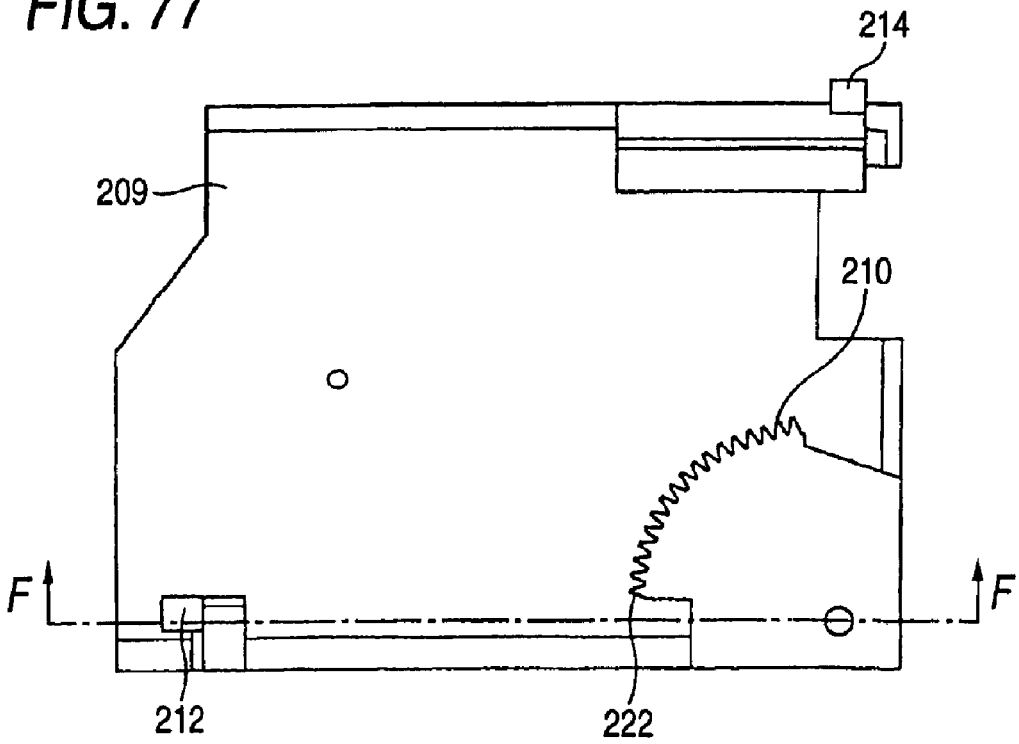
FIG. 77 is a top view showing a tray guide in the fourth embodiment of the invention.
Figure 78:
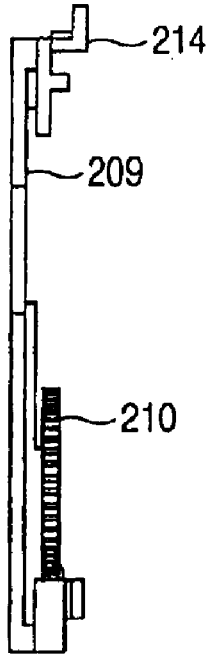
FIG. 78 is a side view showing the structure shown in FIG. 77.
Figure 79:
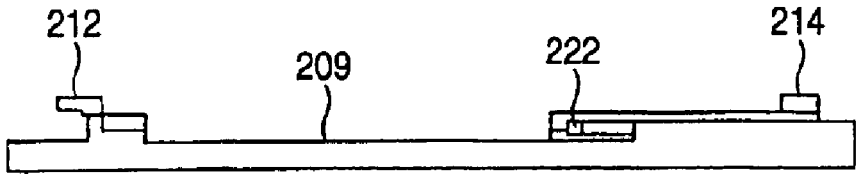
FIG. 79 is a top view showing the structure shown in FIG. 77.
Figure 80:
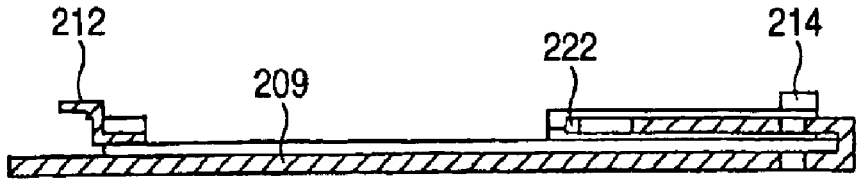
FIG. 80 is a cross sectional view taken on line F—F in FIG. 77.

An arcuate recess 220 is formed in the disc tray 208, as shown also in FIG. 76. A gear part 216 is formed above the arcuate recess.

As shown in FIGS. 81 to 86, when the pinion 224 of the motor 206 comes in engagement with the gear parts 210 and 216, two end teeth projections 222 of the gear part 210 and two end teeth projections 218 of the gear part 216 engage with the pinion 224, while those teeth projections overlapping with each other.

When the disc tray 208 moves to a predetermined position, the coiled spring 202 which is provided on the housing of the ink jet recording device 200 comes in contact with the disc tray 208, and urges the disc tray 208 toward the carriage shafts 28 and 29.

Figure 87:
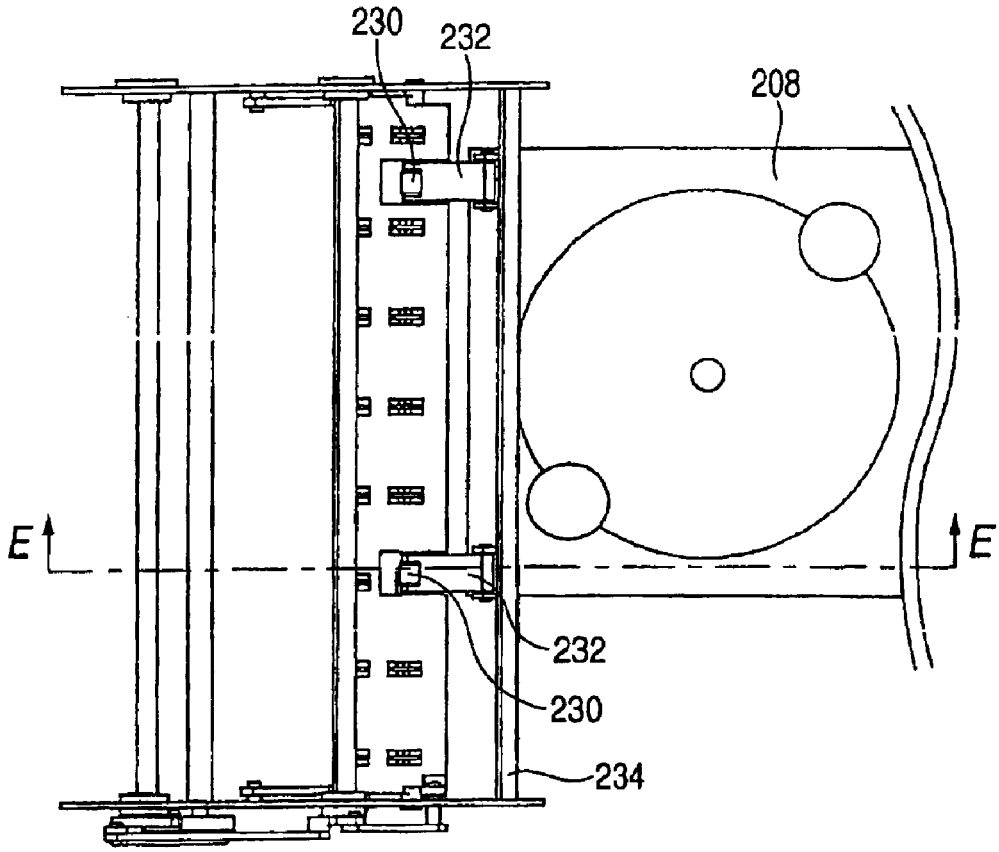
FIG. 87 is a partial top view showing disc feeding rollers in the fourth embodiment of the invention.
Figure 88:
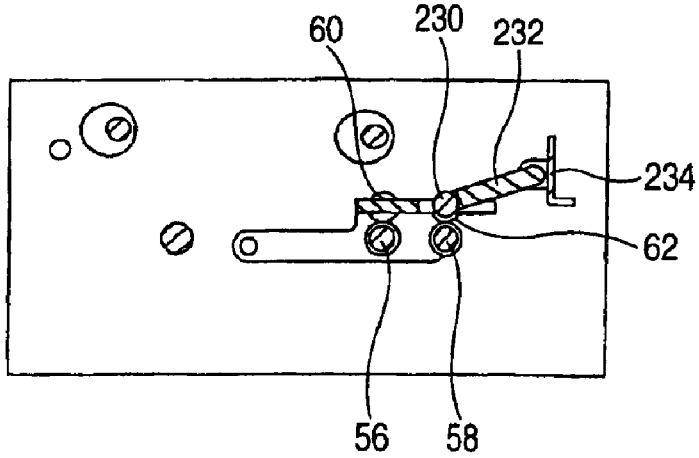
FIG. 88 is a conceptual diagram showing positions of the disc feeding rollers and the free rollers in a normal sheet printing mode in the fourth embodiment of the invention.
Figure 89:
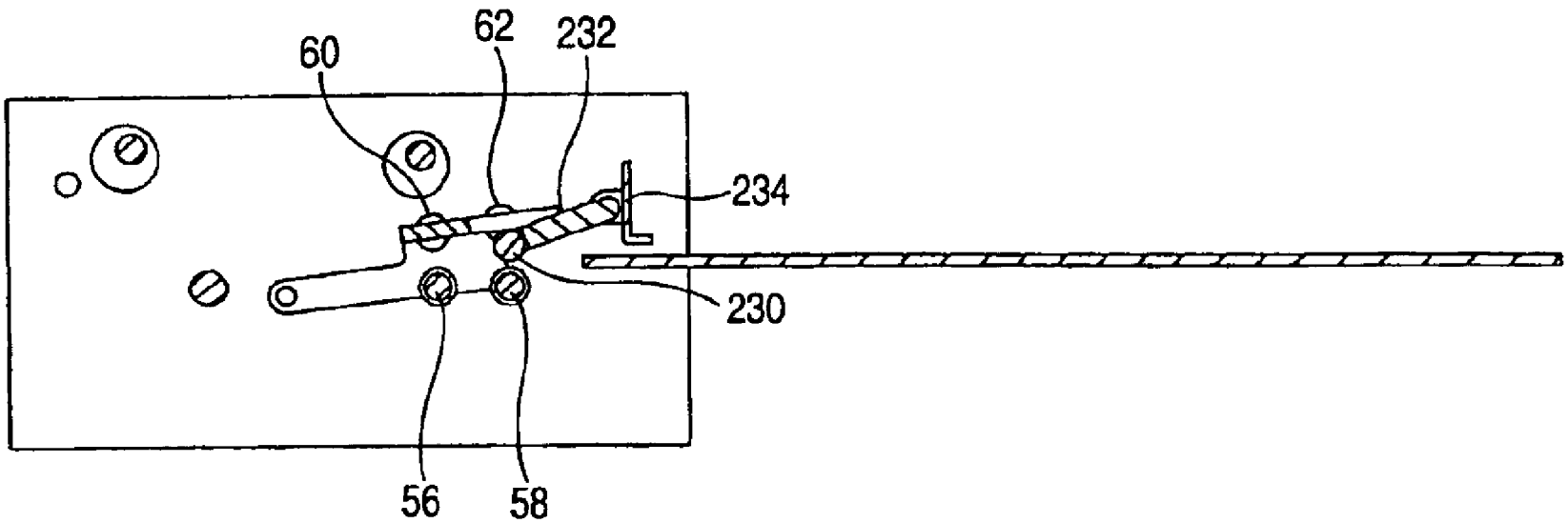
FIG. 89 is a conceptual diagram showing positions of the disc feeding rollers and the free rollers in a disc pull-in start position in the fourth embodiment of the invention.
Figure 90:
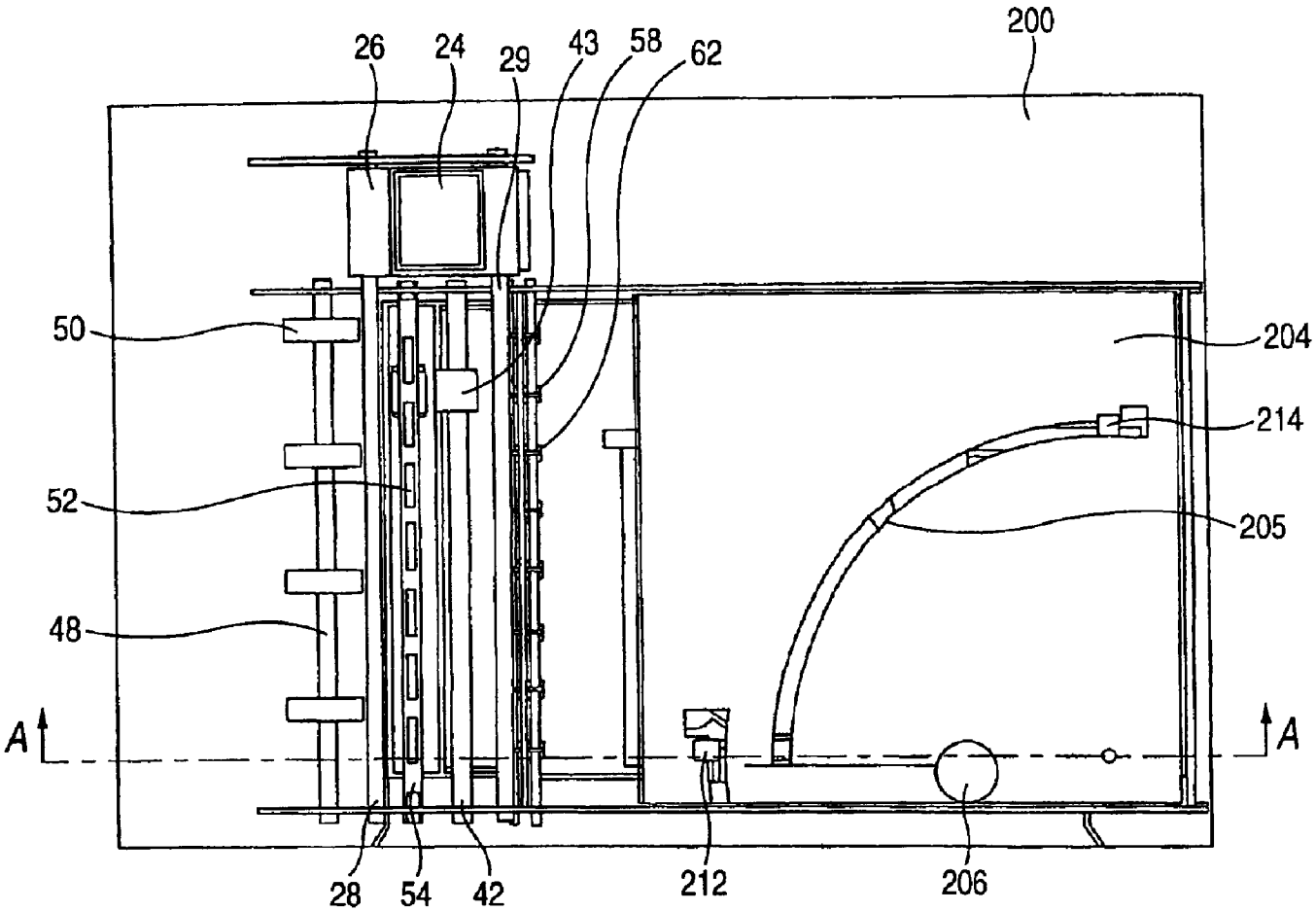
FIG. 90 is a top view showing the innards of the ink jet recording device at the print ready position in the fourth embodiment of the invention.
Figure 91:
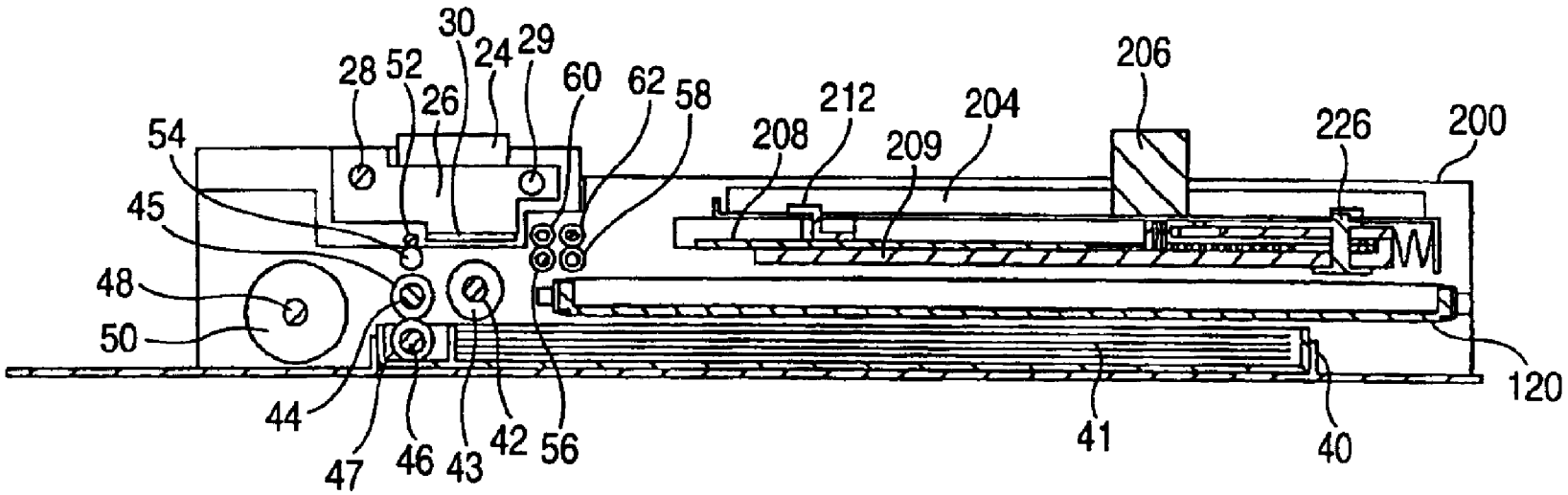
FIG. 91 is a cross sectional view taken line A—A in FIG. 90.
Figure 92:
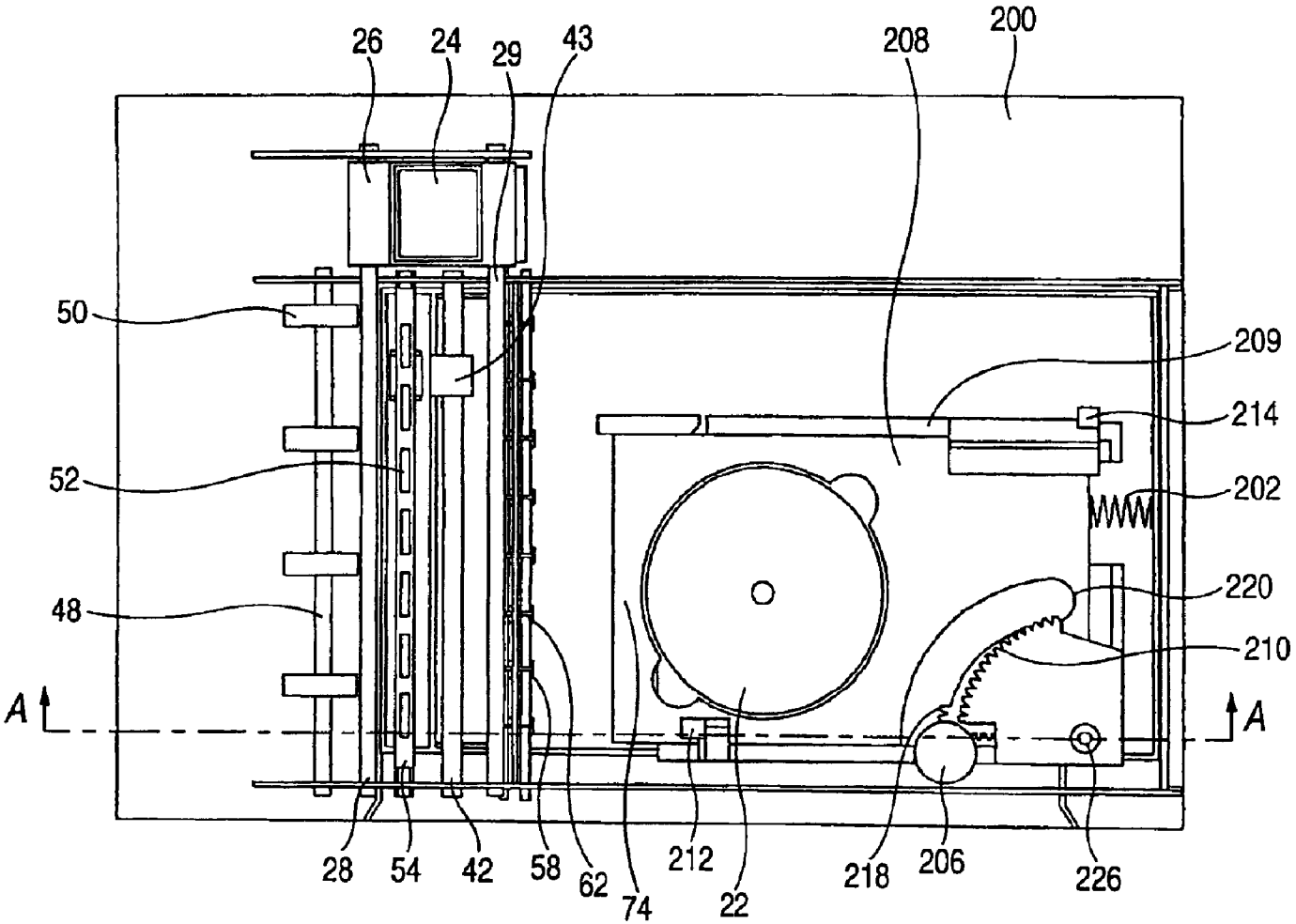
FIG. 92 is a top view showing the innards of the recording device shown in FIG. 90 in which a tray-guide support plate is omitted.
Figure 93:
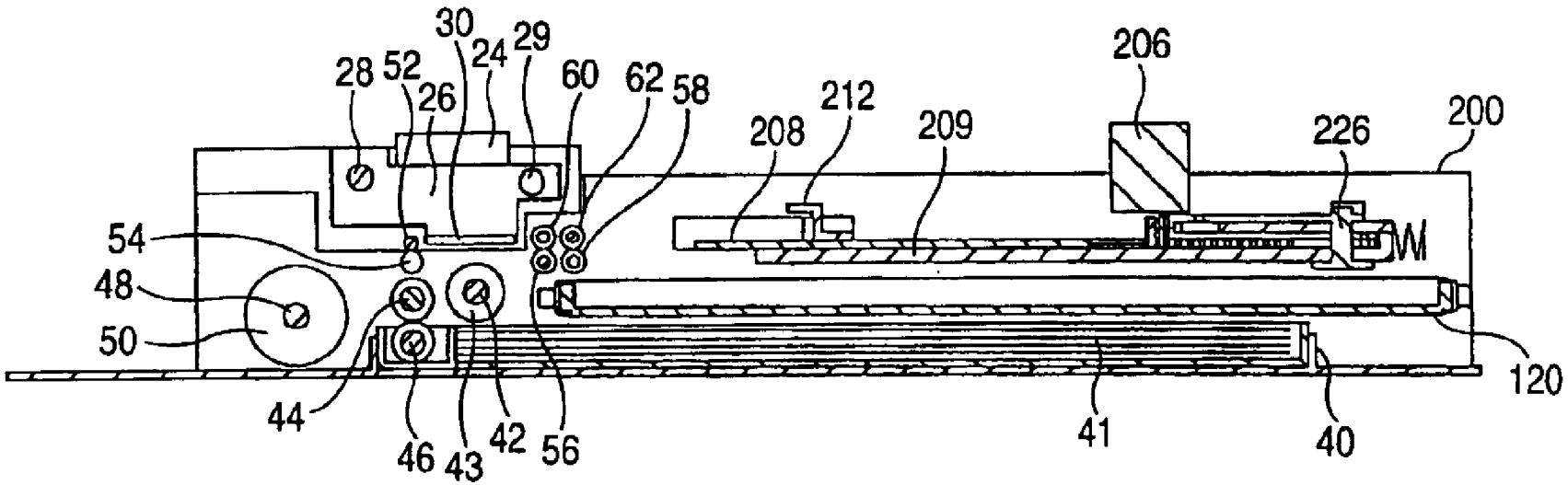
FIG. 93 is a cross sectional view taken on line A—A in FIG. 92.
Figure 94:
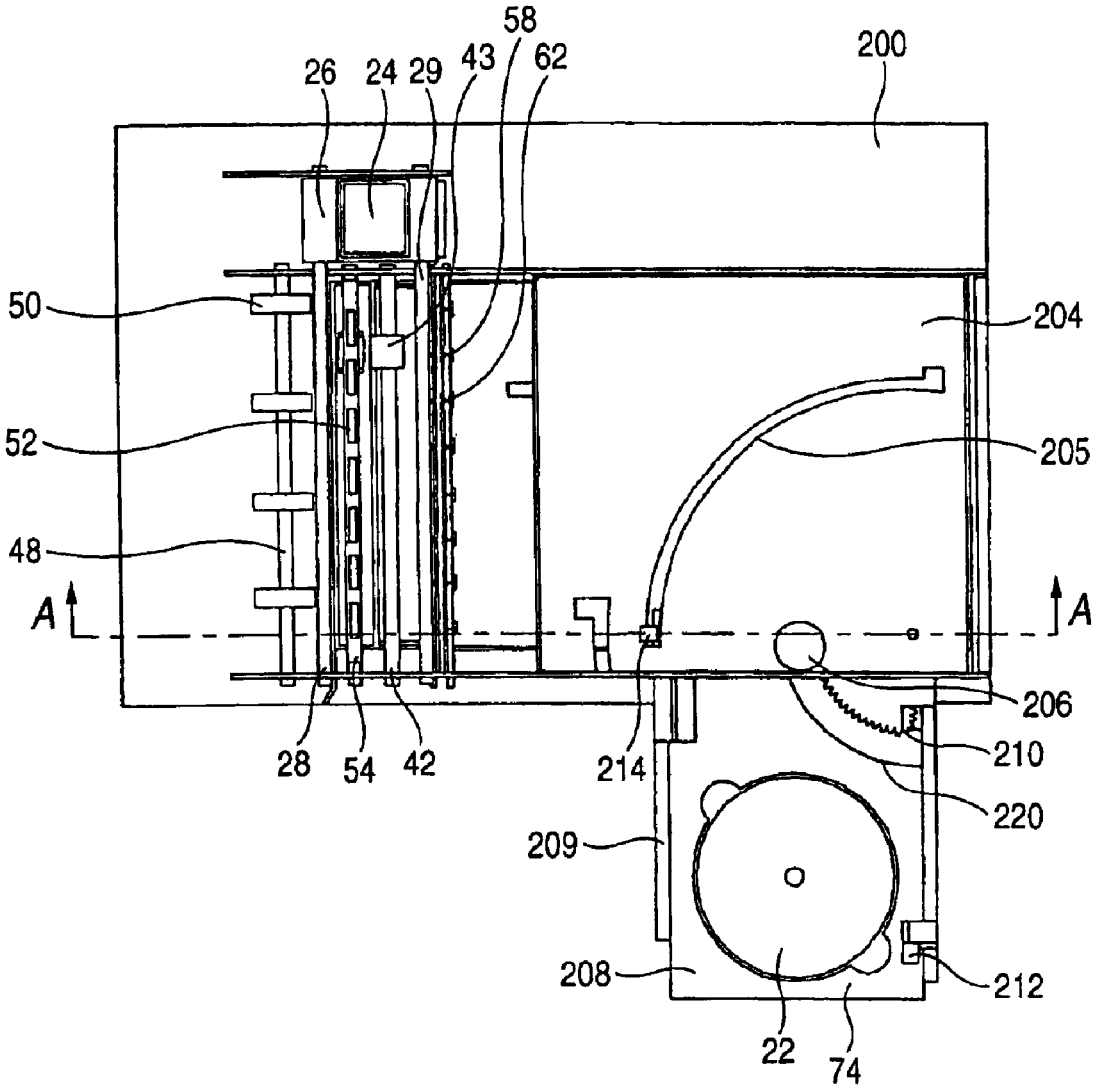
FIG. 94 is a top view showing the innards of the ink jet recording device at the disc loading/unloading position in the fourth embodiment of the invention.
Figure 95:
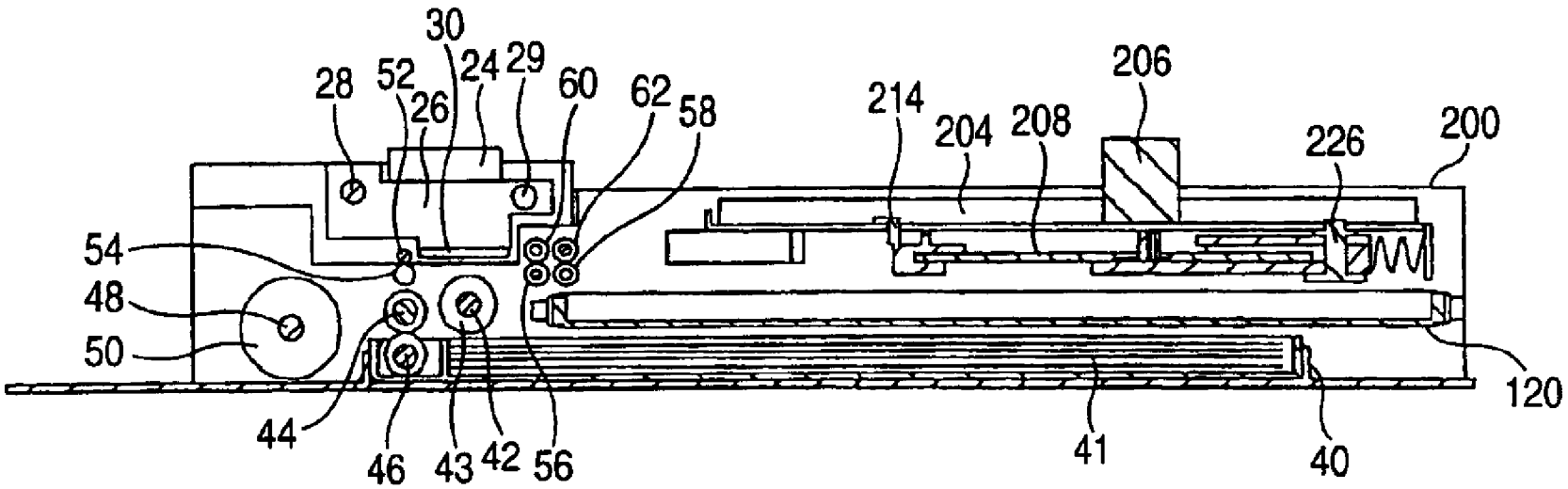
FIG. 95 is a cross sectional view taken on line A—A in FIG. 94.
Figure 96:
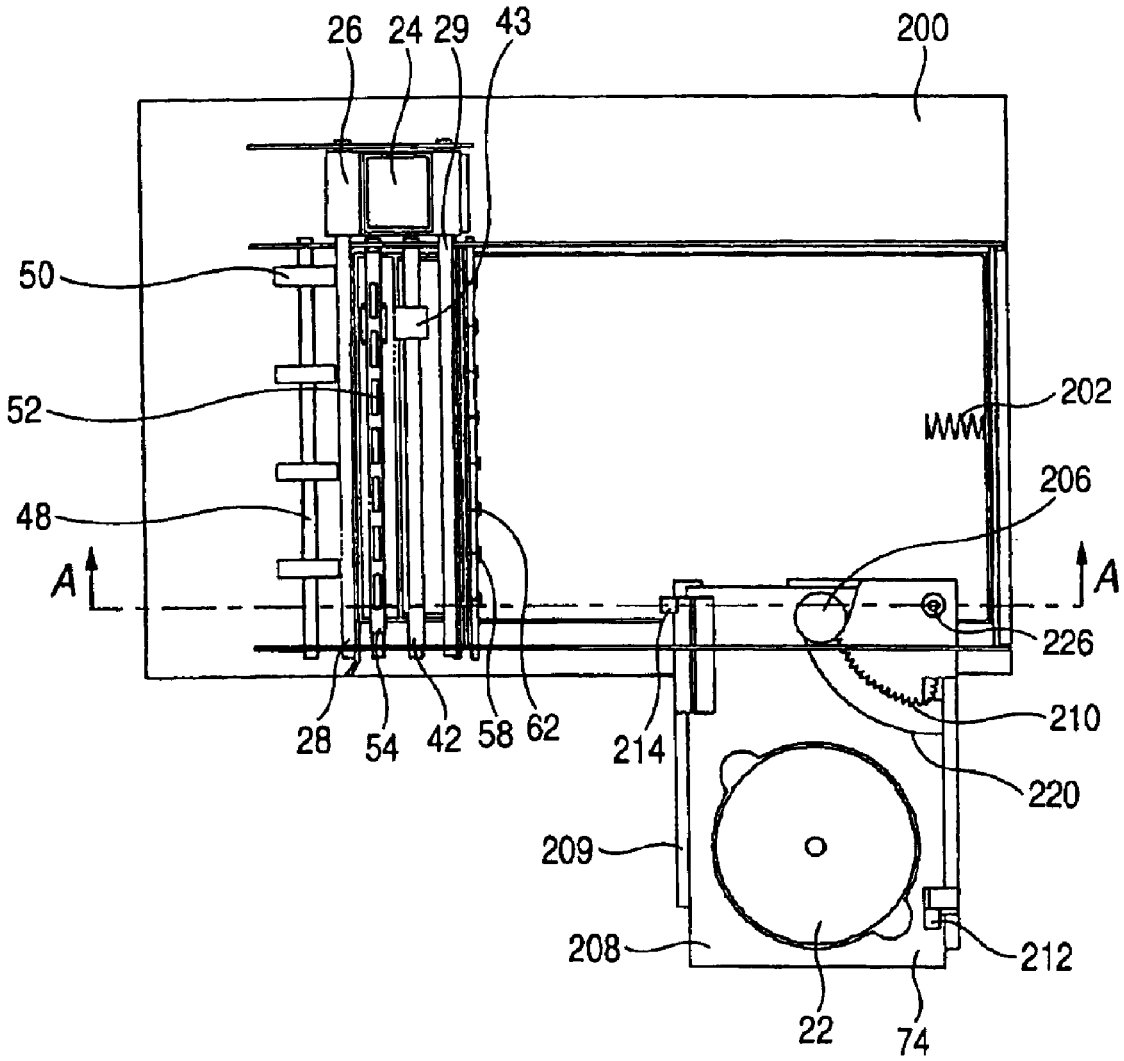
FIG. 96 is a top view showing the innards of the recording device shown in FIG. 94 in which a tray-guide support plate is omitted.
Figure 97:
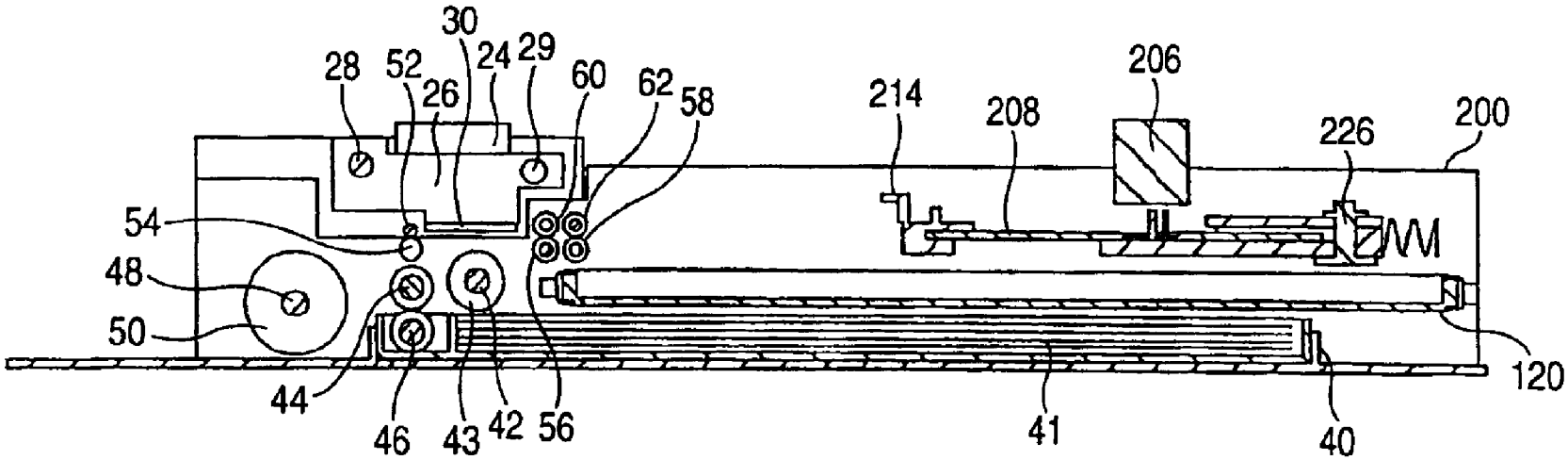
FIG. 97 is a cross sectional view taken on line A—A in FIG. 96.

As shown in FIGS. 87 to 89, a support shaft 234 is fastened to the housing of the ink jet recording device 200, and two disc feeding rollers 230 are provided on the support shaft 234 through arms 232 containing springs therein.

The disc feeding rollers 230 stand opposite to the discharge rollers 56 and 58 in a state that a gap smaller than a thickness of the disc tray 208 is interposed therebetween, so as not to contact with discharge rollers 56 and 58.

In printing on the disc tray 208, as shown in FIG. 89, in a state that the free rollers 60 and 62 are raised as shown in FIG. 89, the disc tray 208 comes in contact with the disc feeding rollers 230 while resisting spring forces of the arms 232. As a result, forward and reverse rotations of the discharge rollers 56 and 58 are transferred to the disc tray 208. In this way, the disc tray 208 is transported in the second region.

To print on a recording sheet (normal sheet) 41 as a second recording medium, the free rollers 60 and 62 are lowered as shown in FIG. 88, and the free rollers 60 and 62 come in contact with a surface of the recording sheet just after its printing. As a result, the recording sheet 41 is transported (discharged) by drive forces of the discharge rollers 56 and 58.

At this time, the recording sheet 41 does not contact with the disc feeding rollers 230.

Size reduction of the ink jet recording device 200 inevitably results in reduction of the length of the gear part 216. In this case, only the engagement of the pinion 224 of the motor 206 with the gear part 216 is insufficient to transport the disc tray 208 to the pinch roller 52 and the main roller 54, thereby possibly failing to transfer the disc tray to those rollers at the time of printing on the disc 22. To cope with this, the disc feeding rollers 230 is provided, and the disc tray 208 is transported by the utilization of the forward/reverse rotation of the discharge rollers 56 and 58.

The support shaft 234, the arms 232 and the disc feeding rollers 230 shown in FIGS. 87 through 89 are omitted in other drawings, for ease of explanation.

Figure 104:
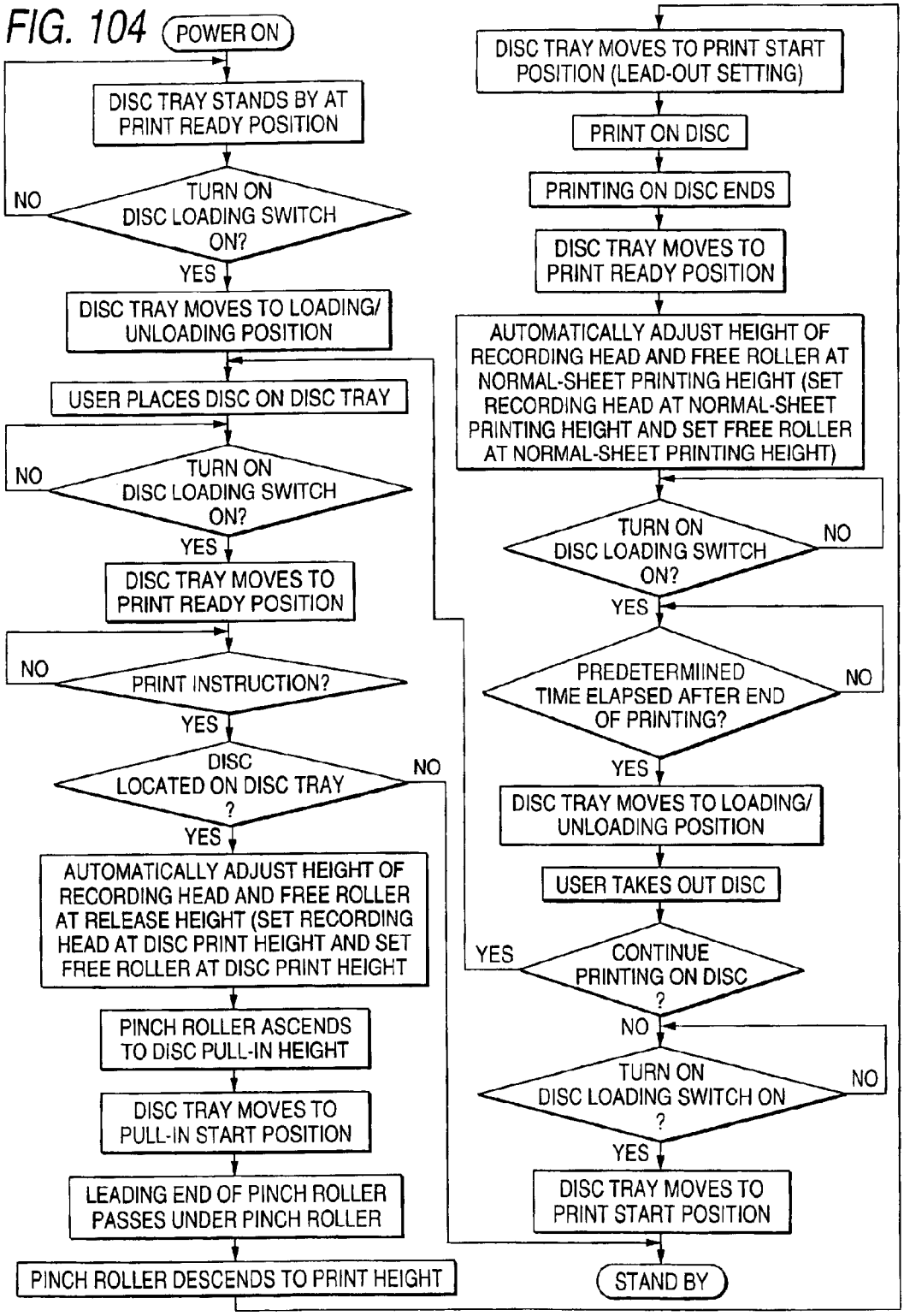
FIG. 104 is a flow chart for explaining operations of the ink jet recording device in the second embodiment of the invention.

Operations of the ink jet recording device 200 in the fourth embodiment of the invention will be described with reference to a flow charge shown FIG. 104.

To start with, the operator turns on the power switch, and then the tray guide 209 having a disc tray 208 put thereon is placed in the print ready state at the print ready position shown in FIGS. 90 to 93.

Then, the operator turns on the disc loading switch (not shown). In turn, the motor 206 is driven and the pinion 224 coupled to the motor 206 comes in mesh with the gear part 210, and the tray guide 209 moves to the disc loading/unloading position shown in FIGS. 94 to 97.

Next, the operator puts the disc 22 on the disc tray 208 on the tray guide 209, and turns on the disc loading switch again, and the tray guide 209 moves to the print ready position.

Movement of the tray guide 209 in this operation is illustrated in model form in FIGS. 81 through 86.

Figure 81:
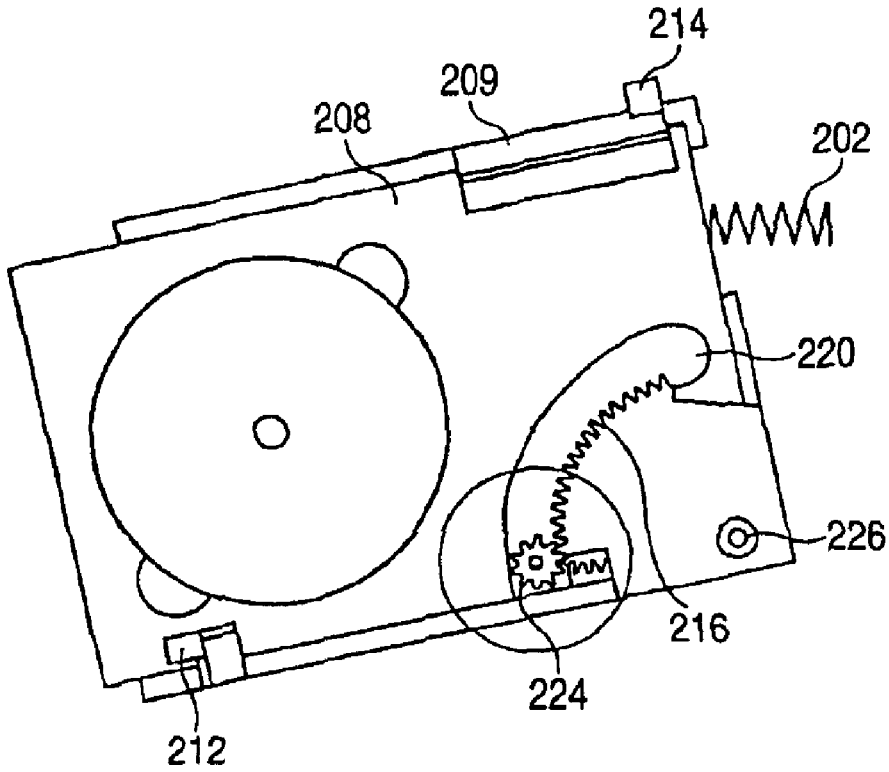
FIG. 81 is a partial top view showing, in model form, movements of the tray guide and the disc tray when those move from the disc loading/unloading position to the print ready position in the fourth embodiment of the invention.
Figure 82:
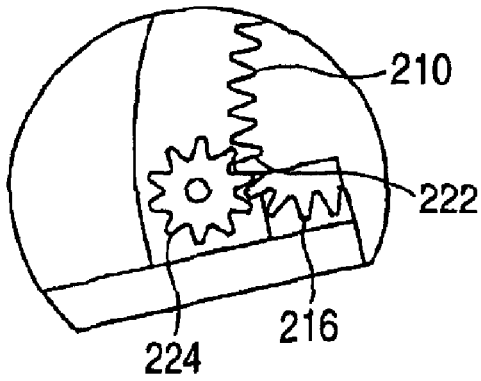
FIG. 82 is a partially enlarged view showing a relationship between the pinion and the gear.

Under driving of the motor 206, the tray guide 209 moves from the disc loading/unloading position to the print ready position, and comes in contact with the disc tray 208 at the position in FIG. 81.

Figure 83:
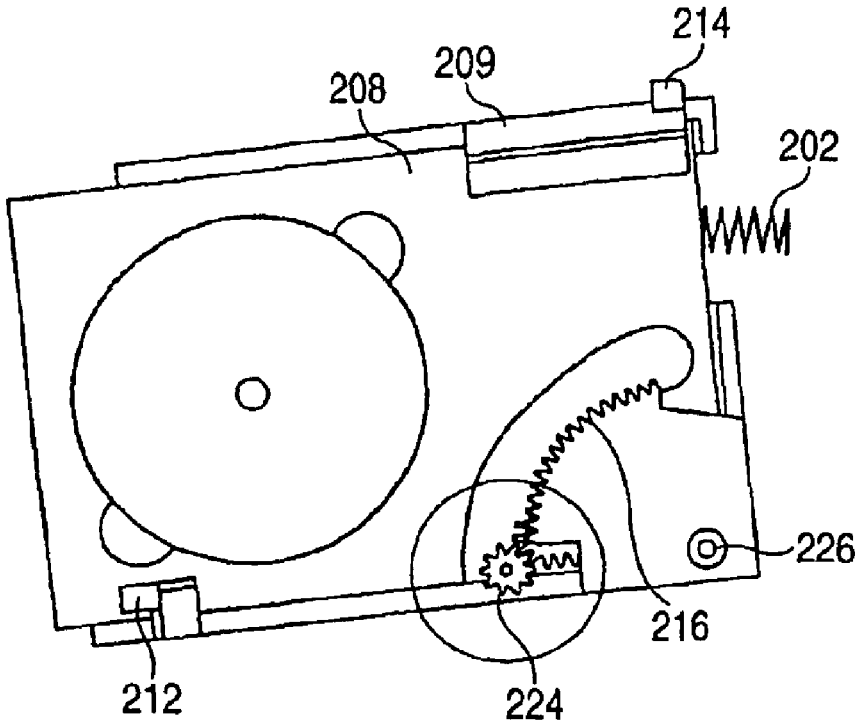
FIG. 83 is a partial top view showing, in model form, a state that the tray guide and the disc tray have further been moved from a position shown in FIG. 81 to the print ready position in the fourth embodiment of the invention
Figure 84:
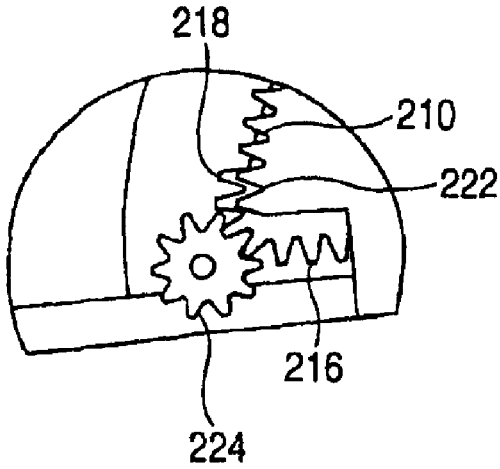
FIG. 84 is a partially enlarged view showing a relationship between the pinion and the gear in FIG. 83.
Figure 85:
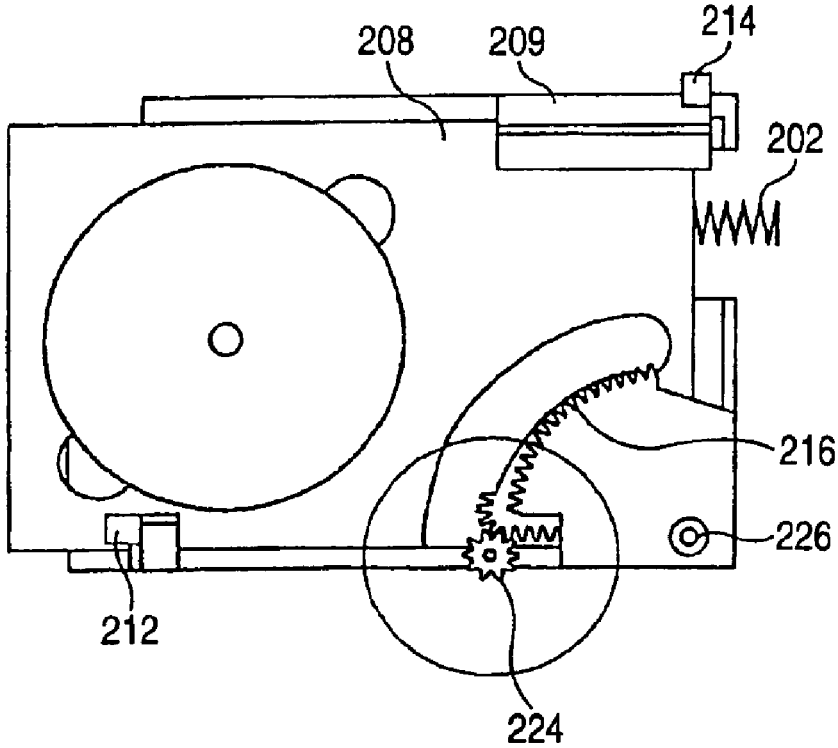
FIG. 85 is a partial top view showing, in model form, a state of the tray guide and the disc tray when those are at the print ready position in the fourth embodiment of the invention.
Figure 86:
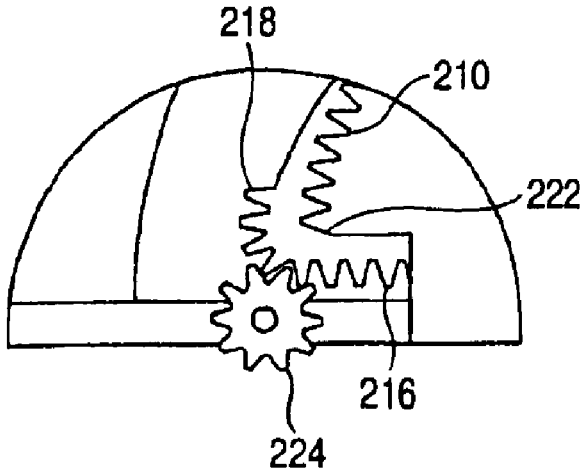
FIG. 86 is a partially enlarged view showing a relationship between the pinion and the gear in FIG. 85.

With rotation of the motor 206, the tray guide 209 is further moved to the print ready position. In turn, the disc tray 208 is gradually pressed to the carriage shafts 28 and 29 under pressing force by the coiled spring 202 (FIGS. 83 and 84). And, the tray guide 209 reaches the exact print ready position and is put in a state shown in FIGS. 85 and 86.

Thereafter, as in the third embodiment, the recording head 30 and the free rollers 60 and 62 ascend to the disc print position, and the pinch roller 52 also ascends to the disc tray pull-in position.

Figure 98:
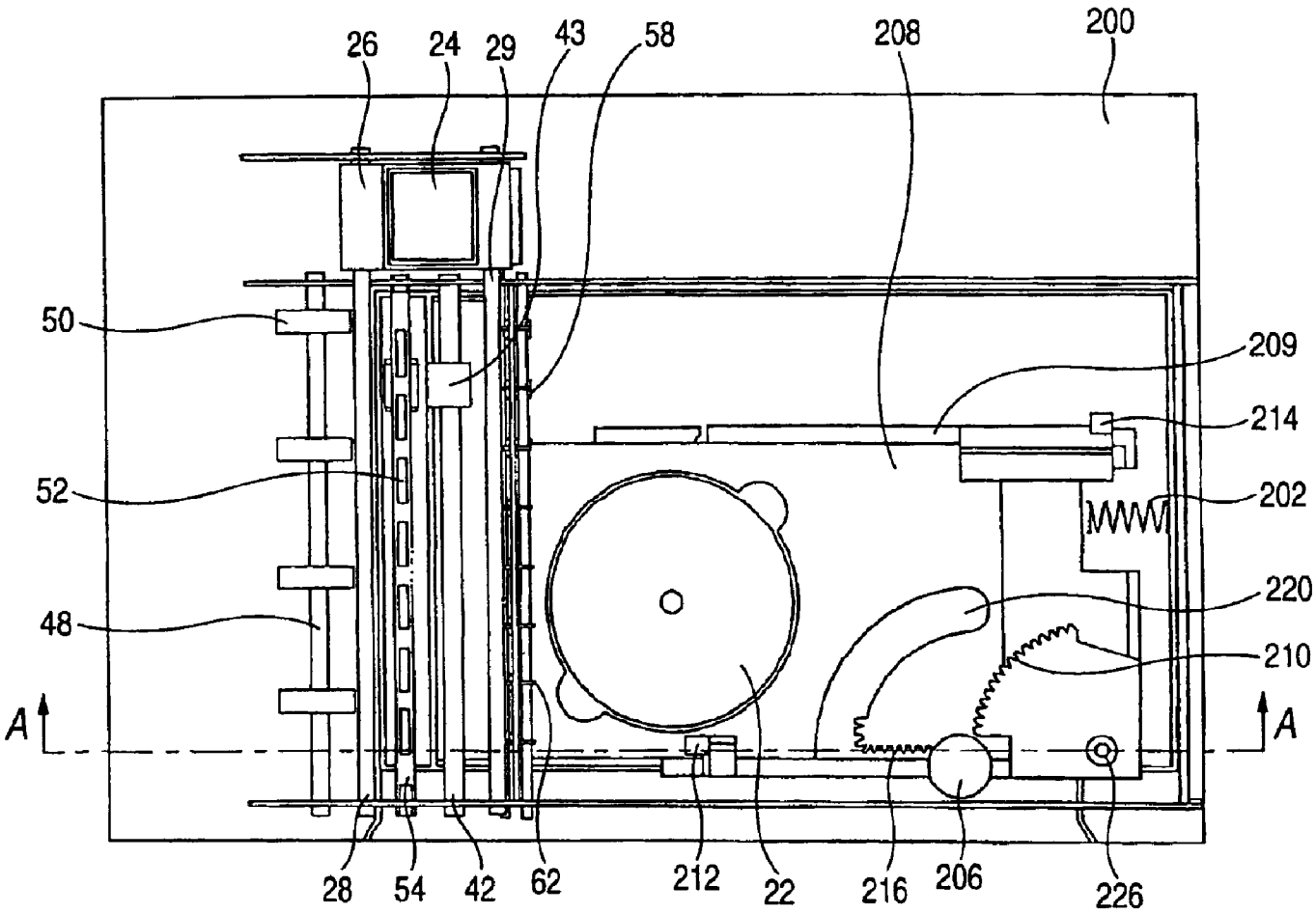
FIG. 98 is a top view showing the innards of the ink jet recording device at the disc pull-in start position in the fourth embodiment of the invention.
Figure 99:
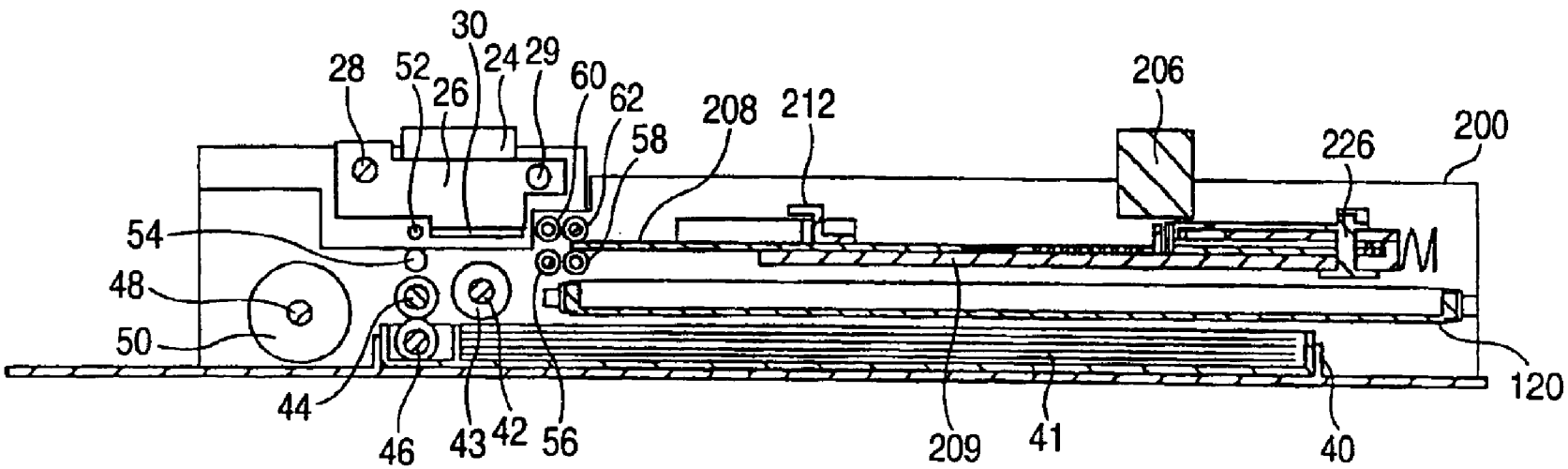
FIG. 99 is a cross sectional view taken on line A—A in FIG. 98.

By the drive force of the motor 206, the disc tray 208 is transported to the disc pull-in start position shown in FIGS. 98 and 99. Thereafter, by the driving forces of the discharge rollers 58 and 56, the disc tray 208 is transported to the main roller 54.

As in the third embodiment, if it is judged that the leading end 74 of the disc tray 208 passed under the pinch roller 52, the pinch roller 52 descends.

Figure 100:
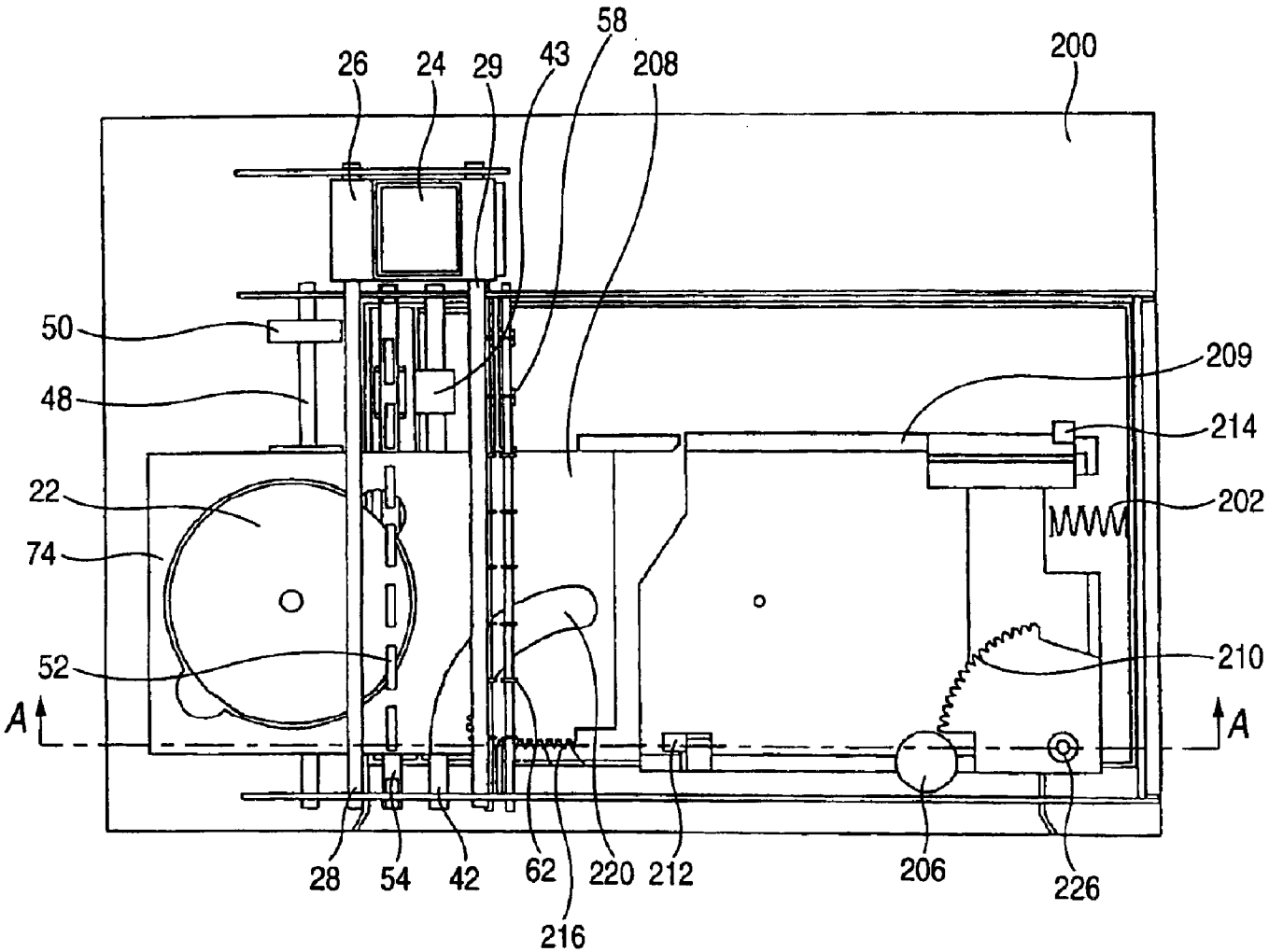
FIG. 100 is a top view showing the innards of the ink jet recording device at the print start position in the fourth embodiment of the invention.
Figure 101:
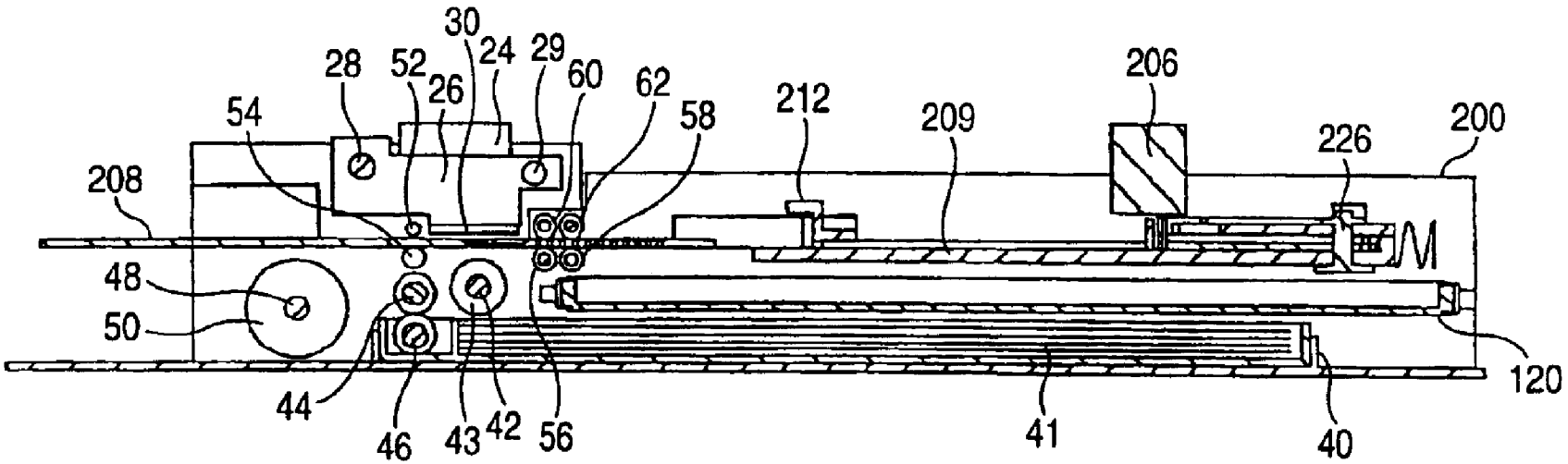
FIG. 101 is a cross sectional view taken on line A—A in FIG. 100.

Thereafter, the disc tray 208 moves to the print start position shown in FIGS. 100 and 101, and then, an operation of printing on the disc 22 starts.

Figure 102:
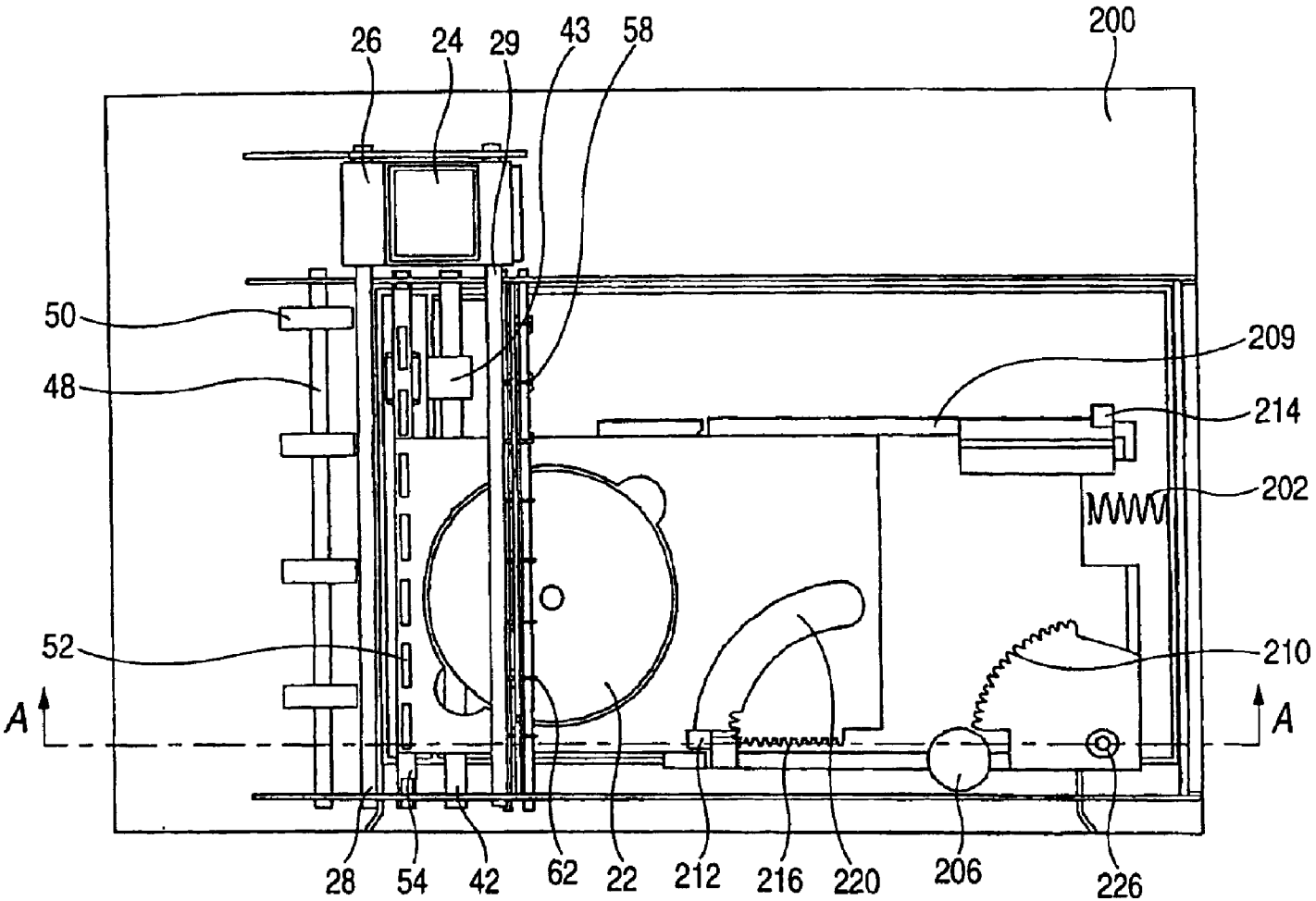
FIG. 102 is a top view showing the innards of the ink jet recording device at the print end position in the fourth embodiment of the invention.
Figure 103:
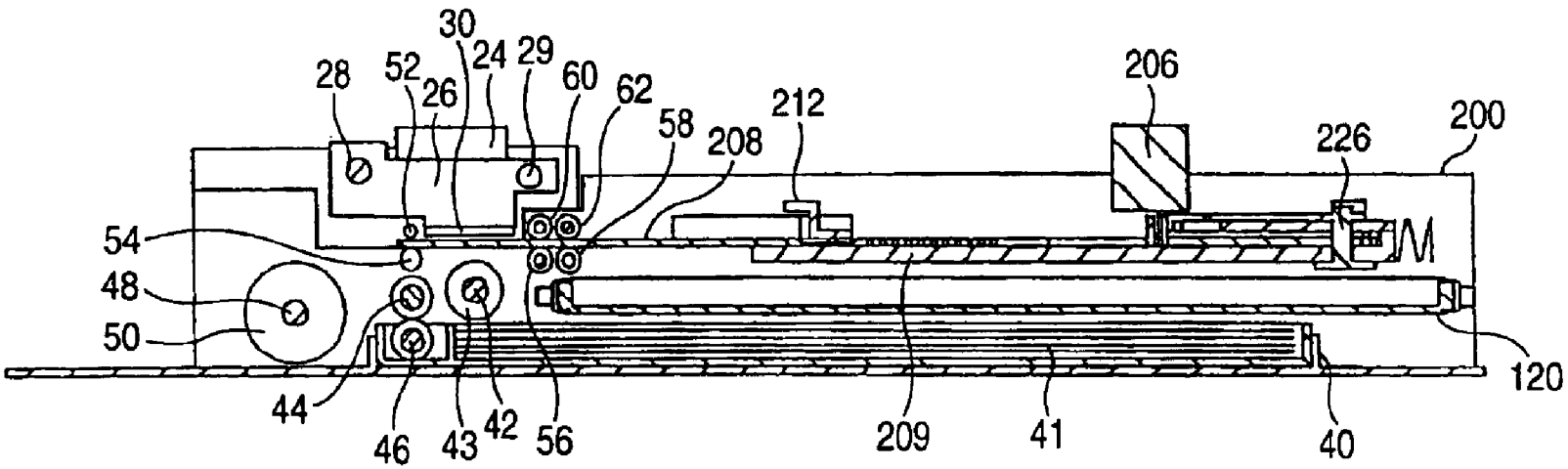
FIG. 103 is a cross sectional view taken on line A—A in FIG. 102.

Thereafter, when the printing on the disc 22 ends, the disc tray 208 is transported to the print end position shown in FIGS. 102 and 103.

Following this, the disc tray 208 is transported to the print ready position, and put in the print ready state.

When it is judged that in this print ready state, the operator turns on the disc loading switch, the computer (not shown) contained in the ink jet recording device 200 judges whether or not a predetermined time (e.g., 10 seconds) has elapsed after the printing on the disc 22 ends. If the predetermined time has not elapsed, the print ready state of the disc tray is maintained at the print ready position. If the predetermined time has elapsed, the tray guide 209 having the disc tray 208 put thereon is moved to the disc loading/unloading position. And, the operator may take out the printed disc 22.

Thereafter, the operator turns on the disc loading switch to return the tray guide 209 to the print ready position.

Thereafter, the next print command is issued, a sensor (not shown) installed to the ink jet recording device 100 detects whether or not a new disc 22 is located on the disc tray 208. If the disc 22 is located, the pinch roller 52 is raised to the disc pull-in position, and subsequently, a similar printing operation is performed. If the new disc 22 is not located, the recording head 30, the pinch roller 52 and the free rollers 60 and 62 are moved to the normal sheet printing position, and the disc tray 208 is held at the print ready position.

As described above, the present embodiment has the following advantages, in addition to the advantages of the second embodiment. The tray guide 102 having the disc tray 108 put thereon can be driven to move by the motor 106 without the need of operator's manual operations of drawing out the discharge tray from or pushing it into the ink jet recording device. As a result, operator's convenience is improved.

Further, in the embodiment, the tray guide 209 can be transported in the main scan direction and a direction orthogonal to the main scan direction, by one motor 206. Accordingly, size reduction of the whole ink jet recording device is realized.

As seen from the foregoing description, according to first aspect of the invention, a select switch is provided which switches between a protruding state and an accommodated state of the medium holding plate on the front side of the ink jet recording apparatus. The select switch, the medium tray and the medium holding plate are all operated on the front side of the ink jet recording apparatus. Accordingly, the ink jet recording apparatus may compactly be accommodated in a place having an opening only at the front, such as a television rack in a home.

The medium tray and the medium holding plate are disposed substantially parallel to each other. Therefore, the ink jet recording apparatus is reduced in height. The ink jet recording apparatus may compactly be accommodated in, for example, a television rack in a home.

The medium holding plate is transported by the first transporting system, and the second recording medium is transported by the second transporting system. Therefore, the printing on the first recording medium or the printing on the second recording medium may be selected.

Additionally, the first transporting system and the second transporting system include each at least one transporting roller. Therefore, the device size may be reduced without increasing the number of component parts.

Further, the ink jet printing apparatus includes a motor provided in the first transporting system, a pinion driven by the motor, and a gear which is provided on the medium holding plate so as to be in mesh with the pinion. A reliable switching is made between a protruding state and an accommodated state of the disc tray.

Further, the second transporting system includes a feed roller for transporting exclusively the second recording medium, and free rollers, in transporting the medium holding plate, the feed roller and the free roller ascend to be not in contact with the medium holding plate, and in transporting the second recording medium, the feed roller and the free roller descend to be in contact with the second recording medium. Therefore, the printing on the first recording medium on the medium holding plate may smoothly be switched to the printing on the second recording medium.

Further, the first transporting system and the second transporting system include each a pinch roller provided opposite to the transporting roller, and when the medium holding plate is transported to the first direction, and when a leading end of the medium holding plate as viewed in the transporting direction passes between the transporting roller and the pinch roller, a distance between the transporting roller and the pinch roller is larger than a thickness of the medium holding plate. Therefore, the medium holding plate may smoothly move from the transporting roller to the pinch roller and vice versa.

Further, a distance between the first recording medium and the recording head and a distance between the second recording medium and the recording head are kept constant. Therefore, the ink jet recording apparatus can adaptively handle plural types of recording media having different thicknesses without the aid of the operator.

Further, the medium holding plate and the medium tray are completely accommodated in the ink jet recording apparatus at least when the recording head starts to print. Therefore, there is no chance that at the time of printing on the recording medium, the medium holding plate and the medium tray protrude to outside the ink jet recording apparatus. Accordingly, there is eliminated a member protruding to outside the ink jet recording apparatus at the start of printing. Further, the operator's work to attach another member to the recording device is omitted.

According to the second aspect of the invention, a medium holding plate is moved out of the ink jet recording device at the time of loading and unloading of an optical recording medium. With such a construction, the medium holding plate is not protruded from the ink jet recording device at the time of printing.

Every kind of operation can be performed from the front side of the recording device.

Accordingly, the ink jet recording device may be accommodated compactly in, for example, a television rack in a home.

Further, the medium holding plate is transported by a first transporting system, and a second recording medium is transported by a second transporting system. It is possible to switch between the printing on the first recording medium and the printing on the second recording medium.

Further, every operation of the medium holding plate and a medium supplying part may be performed in one direction. Therefore, the ink jet recording device maybe installed in a place which allows one to access the interior thereof for operation in only one direction, such as a television rack in a home.

According to third aspect of the invention, the medium holding plate is provided above the medium supplying part.

Another recording medium on which a recording head prints is discharged into between the medium holding plate and the medium supplying part. Therefore, the medium holding plate, the medium supplying part and a space to which the another recording medium is discharged are efficiently disposed. Accordingly, the whole device is compact. Further, in other situations than when the optical recording medium is loaded into or unloaded from the recording device, neither the medium holding plate nor the medium supplying part is protruded from the ink jet recording device, and there is no need of providing the space into which the another recording medium is discharged, outside the ink jet recording device.

Further, the ink jet recording device includes a motor for driving and moving the medium holding plate in a first direction, a first region in which the motor drives and moves the medium holding plate in the first direction, and a second region in which a first transporting system drives and transports the medium holding plate in the first direction, wherein a part of a transporting path of the medium holding plate and a part of a transporting path of the second recording medium are used in common in the second region. Therefore, the recording device is reduced in size.

Further, the first and second transporting systems include each a pinch roller for transporting the medium holding plate and another recording medium in the first direction. The ink jet recording device includes a pinch-roller distance changing mechanism for automatically changing a distance between the pinch roller and the medium holding plate as viewed in a thickness of the medium holding plate in accordance with a thickness of the medium holding plate. With provision of the mechanism, even if the thickness of the medium holding plate changes, there is no need that the operator perform an adjusting work.

Accordingly, the invention produces such an excellent advantage as to eliminate troublesome operations, which are caused by the changing of the thickness of the medium holding plate, and the switching between the printing on the optical recording medium and the printing on another recording medium.

As seen from the foregoing description, the medium holding plate on which the first recording medium is to be placed may be transported in two directions, a first direction and a second direction. Therefore, the ink jet recording apparatus is reduced in size in the first direction, and it is compactly accommodated in, for example, a television rack in a home.

According to fourth aspect of the invention, the medium tray, the discharge tray, and the medium holding plate are all operated on the front side of the ink jet recording apparatus. A loading mechanism for switching between a protruding state and an accommodated state of the disc tray on the front side of the ink jet recording apparatus is provided. Therefore, the ink jet recording apparatus maybe accommodated in a place having an opening only at the front, such as a television rack in a home.

Further, the medium tray and the medium holding plate are disposed substantially parallel to each other. Therefore, the ink jet recording apparatus is reduced in height. The ink jet recording apparatus may compactly be accommodated in, for example, a television rack in a home.

The medium holding plate is transported by the first transporting system, and the second recording medium is transported by the second transporting system. Therefore, the printing on the first recording medium or the printing on the second recording medium may be selected.

Further, the first transporting system and the second transporting system include each at least one transporting roller. Therefore, the device size may be reduced without increasing the number of component parts.

Further, the loading mechanism includes a motor provided in the ink jet recording apparatus, a pinion driven by the motor, and a gear which is provided on the medium holding plate so as to be in mesh with the pinion. Therefore, the operation by the operator is easy.

Further, in the loading mechanism, an idle gear having an axial center which is offset from an axial center of the pinion in the first direction, is provided between the gear and the pinion. Therefore, when the guide part moves and the idle gear comes in contact with the pinion, the idle gear are brought into engagement with the pinion such that the teeth projections of the idle gear obliquely contact with the teeth projections of the pinion, thereby ensuring a reliable engagement of them.

Further, the first transporting system includes a medium holding plate transporting roller for transporting the medium holding plate in the first direction, a taper part tapered in the second direction is formed on the medium holding plate transporting roller, and when the medium holding plate is switched from the protruding state to the accommodated state, and the medium holding plate comes in contact with the medium holding plate transporting roller, the medium holding plate is guided by the taper part. When the medium holding plate is switched from the protruding state to the accommodated state, the medium holding plate does not hit the side surface of the medium holding plate transporting roller, and hence, the medium holding plate transporting roller reliably comes in contact with the surface of the medium holding plate.

Further, the first transporting system includes a pinch roller provided opposite to the transporting roller, and a pinch-roller distance changing mechanism which changes a distance between the transporting roller and the pinch roller when the medium holding plate changes its transportation along the second direction to the transportation along the first direction and when a leading end of the medium holding plate as viewed in the direction of transporting the medium holding plate passes between the transporting roller and the pinch roller. When the medium holding plate changes its transportation along the second direction to the transportation along the first direction, viz., the medium holding plate moves from the print ready position to the disc tray pull-in position, the medium holding plate reliably passes between the transporting roller and the pinch roller.

Further, the second transporting system includes a free roller, and a free roller select mechanism which brings the free roll into contact with the second recording medium during the transportation of the second recording medium, and lifts the free roller so as to detach the free roller from the medium holding plate during the transportation of the medium holding plate. Accordingly, during the transportation of the second recording medium, the free roller select mechanism brings the free roll into contact with the second recording medium, whereby the recording medium is smoothly transported. During the transportation of the medium holding plate, the free roller select mechanism lifts the free roller so as to detach the free roller from the medium holding plate, to thereby prevent the first recording medium on the medium holding plate from being damaged.

Further, the recording head is coupled to the pinch-roller distance changing mechanism, and the pinch-roller distance changing mechanism keeps constant a distance between the first recording medium and the recording head, and keeps constant a distance between the second recording medium and the recording head. Therefore, the ink jet recording apparatus can adaptively handle plural types of recording media having different thicknesses without the aid of the operator.

Further, the medium holding plate, the medium tray and the discharge tray are accommodated in the ink jet recording apparatus at least when the recording head ejects ink or the second recording medium is discharged into the discharge tray. Therefore, there is no chance that at the time of printing on the recording medium, the medium holding plate and the medium tray protrude to outside the ink jet recording apparatus. Therefore, the operator can execute the printing process even in a state that the glass door of a television rack or the like is left closed.

What is claimed is:

1. An ink jet recording apparatus comprising:

a medium holding plate which is contained in said ink jet recording apparatus and on which a first recording medium is to be placed;

a select switch for switching a protruding state of said medium holding plate out of said ink jet recording apparatus and an accommodating state of said medium holding plate;

a medium tray which is contained in said ink jet recording apparatus and on which a second recording medium is to be placed, said medium tray being substantially parallel to said medium holding plate;

a first transporting system for reciprocatively moving said medium holding plate in a first direction and a second direction opposite to said first direction;

a second transporting system for transporting said second recording medium in said first direction; and a recording head for ejecting ink to said first recording medium on said medium holding plate which is transported in said first direction by said first transporting system, and said second recording medium on said medium holding plate which is transported in said second direction by said second transporting system;

wherein said select switch, said medium tray, and said medium holding plate are operated on the front side of said ink jet recording apparatus.

2. An ink jet recording apparatus according to claim 1, wherein said first transporting system and said second transporting system include each at least one transporting roller.

3. An ink jet recording apparatus according to claim 1, wherein said first transporting system includes a motor, a pinion driven by said motor, and a gear which is provided on said medium holding plate so as to be in mesh with said pinion.

4. An ink jet recording apparatus according to claim 1, wherein said second transporting system includes a feed roller for transporting exclusively said second recording medium, and free rollers, in transporting said medium holding plate, said feed roller and said free roller ascend to be not in contact with said medium holding plate, and in transporting said second recording medium, said feed roller and said free roller descend to be in contact with said second recording medium.

5. An ink jet recording apparatus according to any of claims 2 to 4, wherein said first transporting system and said second transporting system include each a pinch roller provided opposite to said transporting roller, and when said medium holding plate is transported to said first direction, and when a leading end of said medium holding plate as viewed in the transporting direction passes between said transporting roller and said pinch roller, a distance between said transporting roller and said pinch roller is larger than a thickness of said medium holding plate.

6. An ink jet recording apparatus according to claim 1, wherein a distance between said first recording medium and said recording head and a distance between said second recording medium and said recording head are kept constant.

7. An ink jet recording apparatus according to claim 1, wherein said medium holding plate and said medium tray are completely accommodated in said ink jet recording apparatus at least when said recording head starts to print.

8. An ink jet recording apparatus according to claim 1, wherein said first recording medium includes at least one of an optical recording medium, a magnetic recording medium, an electronic recording medium, a plastic card, a resin solid material, and a metal solid material.

9. An ink let recording device comprising:

a medium holding plate which is contained in said ink jet recording device and on which a recording medium device is to be placed;

a transporting system for transporting said medium holding plate in a first direction; and a recording head for ejecting ink toward said recording medium device on said medium holding plate, which is transported in said first direction by said transporting system;

wherein said medium holding plate is provided so as to be movable in a second direction which is different from said first direction, and when said recording medium device is loaded into or unloaded from said ink let recording device, said medium holding plate moves along said second direction to outside said ink jet recording device, wherein said first direction and said second direction are orthogonal to each other.

10. An ink jet recording device according to claim 9, wherein when said recording medium device is loaded into and unloaded from said ink jet recording device, said medium holding plate remains at the same position.

11. An ink jet recording device according to claim 9, wherein said medium device consists of at least one from the group of an optical recording medium, a magnetic recording medium, an electronic recording medium, a plastic card, a resin solid material, and a metal solid material.

12. An ink jet recording device comprising:

a medium holding plate which is contained in said ink jet recording device and on which an optical recording medium is to be placed;

a transporting system for transporting said medium holding plate in a first direction;

a recording head for ejecting ink toward said optical recording medium on said medium holding plate, which is transported in said first direction by said transporting system;

a motor for driving and moving said medium holding plate in said first direction;

a first region in which said motor drives and moves said medium holding plate in said first direction; and a second region in which said transporting system drives and transports said medium holding plate in said first direction, wherein said medium holding plate is provided so as to be movable in a second direction which is different from said first direction, and when said optical recording medium is loaded into or unloaded from said ink jet recording device, said medium holding plate moves along said second direction to outside said ink jet recording device.

13. An ink jet recording device according to claim 12, further comprising a motor for driving and moving said medium holding plate in said second direction.

14. An ink jet recording device comprising:

a medium holding plate which is contained in said ink jet recording device and on which a recording medium device is to be placed;

a transporting system for transporting said medium holding plate in a first direction; and a recording head for electing ink toward said recording medium device on said medium holding plate, which is transported in said first direction by said transporting system;

wherein said medium holding plate is provided so as to be movable in a second direction which is different from said first directions, and when said recording medium device is loaded into or unloaded from said ink jet recording device, said medium holding plate moves along said second direction to outside said ink jet recording device, wherein said transporting system includes a pinch roller for transporting said medium holding plate in said first direction, and said ink jet recording device includes a pinch-roller distance changing mechanism which automatically changes a distance as viewed in thickness direction of said medium holding plate between said pinch roller and said medium holding plate in accordance with at least one of a thickness and a kind of said medium holding plate.

15. An ink jet recording device comprising:

a medium holding plate on which an optical recording medium is to be placed;

a medium supplying part for supplying a second recording medium;

a first transporting system for transporting said medium holding plate;

a second transporting system for transporting said second recording medium from said medium supplying part; and a recording head for ejecting ink to said first recording medium and said second recording medium on said medium holding plate, which is transported in a first direction by said first transporting system and said second transporting system, wherein said medium holding plate is provided so as to be movable in a second direction which is different from said first direction, said medium holding plate moves along said second direction to a position outside said ink jet recording device only when said first recording medium may be loaded to or unloaded from said ink jet recording device, and said medium supplying part further comprising a discharge tray into which said second recording medium on which said recording head prints is discharged.

16. An ink jet recording device according to claim 15, wherein said medium supplying part is movable in said second direction.

17. An ink jet recording device according to claim 15, wherein said medium holding plate is provided above said medium supplying part, and said second recording medium on which said recording head prints is discharged into between said medium holding plate and said medium supplying part.

18. An ink jet recording device according to claim 17, wherein said medium holding plate, said medium supplying part and said discharge tray are disposed substantially parallel to one another.

19. An ink jet recording device according to claim 15, wherein said medium holding plate is provided above said medium supplying part, and said second recording medium on which said recording head prints is discharged to a lower side of said medium supplying part.

20. An ink jet recording device according to claim 19, further comprising a discharge tray into which said second recording medium on which said recording head prints is discharged, wherein said medium holding plate, said medium supplying part and said discharge tray are disposed substantially parallel to one another.

21. An ink jet recording device according to claim 15, wherein when said first recording medium is loaded into or unloaded from said ink jet recording device, said medium holding plate is protruded to outside said ink jet recording device to a position where said first recording medium may be put on said medium holding plate.

22. An ink jet recording device according to claim 15, further comprising:

a motor for driving and moving said medium holding plate in said first direction;

a first region in which said motor drives and moves said medium holding plate in said first direction; and a second region in which said transporting system drives and transports said medium holding plate in said first direction.

23. An ink jet recording device according to claim 15, further comprising a motor for driving and moving said medium holding plate in said second direction.

24. An ink jet recording device according to claim 15, wherein when said first recording medium is loaded into and unloaded from said ink jet recording device, said medium holding plate remains at the same position.

25. An ink jet recording device according to claim 15, wherein said first transporting system and said second transporting system use a pinch roller for transporting said medium holding plate and said second recording medium in a first direction, and said ink jet recording device includes a pinch-roller distance changing mechanism which automatically changes a distance as viewed in thickness direction of said medium holding plate between said pinch roller and said medium holding plate in accordance with at least one of a thickness and a kind of said medium holding plate.

26. An ink jet recording device according to claim 25, wherein said pinch-roller distance changing mechanism causes said pinch roller to ascend to a height where said pinch roller does not contact with said medium holding plate when said medium holding plate is moved from a first region to a second region.

27. An ink jet recording device according to claim 25, wherein said pinch-roller distance changing mechanism includes free rollers, in printing on said first recording medium, said pinch-roller distance changing mechanism causes said free rollers to ascend so that said free rollers are not in contact with said first recording medium, and in printing on said second recording medium, said pinch-roller distance changing mechanism causes said free rollers to descend so that said free rollers are brought into contact with said first recording medium.

28. An ink jet recording device according to claim 25, wherein said recording head is coupled to said pinch-roller distance changing mechanism, and said pinch-roller distance changing mechanism keeps constant a distance between said first recording medium and said recording head, and keeps constant and a distance between said second recording medium and said recording head.

29. An ink jet recording device according to any of claims 18 to 25, wherein said medium holding plate, said medium supplying part and said discharge tray are accommodated in said ink jet recording device at least when said recording head ejects ink or said another recording medium is discharged into said discharge tray.

30. An ink jet recording device according to any of claims 18 to 25, wherein a guide part for guiding said medium holding plate is formed on said discharge tray when said medium holding plate moves in said second direction said medium holding plate is held by said guide part, and when said medium holding plate moves in said first direction, said medium holding plate is moved relative to said guide part.

31. An ink jet recording device according to claim 15, consists of at least one from the group of an optical recording medium, a recording medium, a magnetic recording medium, an electronic recording medium, a plastic card, a resin solid material and a metal solid material.

32. An ink jet recording device comprising:

a medium holding plate on which an optical recording medium is to be placed;

a medium supplying part for supplying a second recording medium;

a first transporting system for transporting said medium holding plate;

a second transporting system for transporting said second recording medium from said medium supplying part; and a recording head for ejecting ink to said first recording medium and said second recording medium on said medium holding plate, which is transported in a first direction by said first transporting system and said second transporting system,n wherein said medium holding plate is provided so as to be movable in a second direction which is different from said first direction, said medium holding plate moves along said second direction to a position outside said ink jet recording device only when said first recording medium may be loaded to or unloaded from said ink let recording device, and said medium supplying part further comprising a discharge tray into which said second recording medium on which said recording head prints is discharged, wherein said first direction and said second direction are orthogonal to each other.

33. An ink jet recording apparatus comprising:

a medium holding plate which is contained in said ink jet recording apparatus and on which a first recording medium is to be placed;

a first transporting system for reciprocatively transporting said medium holding plate along a first direction;

a medium tray which is contained in said ink jet recording apparatus and on which a second recording medium is to be placed, said medium tray being substantially parallel to said medium holding plate;

a second transporting system for transporting said second recording medium;

a recording head for ejecting ink to said first recording medium on said medium holding plate which is transported in said first direction by said first transporting system and said second recording medium transported by said second transporting system;

a loading mechanism for transporting said medium holding plate in a second direction perpendicular to said first direction and for switching between a protruding state and an accommodated state of said disc tray on the front side of said ink jet recording apparatus; and a discharge tray, provided parallel to said medium tray, for accommodating said second recording medium which has received ink ejected from said recording head;

wherein said medium tray, said discharge tray, and said medium holding plate are operated on the front side of said ink jet recording apparatus.

34. An ink jet recording apparatus according to claim 33, wherein said first transporting system and said second transporting system include each at least one transporting roller.

35. An ink jet recording apparatus according to claim 33, wherein said loading mechanism includes a motor provided in said ink jet recording apparatus, a pinion driven by said motor, and a gear which is provided on said medium holding plate so as to be in mesh with said pinion.

36. An ink jet recording apparatus according claim 33, wherein in said loading mechanism, an idle gear having an axial center which is offset from an axial center of said pinion in said first direction, is provided between said gear and said pinion.

37. An ink jet recording apparatus according to claim 33, wherein said first transporting system includes a medium holding plate transporting roller for transporting said medium holding plate in said first direction, a taper part tapered in said second direction is formed on said medium holding plate transporting roller, and when said medium holding plate is switched from said protruding state to said accommodated state, and said medium holding plate comes in contact with said medium holding plate transporting roller, said medium holding plate is guided by said taper part.

38. An ink jet recording apparatus according to any of claims 34 to 37, wherein said first transporting system includes a pinch roller provided opposite to said transporting roller, and a pinch-roller distance changing mechanism which changes a distance between said transporting roller and said pinch roller when said medium holding plate changes its transportation along said second direction to the transportation along said first direction and when a leading end of said medium holding plate as viewed in the direction of transporting said medium holding plate passes between said transporting roller and said pinch roller.

39. An ink jet recording apparatus according to claim 33, wherein said second transporting system includes a free roller, and a free roller select mechanism which brings said free roller into contact with said second recording medium during the transportation of said second recording medium, and lifts said free roller so as to detach said free roller from said medium holding plate during the transportation of said medium holding plate.

40. An ink jet recording apparatus according to claim 39, wherein said recording head is coupled to said pinch-roller distance changing mechanism, and said pinch-roller distance changing mechanism keeps constant a distance between said first recording medium and said recording head, and keeps constant a distance between said second recording medium and said recording head.

41. An ink jet recording apparatus according to claim 33, wherein said medium holding plate, said medium tray and said discharge tray are accommodated in said ink jet recording apparatus at least when said recording head ejects ink or said second recording medium is discharged into said discharge tray.

42. An ink jet recording apparatus according to claim 33, wherein said first recording medium includes at least one of an optical recording medium, a magnetic recording medium, an electronic recording medium, a plastic card, a resin solid material, and a metal solid material.

43. An ink jet recording apparatus according to claim 33, wherein said medium holding plate is provided above said medium tray, and said discharge tray is provided between said medium holding plate and said medium tray.

44. An ink jet recording apparatus according to claim 33, wherein said loading mechanism turns said medium holding plate by about 90° in a horizontal direction, whereby said medium holding plate is transported along said second direction.

45. An ink jet recording apparatus according to claim 33, wherein said loading mechanism includes a guide part for supporting said medium holding plate and an arcuate gear part which is provided on said guide part and engages with said pinion, said pinion engages with said arcuate gear part and said guide part horizontally turns by about 90°, whereby said medium holding plate, together with said guide part, is transported in said second direction, and said pinion engages with a gear provided on said medium holding plate and said medium holding plate slides on said guide part, whereby said medium holding plate is transported in said first direction.

46. An ink jet recording apparatus according to claim 33, wherein said loading mechanism includes a guide part for supporting said medium holding plate and a linear gear part which is provided on said guide part and engages with said pinion, said pinion engages with said linear gear part and said guide part, together with said medium holding plate, is transported in said second direction, and said pinion engages with a gear provided on said medium holding plate and said medium holding plate slides on said guide part, whereby said medium holding plate is transported in said first direction.

* * * * *

UNITED STATES PATENT AND TRADEMARK OFFICE

CERTIFICATE OF CORRECTION

PATENT NO. : 6,988,838 B2
DATED : January 24, 2006
INVENTOR(S) : Inokuchi et al.

It is certified that error appears in the above-identified patent and that said Letters Patent is hereby corrected as shown below:

Column 13,
Line 34, delete “apart” and insert -- a part --.

Column 15,
Line 46, delete “maybe” and insert -- may be --.

Column 17,
Line 11, delete “a but” and insert -- abut --.

Column 19,
Line 25, delete “maybe” and insert -- may be --.

Column 28,
Line 48, delete “let” and insert -- jet --.

Column 31,
Line 30, delete “direction” and insert -- direction, --.
Line 54, delete “n” after “system”.

Signed and Sealed this

Eighteenth Day of April, 2006

JON W. DUDAS
*Director of the United States Patent and Trademark Office*